US008041281B2

(12) United States Patent
Sugimoto et al.

(10) Patent No.: US 8,041,281 B2
(45) **Date of Patent: *Oct. 18, 2011**

(54) CLEANING DEVICE, IMAGE FORMING APPARATUS, AND PROCESS CARTRIDGE

(75) Inventors: Naomi Sugimoto, Kawasaki (JP); Hidetoshi Yano, Yokohama (JP); Kenji Sugiura, Yokohama (JP); Osamu Naruse, Yokohama (JP); Yasuyuki Yamashita, Zama (JP)

(73) Assignee: Ricoh Company Limited, Tokyo (JP)

( * ) Notice: Subject to any disclaimer, the term of this patent is extended or adjusted under 35 U.S.C. 154(b) by 494 days.

This patent is subject to a terminal disclaimer.

(21) Appl. No.: 12/030,608

(22) Filed: Feb. 13, 2008

(65) Prior Publication Data

US 2008/0193178 A1 Aug. 14, 2008

(30) Foreign Application Priority Data

Feb. 14, 2007 (JP) ..... 2007-033713

(51) Int. Cl.
*G03G 21/00* (2006.01)

(52) U.S. Cl. ..... 399/354; 399/343; 399/353

(58) Field of Classification Search ..... None
See application file for complete search history.

(56) References Cited

U.S. PATENT DOCUMENTS

| | | | | |
|---|---|---|---|---|
| 4,506,975 | A * | 3/1985 | Shukuri et al. | 399/354 |
| 5,606,408 | A | 2/1997 | Yano et al. | |
| 5,619,316 | A | 4/1997 | Shoji et al. | |
| 5,740,494 | A | 4/1998 | Shoji et al. | |
| 5,765,087 | A | 6/1998 | Yano et al. | |
| 5,999,773 | A | 12/1999 | Yasutomi et al. | |
| 6,799,012 | B2 | 9/2004 | Shakuto et al. | |
| 6,987,944 | B2 | 1/2006 | Shakuto et al. | |
| 7,062,212 | B2 | 6/2006 | Naruse et al. | |
| 7,103,301 | B2 | 9/2006 | Watanabe et al. | |
| 7,123,872 | B2 | 10/2006 | Shakuto et al. | |
| 7,184,699 | B2 | 2/2007 | Naruse et al. | |
| 7,209,699 | B2 | 4/2007 | Yamaguchi et al. | |
| 7,539,431 | B2 * | 5/2009 | Watanabe et al. | 399/71 |

(Continued)

FOREIGN PATENT DOCUMENTS

JP 1-292116 11/1989

(Continued)

OTHER PUBLICATIONS

U.S. Appl. No. 12/248,364, filed Oct. 9, 2009, Yano, et al.

(Continued)

*Primary Examiner* — David Porta
*Assistant Examiner* — Carolyn Igyarto
(74) *Attorney, Agent, or Firm* — Oblon, Spivak, McClelland, Maier & Neustadt, L.L.P.

(57) ABSTRACT

A cleaning device removes residual toner particles from a cleaning target, such as a photoconductor, which has a moving surface. The cleaning device includes a cleaning brush, a power circuit, and a cleaning member. The cleaning brush includes a brush rotation shaft, and the power circuit applies a first voltage of a first polarity to the brush rotation shaft. The cleaning member applies a second voltage of the first polarity to the cleaning brush. If the first polarity is negative, the cleaning member electrostatically removes toner particles having a positive polarity from the cleaning target. Then, the cleaning brush is triboelectrically charged to a second polarity, which is opposite to the first polarity, by contacting the cleaning target. Accordingly, the cleaning brush also removes residual toner particles having a negative polarity. Thus, the cleaning device removes both positively and negatively charged toner particles to clean the cleaning target.

19 Claims, 26 Drawing Sheets

U.S. PATENT DOCUMENTS

| | | | | |
|---|---|---|---|---|
| 2002/0067937 | A1* | 6/2002 | Morse et al. | 399/355 |
| 2004/0197122 | A1 | 10/2004 | Nakano et al. | |
| 2005/0058474 | A1 | 3/2005 | Watanabe et al. | |
| 2005/0254868 | A1 | 11/2005 | Naruse et al. | |
| 2006/0099016 | A1 | 5/2006 | Watanabe et al. | |
| 2006/0133872 | A1 | 6/2006 | Sugiura et al. | |
| 2006/0216085 | A1* | 9/2006 | Murakami et al. | 399/350 |
| 2006/0285897 | A1 | 12/2006 | Sugiura et al. | |
| 2006/0285898 | A1 | 12/2006 | Watanabe et al. | |
| 2007/0003337 | A1 | 1/2007 | Shakuto et al. | |
| 2007/0166087 | A1 | 7/2007 | Yamaguchi et al. | |

FOREIGN PATENT DOCUMENTS

| | | |
|---|---|---|
| JP | 3-64604 | 10/1991 |
| JP | 7-64444 | 3/1995 |
| JP | 7-33606 | 4/1995 |
| JP | 7-33637 | 4/1995 |
| JP | 7-53095 | 12/1995 |
| JP | 10-131035 | 5/1998 |
| JP | 10-310974 | 11/1998 |
| JP | 2001-282068 | 10/2001 |
| JP | 2003-280251 | 10/2003 |
| JP | 2005-134776 | 5/2005 |
| JP | 2005-265907 | 9/2005 |

OTHER PUBLICATIONS

U.S. Appl. No. 12/184,554, filed Aug. 1, 2008, Sugimoto, et al.

U.S. Appl. No. 09/035,997, filed Mar. 6, 1998, Hidetoshi Yano, et al.

* cited by examiner

HIGHER TEMPERATURE AND HUMIDITY

LOWER TEMPERATURE AND HUMIDITY

CLEANING DEVICE, IMAGE FORMING APPARATUS, AND PROCESS CARTRIDGE

CROSS-REFERENCE TO RELATED APPLICATIONS

The present patent application is based on and claims priority under 35 U.S.C. §119 from Japanese Patent Application No. 2007-033713, filed on Feb. 14, 2007 in the Japan Patent Office, the entire contents of which are incorporated herein by reference.

BACKGROUND OF THE INVENTION

1. Field of the Invention

Exemplary aspects of the present invention generally relate to a cleaning device employed in an image forming apparatus such as a copying machine, a facsimile machine, and a printer; a process cartridge; and an image forming apparatus that includes the cleaning device and the process cartridge.

2. Discussion of the Background

A related-art image forming apparatus, such as a copying machine, a facsimile machine, a printer, or a multifunction printer having two or more of copying, printing, scanning, and facsimile functions, forms a toner image on a recording medium (e.g., a sheet) according to image data using an electrophotographic method. In such a method, for example, a charger charges a surface of an image bearing member (e.g., a photoconductor). An optical device emits a light beam onto the charged surface of the photoconductor to form an electrostatic latent image on the photoconductor according to the image data. The electrostatic latent image is developed with a developer (e.g., a toner) to form a toner image on the photoconductor. A transfer device transfers the toner image formed on the photoconductor onto a sheet. A fixing device applies heat and pressure to the sheet bearing the toner image to fix the toner image onto the sheet. The sheet bearing the fixed toner image is then discharged from the image forming apparatus.

The related-art image forming apparatus further includes a cleaning device for removing toner particles remaining on a surface of the photoconductor after transfer has been performed. The cleaning device includes a cleaning blade formed of rubber, which contacts the photoconductor to remove the toner particles remaining on the surface of the photoconductor. When the cleaning blade does not accurately contact the photoconductor, the toner particles on the surface of the photoconductor pass through the cleaning blade and remain thereon, degrading cleaning performance. To solve such a problem, the cleaning blade is pressed against the photoconductor with a high linear pressure. However, the high linear pressure causes curling-up of the cleaning blade. As a result, a part of the toner particles are not removed by the cleaning blade and remain on the surface of the photoconductor in a linear or band-like shape. Thus, higher cleaning performance may not be stably obtained. Moreover, over an extended period of time, the surface of the photoconductor is further worn away, shortening a product life of the photoconductor.

To meet demand for higher quality images, toner particles having a smaller particle diameter and a spherical shape have been developed in recent years. Furthermore, to meet demand for reduction in manufacturing costs of toner and improvement in transfer rate, image forming apparatuses using toner having particles of a spherical shape manufactured using a polymerization method have become widely commercialized over those using pulverized toner having particles of an irregular shape. At the same time, however, it is known that the cleaning blade cannot reliably remove the toner particles having a smaller particle diameter and a spherical shape from the surface of the photoconductor as compared to pulverized toner particles.

One example of a cleaning device uses an electrostatic brush cleaning method to reliably remove the toner particles having a smaller particle diameter and a spherical shape from the surface of the photoconductor, and to prevent the surface of the photoconductor from being abraded by mechanical rubbing by the cleaning blade. In the electrostatic brush cleaning method, a cleaning brush is provided in contact with the surface of the photoconductor, and furthermore, a collecting roller serving as a cleaning member is provided in contact with the cleaning brush to remove the toner particles from the cleaning brush. A voltage is applied to the cleaning brush, or to both of the cleaning brush and the collecting roller. The toner particles charged to a polarity opposite to that of the voltage applied to the cleaning brush are electrostatically adhered to a brush string of the cleaning brush, so that the toner particles are removed from the surface of the photoconductor. Therefore, the electrostatic brush cleaning method can provide reliable and improved cleaning performance for the toner particles having a smaller particle diameter and a spherical shape.

Generally, a voltage with a polarity opposite to that of toner particles after development has been performed is applied to a transfer member so as to transfer the toner particles on the surface of the photoconductor onto a sheet. Therefore, a charge with a polarity opposite to that of the charge injected into the toner particles during development is injected into the toner particles on the surface of the photoconductor during transfer. Consequently, the more weakly charged toner particles are charged to the polarity opposite to that of the toner particles after development has been performed due to the charge injection during transfer described above. Therefore, a part of the toner particles remaining on the surface of the photoconductor after transfer has been performed have a polarity identical to that of the toner particles after development has been performed, and the other part of the toner particles have a polarity opposite to that of the toner particles after development has been performed. In other words, both toner particles charged to the polarity opposite to that of the voltage applied to the cleaning brush and toner particles charged to the polarity identical to that of the voltage applied to the cleaning brush remain on the surface of the photoconductor after transfer has been performed. Consequently, the toner particles on the surface of the photoconductor that are charged to the polarity identical to that of the voltage applied to the cleaning brush are not electrostatically adhered to the cleaning brush and pass through the cleaning brush, resulting in poor cleaning performance.

SUMMARY

In view of the foregoing, exemplary embodiments of the present invention provide a cleaning device including a cleaning brush to reliably clean toner particles charged to polarities opposite to, and identical to, a polarity of a voltage applied to the cleaning brush. Exemplary embodiments of the present invention further provide a process cartridge, and an image forming apparatus that includes the cleaning device and the process cartridge.

In one exemplary embodiment, a cleaning device includes a cleaning brush to which a voltage is applied to remove residual toner particles from a cleaning target having a moving surface. The cleaning brush is configured to be triboelectrically charged to a polarity opposite to that of the voltage applied to the cleaning brush by contacting the cleaning target.

Another exemplary embodiment provides an image forming apparatus including at least one image bearing member to bear an electrostatic latent image, a charging device to charge a surface of the image bearing member, an irradiating device to irradiate the charged surface of the image bearing member to form an electrostatic latent image thereon, at least one developing device to develop the electrostatic latent image with a toner to form a toner image, a transfer device to transfer the toner image onto a transfer member or a recording medium, and a cleaning device including a cleaning brush to which a voltage is applied to remove residual toner particles from a cleaning target having a moving surface. The cleaning brush is configured to be triboelectrically charged to a polarity opposite to that of the voltage applied to the cleaning brush by contacting the cleaning target, and the cleaning target is the image bearing member.

Yet another exemplary embodiment provides a process cartridge detachably attachable to an image forming apparatus, including an image bearing member, and a cleaning device including a cleaning brush to which a voltage is applied to remove residual toner particles from a cleaning target having a moving surface. The cleaning brush is configured to be triboelectrically charged to a polarity opposite to that of the voltage applied to the cleaning brush by contacting the cleaning target, and the cleaning target is the image bearing member.

Additional features and advantages of the present invention will be more fully apparent from the following detailed description of exemplary embodiments, the accompanying drawings and the associated claims.

BRIEF DESCRIPTION OF THE DRAWINGS

A more complete appreciation of the disclosure and many of the attendant advantages thereof will be readily obtained as the same becomes better understood by reference to the following detailed description of exemplary embodiments when considered in connection with the accompanying drawings, wherein.

DETAILED DESCRIPTION OF EXEMPLARY EMBODIMENTS

Figure 1:
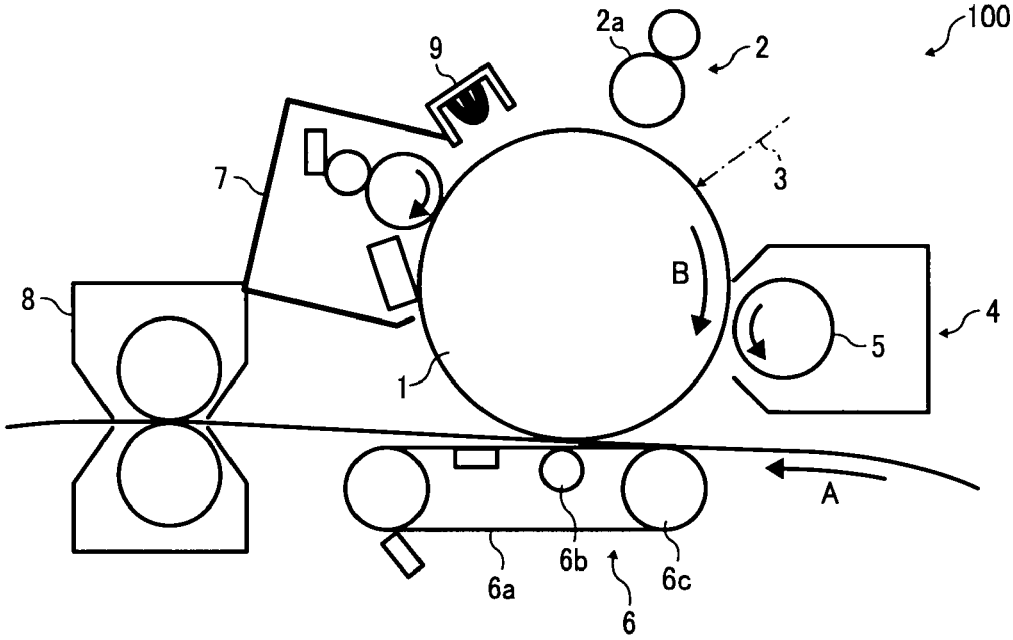
FIG. 1 is a schematic view illustrating main components of an image forming apparatus according to a first exemplary embodiment.

It will be understood that if an element or layer is referred to as being "on," "against," "connected to" or "coupled to" another element or layer, then it can be directly on, against connected or coupled to the other element or layer, or intervening elements or layers may be present.

In contrast, if an element is referred to as being "directly on", "directly connected to" or "directly coupled to" another element or layer, then there are no intervening elements or layers present. Like numbers refer to like elements throughout.

As used herein, the term "and/or" includes any and all combinations of one or more of the associated listed items.

Spatially relative terms, such as "beneath", "below", "lower", "above", "upper" and the like, may be used herein for ease of description to describe one element or feature's relationship to another element(s) or feature(s) as illustrated in the figures.

It will be understood that the spatially relative terms are intended to encompass different orientations of the device in use or operation in addition to the orientation depicted in the figures.

For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein interpreted accordingly.

Although the terms first, second, etc. may be used herein to describe various elements, components, regions, layers and/or sections, it should be understood that these elements, components, regions, layers and/or sections should not be limited by these terms.

These terms are used only to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise.

It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing exemplary embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Exemplary embodiments of the present invention are now described below with reference to the accompanying drawings.

In a later-described comparative example, exemplary embodiment, and exemplary variation, for the sake of simplicity the same reference numerals will be given to identical constituent elements such as parts and materials having the same functions and redundant descriptions thereof omitted unless otherwise stated.

Typically, but not necessarily, paper is the medium from which is made a sheet on which an image is to be formed. It should be noted, however, that other printable media are available in sheets, and accordingly their use here is included. Thus, solely for simplicity, although this Detailed Description section refers to paper, sheets thereof, paper feeder, etc., it should be understood that the sheets, etc., are not limited only to paper but includes other printable media as well.

A first exemplary embodiment of the present invention employed in an electrophotographic printer serving as an image forming apparatus (hereinafter simply referred to as a "printer 100") is described in detail below.

FIG. 1 is a schematic view illustrating main components of the printer 100 according to the first exemplary embodiment. A drum-type photoconductor 1 serving as an image bearing member is rotated in a direction indicated by an arrow B in FIG. 1 at a speed of 250 mm/sec. A charger 2 serving as a charging unit evenly charges a surface of the photoconductor 1, and subsequently, an optical writing device serving as a latent image forming unit irradiates a light beam 3 based on image data read by a document reading device, not shown. Consequently, an electrostatic latent image is formed on the surface of the photoconductor 1. A developing device 4 develops the electrostatic latent image formed on the surface of the photoconductor 1 with a toner. The developing device 4 includes a developing roller 5 to carry and convey a dry developer including a toner and a carrier, and the toner is charged to a predetermined polarity, for example, to the negative polarity in the first exemplary embodiment. The toner included in the developer is carried and conveyed by the developing roller 5, and is electrostatically transferred onto the electrostatic latent image formed on the surface of the photoconductor 1 to form a toner image. Meanwhile, a paper feeder, not shown, feeds a sheet in a direction indicated by an arrow A in FIG. 1, and a transfer device 6 transfers the toner image formed on the surface of the photoconductor 1 onto the sheet. The sheet having a transferred toner image thereon is conveyed to a fixing device 8, and the fixing device 8 applies heat and pressure to the sheet to fix the toner image to the sheet. Thereafter, the sheet having a fixed toner image thereon is discharged to a discharging device, not shown.

Residual toner particles remaining on the surface of the photoconductor 1 after the toner image has been transferred onto the sheet are removed by a cleaning device 7. Thereafter, a neutralizing lamp 9 neutralizes an electric charge remaining on the surface of the photoconductor 1 passing through the cleaning device 7.

The charger 2 illustrated in FIG. 1 includes a charging roller 2*a* including a conductive substrate and a resistive layer provided on the conductive substrate. The charging roller 2*a* is pressed against the surface of the photoconductor 1 by a pressing unit, not shown, with a predetermined pressure of, for example, 500 gf, so that the charging roller 2*a* contacts the surface of the photoconductor 1 so as to trail the photoconductor 1. However, when a surface of the charging roller 2*a* has a sufficiently smaller static friction coefficient, the charging roller 2*a* may not trail the photoconductor 1. Therefore, to obtain stable contact pressure between the charging roller 2*a* and the surface of the photoconductor 1, a driving device to rotatively drive the charging roller 2*a* may be provided. A longitudinal length, namely an axial length, of the charger 2 including the charging roller 2*a* is set longer than a width in a lateral direction of A4 size paper (about 300 mm), which is the maximum image width according to the first exemplary embodiment.

A power source, not shown, is connected to the conductive substrate of the charging roller 2*a* to apply a voltage to the charging roller 2*a* such that a potential difference between the surface of the photoconductor 1 and the charging roller 2*a* becomes greater than a voltage at the beginning of electric discharge. In the first exemplary embodiment, the voltage is applied to the charging roller 2*a* so that the surface of the photoconductor 1 is charged to an electric potential of −700V. Therefore, the electric discharge occurs in the vicinity of a portion where the charging roller 2*a* contacts the photoconductor 1, so that the surface of the photoconductor 1 is evenly charged. For example, a DC voltage overlapped with an AC voltage, with a frequency of 1.8 kHZ, a peak voltage of 2 kV, and an offset voltage of −740V, is applied to the charging roller 2*a* in the first exemplary embodiment. However, because application of the DC voltage can more effectively suppress generation of nitrogen oxides as compared to application of the DC voltage overlapped with the AC voltage, it is preferable to apply the DC voltage to the charging roller 2*a* in order to suppress generation of ozone and nitrogen oxides, although the application of the DC voltage overlapped with the AC voltage can more evenly charge the surface of the photoconductor 1 as compared to the application of the DC voltage. In place of the charging roller 2*a*, a charging blade, a charging brush, or the like, may also be used.

As described above, in the first exemplary embodiment, the charging roller 2*a* is provided in contact with the surface of the photoconductor 1. Alternatively, for example, the charging roller 2*a* may be provided apart from the surface of the photoconductor 1. In a case of using such a contactless-type charging roller, a predetermined voltage is applied to the contactless-type charging roller so as to generate electric discharge between the contactless-type charging roller and the photoconductor 1, and consequently, the surface of the photoconductor 1 is charged to a predetermined polarity. Thus, the charging roller 2*a* provided in contact with, or apart from, the surface of the photoconductor 1 may be preferably employed in the first exemplary embodiment.

The transfer device 6 includes a transfer belt 6*a* capable of contacting and separating from the surface of the photoconductor 1, a transfer roller 6*b*, a driving roller 6*c*, and so forth. After the developing device 4 has been developed the electrostatic latent image formed on the surface of the photoconductor 1 with a toner to form a toner image, the transfer device 6 transfers the toner image onto a sheet. At this time, a transfer voltage with a polarity opposite to that of the toner of the toner image, for example, a positive transfer voltage controlled by a constant current of 30 μA, is applied to the transfer roller 6*b* included in the transfer device 6. Accordingly, a part of residual toner particles remaining on the surface of the photoconductor 1 after transfer has been performed may have a positive polarity, which is opposite to that of the toner during development, due to the application of the positive transfer voltage. As a result, a mixture of the positively charged residual toner particles and the negatively charged residual toner particles remains on the surface of the photoconductor 1.

Although the transfer device 6 illustrated in FIG. 1 includes the transfer belt 6*a*, the transfer roller 6*b*, the driving roller 6*c*, and so forth, any transfer device with an appropriate configuration may also be used in the first exemplary embodiment.

A description is now given of the cleaning device 7 according to the first exemplary embodiment.

Figure 2:
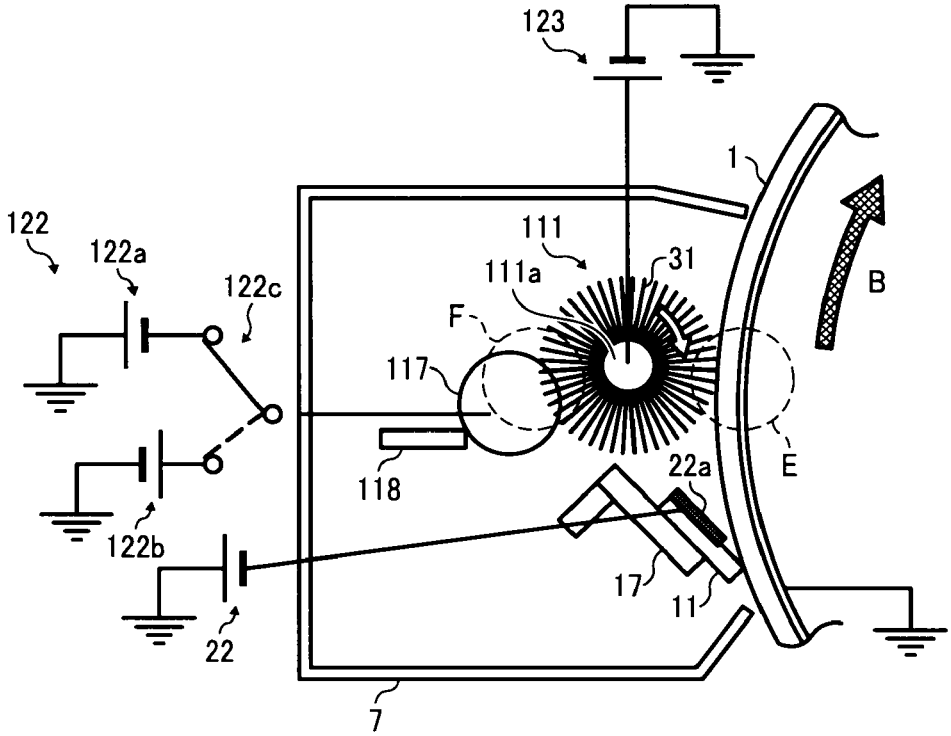
FIG. 2 is a schematic view illustrating a cleaning device employed in the image forming apparatus illustrated in FIG. 1.

FIG. 2 is a schematic view illustrating the cleaning device 7. Referring to FIG. 2, the cleaning device 7 includes a conductive blade 11 serving as a polarity control member, a cleaning brush 111, and so forth. The conductive blade 11 is provided on an upstream side from the cleaning brush 111 relative to a rotation direction of the photoconductor 1. The conductive blade 11 includes an elastic body such as rubber having an electric resistivity of from $10^5$ to $10^9\Omega\cdot$cm. The conductive blade 11 contacts the surface of the photoconductor 1 so as to face in the rotation direction of the photoconductor 1 with a contact pressure of from 20 to 40 g/cm. The conductive blade 11 is provided on a blade holder 17 in the cleaning device 7. An electrode 22*a* is attached to the conductive blade 11 in a longitudinal direction, and is connected to a first power circuit 22 for applying a voltage to the electrode 22*a*. The voltage is applied to the conductive blade 11 through the electrode 22*a*, so that a charge is injected into the residual toner particles on the surface of the photoconductor 1 when the residual toner particles pass through the conductive blade 11. Consequently, the residual toner particles are controlled to have a single polarity by the conductive blade 11.

The cleaning brush 111 is rotated by a driving unit, not shown, in a direction same as the rotation direction of the photoconductor 1. The cleaning brush 111 includes a brush string 31 in which a conductive material such as carbon and an ionic conductive material is incorporated into an insulating string including a material such as nylon, polyester, and acrylic so as to provide conductive property to the brush string 31. A foundation cloth in which the brush strings 31 are implanted is wound on a metal core such as a stainless steel to form the cleaning brush 111. A third power circuit 123 is connected to a brush rotation shaft 111*a* of the cleaning brush 111 to apply a voltage with a polarity opposite to that of the voltage applied to the conductive blade 11 to the cleaning brush 111.

The cleaning device 7 further includes a collecting roller 117 in contact with the cleaning brush 111, and a second power circuit 122 for applying a voltage to the collecting roller 117. The second power circuit 122 includes a first power source 122*a* for applying a voltage to the collecting roller 117. The voltage applied to the collecting roller 117 from the first power source 122*a* is higher than the voltage applied to the cleaning brush 111, and has a polarity identical to that of the voltage applied to the cleaning brush 111. The second power circuit 122 further includes a second power source 122*b* for applying a voltage with a polarity opposite to that of the voltage applied to the cleaning brush 111 to the collecting roller 117, and a switching unit 122*c* for switching the power source to apply the voltage to the collecting roller 117 between the first power source 122*a* and the second power source 122*b*. In other words, the switching unit 122*c* switches the polarity of the voltage applied to the collecting roller 117. The cleaning device 7 further includes a scraper 118 in contact with the collecting roller 117, a conveyance coil, not shown, and so forth.

After the residual toner particles has been passed thorough the conductive blade 11, the cleaning brush 111 electrostatically collects the residual toner particles with the polarity identical to that of the voltage applied to the conductive blade 11. The residual toner particles collected by the cleaning brush 111 are conveyed to a portion facing the collecting roller 117 along with the rotation of the cleaning brush 111, and are electrostatically collected by the collecting roller 117. The residual toner particles collected by the collecting roller 117 are scraped off by the scraper 118, and are conveyed to a waste toner container, not shown, by the conveyance coil, not shown.

A description is now given of a charge amount of the residual toner particles which remain on the surface of the photoconductor 1 and are conveyed to the portion facing the cleaning device 7.

Figure 3:
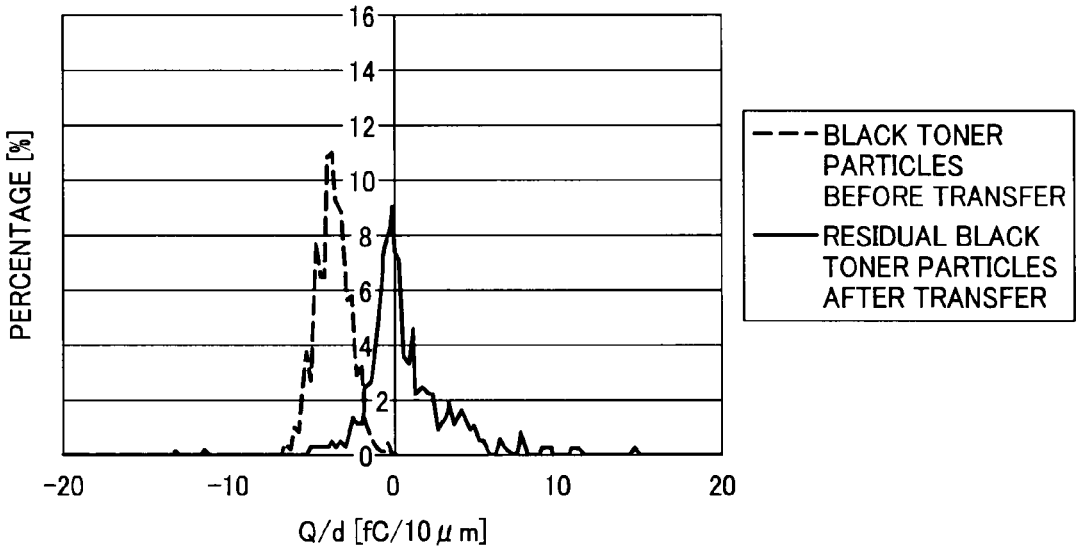
FIG. 3 is a graph illustrating charge distributions of toner particles on a surface of a photoconductor before and after transfer is performed.

FIG. 3 is a graph illustrating charge distributions of each of black toner particles on the surface of the photoconductor 1 immediately before transfer (i.e., after development) is performed, and residual black toner particles remaining on the surface of the photoconductor 1 after transfer has been performed. Referring to FIG. 3, the black toner particles on the surface of the photoconductor 1 immediately before transfer is negatively charged. A part of such negatively charged black toner particles are inverted to positively charged black toner particles due to positive charge injection applied from the transfer roller 6*b*, or are turned into black toner particles with no charge. Therefore, as illustrated in FIG. 3, a mixture of the positively and negatively charged black residual toner particles remains on the surface of the photoconductor 1 after transfer has been performed.

Figure 4:
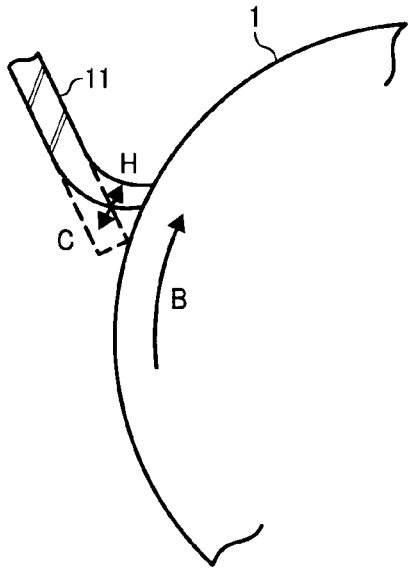
FIG. 4 is an enlarged schematic view illustrating a conductive blade when the photoconductor is rotated.

The residual toner particles which remain on the surface of the photoconductor 1 and pass through a portion facing the transfer roller 6*b* are conveyed to a portion facing the conductive blade 11 along with the rotation of the photoconductor 1. Most of the residual toner particles conveyed to the portion facing the conductive blade 11 are mechanically scrapped off by the conductive blade 11. However, referring to FIG. 4, the conductive blade 11 in contact with the surface of the photoconductor 1 is deformed in the rotation direction of the photoconductor 1, causing a stick-slip motion. In the stick-slip motion, a rubber included in the conductive blade 11 is elastically stretched in the rotation direction of the photoconductor 1 at a portion where the conductive blade 11 contacts the surface of the photoconductor 1, and consequently, the conductive blade is deformed as illustrated in a state H with a solid line. When being stretched to the limit, the conductive blade 11 returns to an original state as illustrated in a state C with a dotted line. Therefore, the residual toner particles on the surface of the photoconductor 1 pass through the conductive blade 11 when the state of the conductive blade 11 changes from the state H to the state C.

Figure 5:
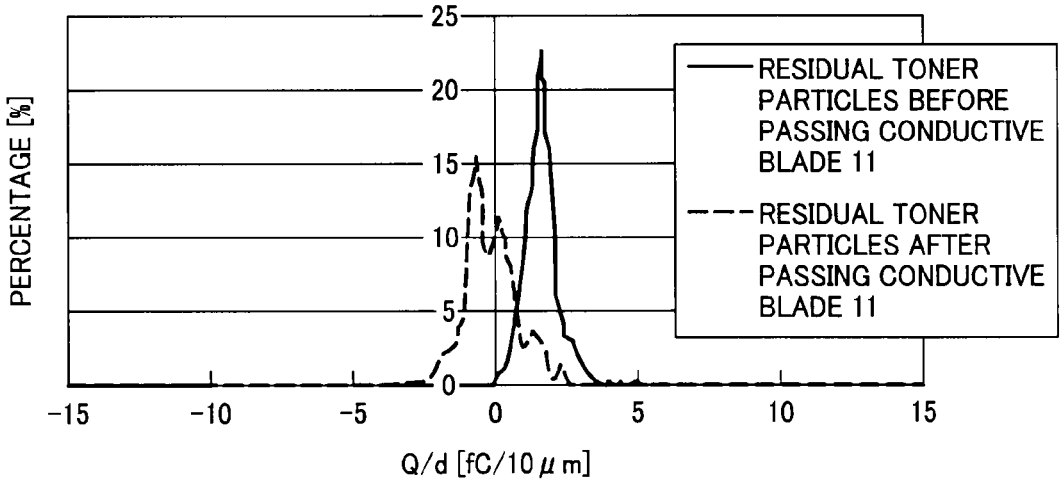
FIG. 5 is a graph illustrating charge distributions of toner particles on the surface of the photoconductor before and after the toner particles pass through the conductive blade.

FIG. 5 is a graph illustrating charge distributions of each of toner particles on the surface of the photoconductor 1 which are experimentally positively charged by corona discharge by using a testing machine, and residual toner particles remaining on the surface of the photoconductor 1 after passing through the conductive blade 11 which is electrically floated. Referring to FIG. 5, the residual toner particles are slightly charged to the negative polarity after passing the portion facing the conductive blade 11, so that the charge distribution of the residual toner particles on the surface of the photoconductor 1 after passing through the conductive blade 11 shifts toward the negative polarity side, which is the regular polarity of the toner particles. The reason is thought that a part of the residual toner particles are triboelectrically negatively charged when passing through the conductive blade 11 due to a pressure from the conductive blade 11. However, as illustrated in FIG. 5, a mixture of the positively and negatively charged residual toner particles still remains on the surface of the photoconductor 1 after passing through the conductive blade 11.

Referring back to FIG. 3, the residual toner particles on the surface of the photoconductor 1 after transfer have a broader charge distribution including both the positively and negatively charged toner particles. Accordingly, the residual toner particles passing through the conductive blade 11 are not entirely charged to the single polarity, namely, the regular polarity of the toner particles. As a result, either one of the residual toner particles which are not charged to the regular polarity, and the residual toner particles which are charged to the regular polarity, cannot be collected by the cleaning brush 111, causing cleaning residual toner particles, which are the residual toner particles that remain on the photoconductor 1 after cleaning.

To solve such a problem, the voltage is applied to the conductive blade 11 as described above so as to inject a charge into the residual toner particles passing through the conductive blade 11. Thus, the residual toner particles are controlled to have the single polarity by the conductive blade 11.

In a case in which the voltage applied to the conductive blade 11 is sufficiently lower than the voltage at the beginning of the electric discharge, it is considered that the residual toner particles are charged to the polarity identical to that of the voltage applied to the conductive blade 11. That is, the residual toner particles are sandwiched between the conductive blade 11 and the photoconductor 1 when passing therebetween, and are charged to the polarity identical to that of the applied voltage in a similar way as, for example, a condenser is charged. In other words, charge injection into the residual toner particles occurs when the residual toner particles pass between the conductive blade 11 and the photoconductor 1. Thus, the residual toner particles after passing thorough the conductive blade 11 are charged to the polarity identical to that of the voltage applied to the conductive blade 11 due to the charge injection.

In a case in which the voltage applied to minute gaps between the conductive blade 11 and the residual toner particles, or the conductive blade 11 and the surface of the photoconductor 1, is close to, or higher than the voltage at the beginning of the electric discharge, it is considered that the residual toner particles are charged to the polarity identical to that of the voltage applied to the conductive blade 11. That is, the residual toner particles are charged to the polarity identical to that of the voltage applied to the conductive blade 11 by electric discharge from the minute gaps at an entry and an exit of a wedge portion formed between the photoconductor 1 and the conductive blade 11.

However, even when the voltage is applied to the conductive blade 11 to control the polarity of the residual toner particles passing through the conductive blade 11, the residual toner particles may not be entirely controlled to have the single polarity. One of possible reason for this is that the polarity of toner particles is not easily controlled depending on toner types. The other possible reason is that the charge distributions of the residual toner particles passing through the conductive blade 11 vary depending on usage conditions, a number of adhered toner particles per unit area, an amount of transfer current, an area ratio of an image, toner types, and so forth. Accordingly, the residual toner particles passing through the conductive blade 11 may not be entirely controlled to have the polarity identical to that of the voltage applied to the conductive blade 11. In such a case, a part of the residual toner particles may not be electrostatically collected by the cleaning brush 111, causing cleaning residual toner particles.

Figure 6:
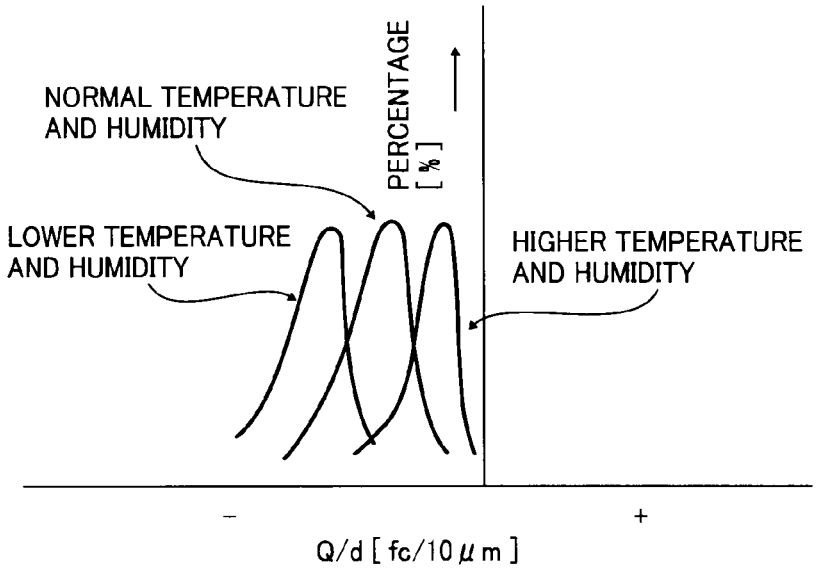
FIG. 6 is a graph illustrating charge distributions of the toner particles on the surface of the photoconductor before transfer is performed under various environmental conditions.
Figure 7:
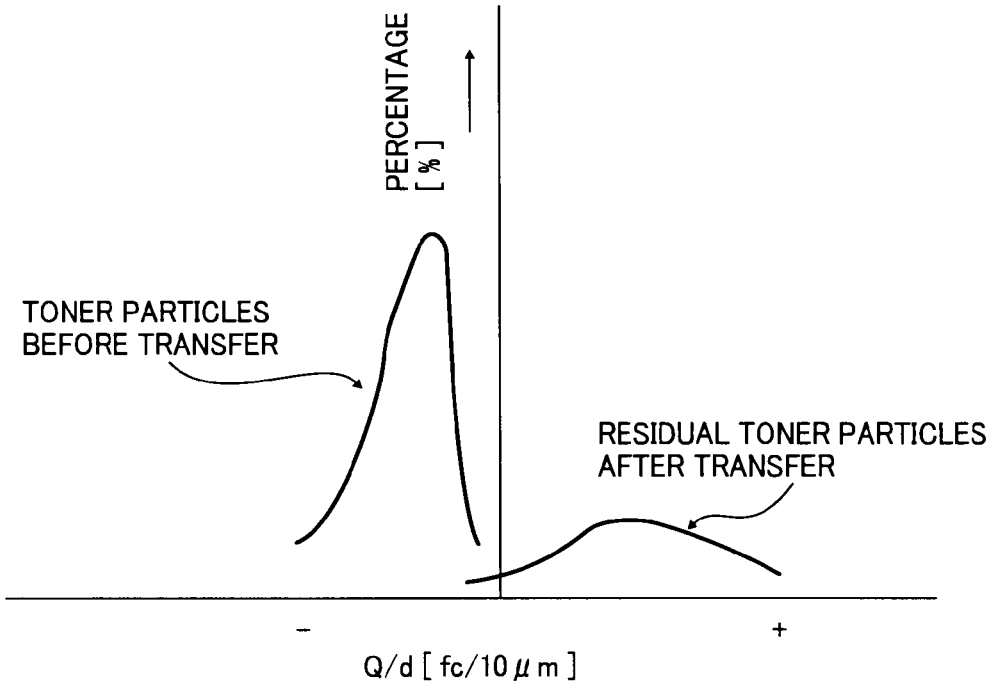
FIG. 7 is a graph illustrating charge distributions of the toner particles on the surface of the photoconductor before and after transfer is performed at higher temperature and humidity.
Figure 8:
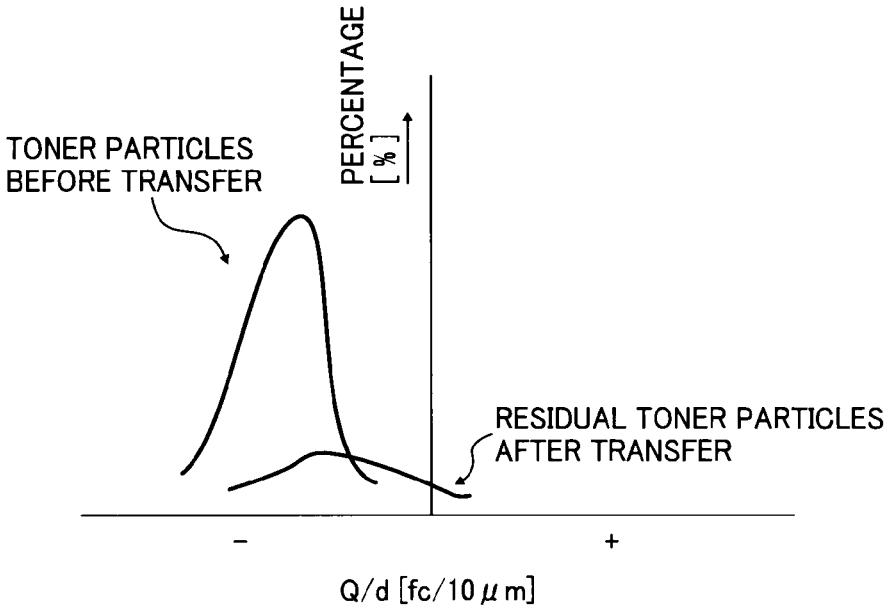
FIG. 8 is a graph illustrating charge distributions of the toner particles on the surface of the photoconductor before and after transfer is performed at lower temperature and humidity.

For example, referring to FIGS. 6 through 8, the charge distributions of toner particles vary depending on usage conditions. The charge distributions of the toner particles illustrated in FIGS. 6 through 8 are measured by using E-SPART analyzer manufactured by Hosokawa Micron Corporation. A horizontal axis of each of the graphs in FIGS. 6 through 8 represents a Q/d value, with a unit of fC/10 μm, obtained by dividing a charge amount Q per toner particle by a diameter d of the toner particle, and a vertical axis represents a percentage out of a total amount of collected toner particles. Here, only 500 toner particles are collected for the measurement due to a smaller amount of the residual toner particles on the surface of the photoconductor 1.

FIG. 6 is a graph illustrating the charge distributions of the toner particles on the surface of the photoconductor 1 after development has been performed under environmental conditions at a higher temperature of 30° C. and a higher humidity of 90%, a normal temperature of 20° C. and a normal humidity of 50%, and a lower temperature of 10° C. and a lower humidity of 15%. Because a toner particle is charged by friction with a carrier, the toner particle tends not to be negatively charged at the higher humidity, and consequently, a number of negatively charged toner particles decreases under such an environmental condition. Therefore, as illustrated in FIG. 6, the charge distribution at the higher temperature and humidity is closer to zero as compared to the charge distribution at the normal temperature and humidity, and the charge distribution at the lower temperature and humidity is further apart from zero as compared to the charge distribution at the normal temperature and humidity.

FIG. 7 is a graph illustrating charge distributions of the toner particles on the surface of the photoconductor 1 before and after transfer is performed at the higher temperature and humidity. FIG. 8 is a graph illustrating charge distributions of the toner particles on the surface of the photoconductor 1 before and after transfer is performed at the lower temperature and humidity. Referring to FIG. 7, the charge distribution of the residual toner particles on the surface of the photoconductor 1 after transfer has been performed is shifted toward the positive polarity side at the higher temperature and humidity as compared to the charge distribution at the normal temperature and humidity. Referring to FIG. 8, the charge distribution of the residual toner particles on the surface of the photoconductor 1 after transfer has been performed is shifted toward the negative polarity side at the lower temperature and humidity as compared to the charge distribution at the normal temperature and humidity. The charge distribution of the toner particles may be changed depending on transfer conditions such as a thickness of the sheet.

Even in a case in which the charge distributions of the toner particles vary depending on the usage conditions, the transfer conditions, an area ratio of an image, and so forth, 90 percent of the residual toner particles passing through the conductive blade 11 are charged to the polarity identical to that of the voltage applied to the conductive blade 11 by appropriately applying the voltage to the conductive blade 11. However, for example, only 80 percent of the residual toner particles passing through the conductive blade 11 may be charged to the polarity identical to that of the voltage applied to the conductive blade 11 depending on toner types even if a voltage of 1 kV is applied to the conductive blade 11. So far, it is not known that which factor in the toner types causes improper control of the polarity of the residual toner particles. However, the remaining 20 percent of the residual toner particles with the polarity opposite to that of the voltage applied to the conductive blade 11 can be collected by the cleaning brush 111 after passing through the conductive blade 11 by using the cleaning device 7 to be described in detail below. Therefore, a number of the residual toner particles which are not collected by the cleaning brush 11 and pass through the cleaning brush 111 can be suppressed.

The cleaning device 7 according to the first exemplary embodiment includes the cleaning brush 111 including the brush string 31. The brush string 31 are charged to the polarity identical to that of the voltage applied to the conductive blade 11 by contacting the surface of the photoconductor 1. In other words, the brush string 31 includes a material which is charged to the polarity identical to that of the voltage applied to the conductive blade 11 by friction with a material included in the surface of the photoconductor 1.

The voltage with the polarity opposite to that of the voltage applied to the conductive blade 11 is applied to the cleaning brush 111, so that the residual toner particles passing through the conductive blade 11, 90 percent or more of which have the polarity identical to that of the voltage applied to the conductive blade 11, are electrostatically collected by the cleaning blade 11.

Less than 10 percent of the residual toner particles passing through the conductive blade 11, of which polarity is not controlled by the conductive blade 11, namely, the toner particles with the polarity opposite to that of the voltage applied to the conductive blade 11, electrostatically adhere to the cleaning brush 111 when the brush string 31 contacts the surface of the photoconductor 1 so as to be charged to the polarity identical to that of the voltage applied to the conductive blade 11. More specifically, the residual toner particles with the polarity opposite to that of the voltage applied to the conductive blade 11 adhere to the cleaning brush 111 by an electrostatic attraction between an electric potential of an insulating layer of the cleaning brush 111 and a charge amount of the residual toner particles.

The residual toner particles with the polarity not controlled by the conductive blade 11 adhere to the brush string 31 charged by contacting the photoconductor 1. Because such residual toner particles have a larger amount of charge with the polarity opposite to that of the voltage applied to the conductive blade 11, namely the positive polarity, before passing through the conductive blade 11, the polarity of the residual toner particles is not reversed even when the negative charge is injected into the residual toner particles from the conductive blade 11. However, the amount of charge of such positively charged residual toner particles decreases after passing through the conductive blade 11 due to the negative charge injection from the conductive blade 11, resulting in the residual toner particles with a smaller amount of charge. Therefore, it is thought that electrostatic attraction between the photoconductor 1 and the toner particles with a smaller amount of charge is weaker, so that the residual toner particles easily adhere to the brush string 31 charged by contacting the photoconductor 1. The residual toner particles still have a smaller amount of charge after being collected by the brush string 31, so that intermolecular force between the residual toner particles and the brush strings 31, and a force generated between each of the brush string 31 to collect the residual toner particles are stronger than an electric field between the photoconductor 1 and the cleaning brush 111. Therefore, the residual toner particles adhering to the brush string 31 rarely adhere to the surface of the photoconductor 1 again, and remain adhering to the brush string 31.

Figure 9A:
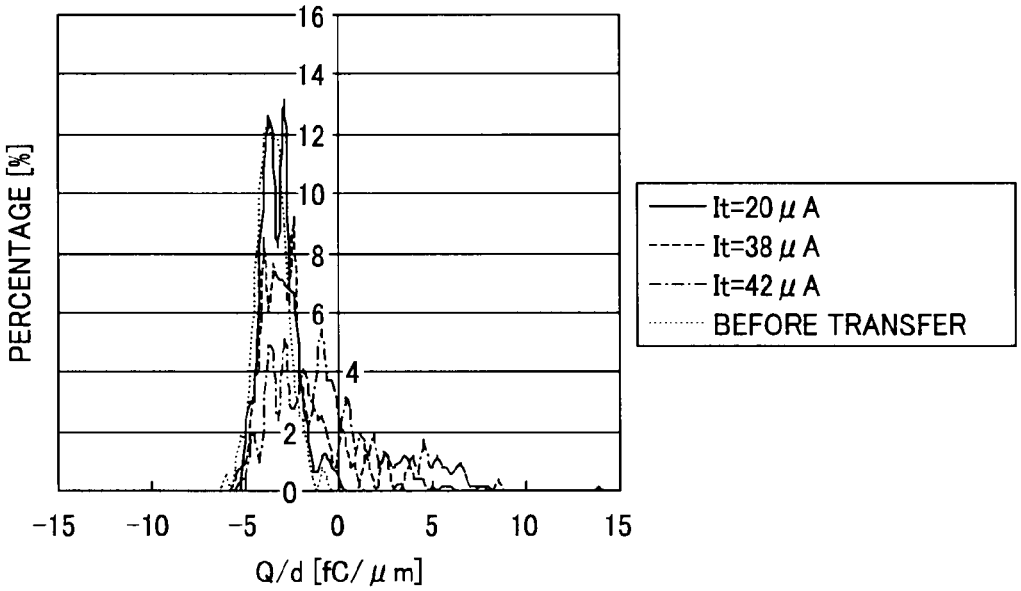
FIG. 9A is a graph illustrating charge distributions of the residual toner particles after transfer has been performed with various transfer currents.
Figure 9B:
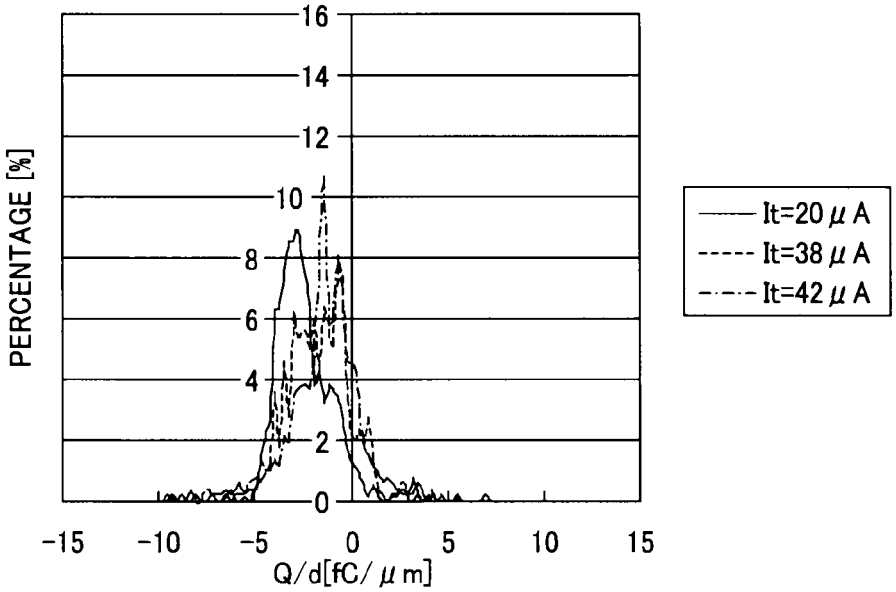
FIG. 9B is a graph illustrating charge distributions of residual toner particles adhering to a cleaning brush.

A description is now given of an experiment performed by the present inventors. In the experiment, the cleaning brush 111 is electrically floated, and a voltage of 300V is applied to the collecting roller 117. The cleaning brush 111 includes a material which is located in the negative side in the triboelectric series with the material included in the surface of the photoconductor 1, for example, the brush string 31 is formed of polyester and has a bent shape. The conductive blade 11 is removed from the cleaning device 7, and in order to obtain positively charged toner particles which are not expected to be electrostatically collected by the cleaning brush 111, three types of transfer currents (It) of 20 μA, 38 μA, and 42 μA, are respectively applied. Accordingly, a mixture of the positively and negatively charged residual toner particles of a solid image are conveyed to the cleaning brush 111. FIG. 9A is a graph illustrating charge distributions of the residual toner particles before cleaning is performed by the cleaning brush 111, and FIG. 9B is a graph illustrating charge distributions of the residual toner particles collected by the cleaning brush 111. An electrically floated metal plate is contacted with the leading edge of the cleaning brush 111 during cleaning to measure an electric potential of the leading edge of the cleaning brush 111 by using a surface electrometer. As a result, the electric potential of the leading edge of the cleaning brush 111 is 220V, which is lower than the voltage of 300V applied to the collecting roller 117.

Referring to FIG. 9B, it is found out that the positively charged residual toner particles are collected by the cleaning brush 111 in spite of the fact that the electric potential of the leading edge of the cleaning brush 111 has a positive electric potential of 220V. For this reason, it is thought that the positively charged residual toner particles adhere to the cleaning brush 111 because the brush string 31 is charged to the negative polarity by contacting the photoconductor 1.

A description is now given of verification experiments performed by the present inventors.

A foundation cloth having a conductive polyester brush string thereon is wound on a metal core to form the cleaning brush 111. The cleaning brush 111 is electrically floated, and photoconductors 1 to be described in detail later are placed in the dark. Conductive substrates of each of the photoconductors are grounded when electric potentials of each of surfaces of the photoconductors are 0V. When an electric potential of the core metal of the cleaning brush 111 is measured by a surface electrometer while rotating the cleaning brush 111 and the photoconductors, the core metal of the cleaning brush 111 has an electric potential of −30V. This means the conductive polyester brush string is charged to −30V. On the other hand, when the experiment is performed by using the cleaning brush 111 including a nylon brush string including the above-described conductive material in a similar way as described above, the core metal of the cleaning brush 111 has an electric potential of +70V. This means the conductive nylon brush string is charged to +70V.

In order to collect the residual toner particles passing through the conductive blade 11, 90 percent of which are negatively charged and 10 percent of which are positively charged, a voltage of +200V is applied to the core metal of the cleaning brush 111 including the conductive polyester brush string, and a voltage of +300V is applied to a high-resistance collecting roller 117*a* for rotatively contacting the conductive brush 111 to collect the residual toner particles from the cleaning brush 111. As a result, the residual toner particles are reliably collected by the high-resistance collecting roller 117*a*. The high-resistance collecting roller 117*a* includes a stainless steel roller, of which surface is covered with a PVDF tube with a thickness of 100 μm, and is further coated with an insulating coating layer with a thickness of 3 μm. The use of the high-resistance collecting roller 117*a* can stabilize a potential difference between the cleaning brush 111 and the high-resistance collecting roller 117*a*, so that the residual toner particles can be reliably collected from the cleaning brush 111 by the high-resistance collecting roller 117*a* to be described in detail later.

Meanwhile, in order to collect the residual toner particles passing through the conductive blade 11, 90 percent of which are negatively charged and 10 percent of which are positively charged, a voltage is applied to the metal core of the cleaning brush 111 including the conductive nylon brush string under the condition same as that of the above-described verification experiment. However, the residual toner particles cannot be reliably collected from the cleaning brush 111 by the high-resistance collecting roller 117*a*.

Next, in order to collect the residual toner particles passing through the conductive blade 11, 90 percent of which are negatively charged and 10 percent of which are positively charged, a voltage of −200V is applied to the metal core of the cleaning brush 111 including the conductive nylon brush string, and a voltage of −300V is applied to the high-resistance collecting roller 117*a*. As a result, the residual toner particles can be reliably collected from the cleaning brush 111 by the high-resistance collecting roller 117*a*.

Meanwhile, in order to collect the residual toner particles passing through the conductive blade 11, 90 percent of which are negatively charged and 10 percent of which are positively charged, a voltage is applied to a metal core of the cleaning brush 111 including the conductive polyester brush string under the condition same as that of the above-described verification experiment. However, the residual toner particles cannot be reliably collected from the cleaning brush 111 by the high-resistance collecting roller 117*a*.

From the results of the verification experiments described above, it is found out that the use of the brush string 31 which are charged to the polarity identical to that of the voltage applied to the conductive blade 11 by contacting the photoconductor 1 can provide preferred cleaning performance.

Figure 10A:
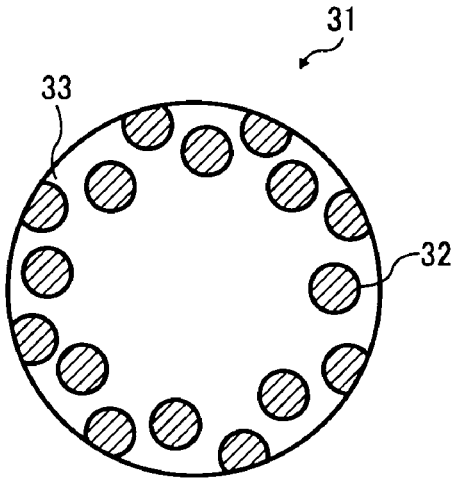
FIG. 10A RELATED ART
FIG. 10A is a cross-sectional view illustrating an example of a brush string of the cleaning brush used in a related-art cleaning device.
Figure 10B:
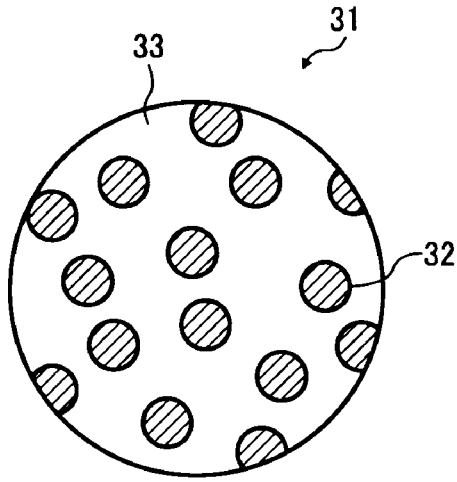
FIG. 10B RELATED ART
FIG. 10B is a cross-sectional view illustrating another example of the brush string of the cleaning brush used in the related-art cleaning device.

When the cleaning brush 111 includes a conductive material 32 dispersed in a surface part of the brush string 31 as illustrated in FIGS. 10A and 10B, the conductive material 32 easily contacts the residual toner particles so that a larger amount of current flows into the residual toner particles between the photoconductor 1 and the cleaning brush 111. As a result, the residual toner particles tend to be strongly charged to the polarity identical to that of the voltage applied to the cleaning brush 111.

The charge distribution of the residual toner particles has an influence on the polarity of the residual toner particles when being controlled by the conductive blade 11. In a case in which the charge distribution of the residual toner particles is extremely shifted toward the positive polarity side, a mixture of the negatively charged residual toner particles with a smaller amount of charge and the positively charged residual toner particles remains on the surface of the photoconductor 1 even after the polarity of the residual toner particles has been controlled by the conductive blade 11. Thereafter, a charge may be injected into the residual toner particles from the cleaning brush 111 in an area E, illustrated in FIG. 2, where the cleaning brush 111 contacts the photoconductor 1, and consequently, the residual toner particles tend to be strongly charged to the polarity identical to that of the voltage applied to the cleaning brush 111.

Such a charge injection also occurs in an area F, illustrated in FIG. 2, where the cleaning brush 111 contacts the collecting roller 117. Therefore, the negatively charged residual toner particles with a smaller amount of charge and the positively charged residual toner particles are strongly charged to the polarity identical to that of the voltage applied to the collecting roller 117 in the area F. As a result, these residual toner particles are not removed from the cleaning brush 111 to the collecting roller 117, and remain on the cleaning brush 111. Thereafter, the residual toner particles remaining on the cleaning brush 111 contact the surface of the photoconductor 1 along with the rotation of the cleaning brush 111, and adhere to the surface of the photoconductor 1 again, resulting in the cleaning residual toner particles.

Figure 11:
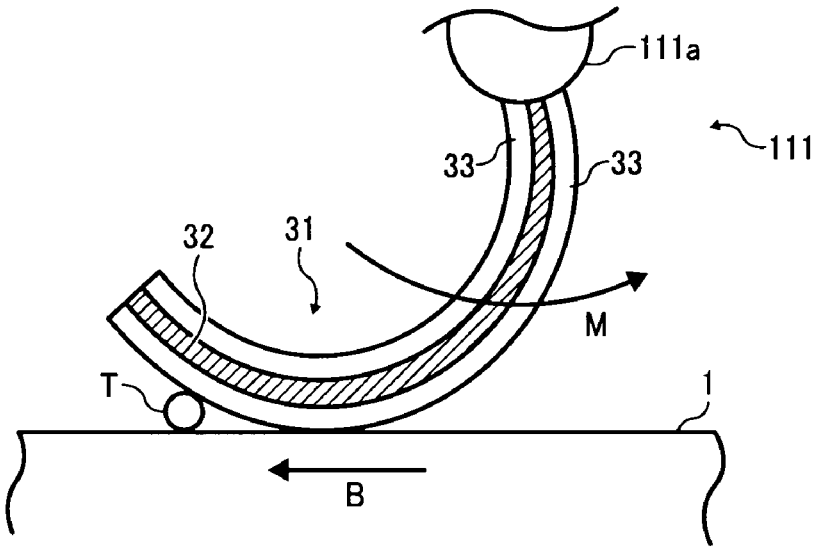
FIG. 11 is a vertical sectional view illustrating a piece of the brush string of the cleaning brush according to the first exemplary embodiment.
Figure 12A:
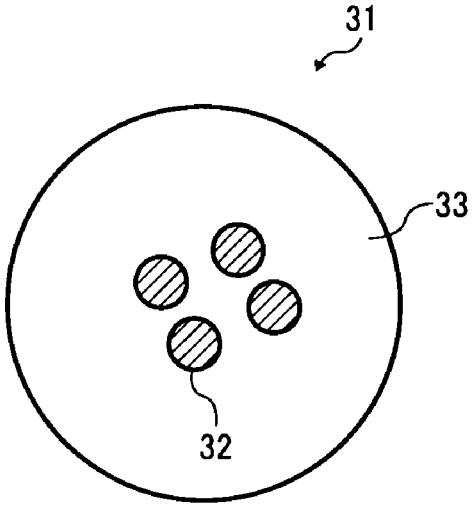
FIG. 12A is a cross-sectional view illustrating an example of the brush string of the cleaning brush used in the cleaning device according to the first exemplary embodiment.

FIG. 11 is a vertical sectional view illustrating a piece of the brush string 31 in contact with the surface of the photoconductor 1, included in the cleaning brush 111 of the cleaning device 7 according to the first exemplary embodiment. FIG. 12A is a cross-sectional view illustrating an example of the brush string 31 of the cleaning brush 111, and FIG. 12B is a cross-sectional view illustrating another example of the brush string 31 thereof.

Figure 12B:
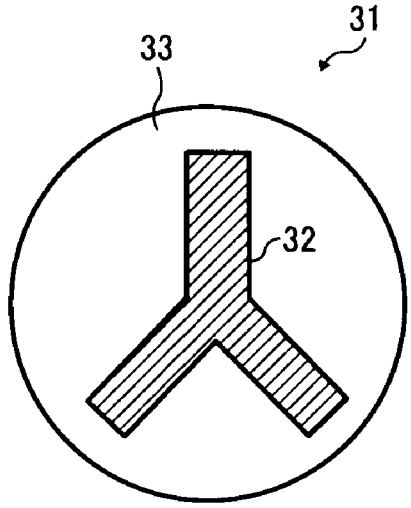
FIG. 12B is a cross-sectional view illustrating another example of the brush string of the cleaning brush used in the cleaning device according to the first exemplary embodiment.

Referring to FIGS. 11, 12A, and 12B, the cleaning string 31 has a core-in-sheath type structure including the conductive material 32 and the insulating material 33 provided on a surface of the conductive material 32. Because the brush string 31 having the core-in-sheath type structure includes the insulating material 33 in an outermost surface thereof, the conductive material 32 does not contact a toner particle T with a portion other than a cutting surface of the brush string 31. Therefore, the charge injection into the toner particle T from the cleaning brush 111 may be suppressed.

Insulating materials such as nylon, polyester, and acrylic are widely used as the insulating material 33 included in the brush string 31. All of the above-described insulating materials can suppress the charge injection into the toner particles T from the cleaning brush 111. Specific examples of the brush string having a core-in-sheath type structure have been disclosed in published unexamined Japanese patent application Nos. (hereinafter referred to as "JP-A") 10-310974, 10-131035, and 01-292116, and published examined Japanese patent application Nos. (hereinafter referred to as "JP-B") 07-033637, 07-033606, and 03-064604.

For example, the brush string 31 may have conductive property by coating the surface thereof with a conductive material, or dispersing or providing a conductive material into the brush string 31. However, it is desirable that the surface of the brush string 31 has insulation property. When the surface of the brush string 31 is conductive, it is difficult to make the brush string 31 be triboelectrically charged. The reason is thought that, although still unknown, the brush string 31 is not easily triboelectrically charged, or charges are lost after the brush string 31 has been triboelectrically charged. Thus, the residual toner particles, of which polarity is not controlled by the conductive blade 11, are not reliably removed from the surface of the photoconductor 1. Experiments have been performed by using each of the brush string 31 having a resistivity of $10^{6.5}\Omega\cdot m$ and $10^{8}\Omega\cdot m$, and no difference has been observed in cleaning performance between each of the above-described brush string 31. In the experiments, each of the components is set as follows. The brush string 31 has a resistivity of $10^{8}\Omega\cdot m$, and the cleaning brush 111 has a density of 100,000 strings per square inch. The collecting roller 117 includes a metal roller, and the scraper 118 includes a polyurethane rubber and contacts the collecting roller 117 at an angle of 20 degrees with an engagement of 1 mm. Furthermore, the experiments have been performed under two different conditions, in which a voltage is applied to a rotation shaft of the collecting roller 117, and no voltage is applied to the brush rotation shaft 111*a*.

Referring back to FIG. 11, the brush string 31 is bent backward relative to the rotation direction of the cleaning brush 111 indicated by an arrow M.

Figure 13:
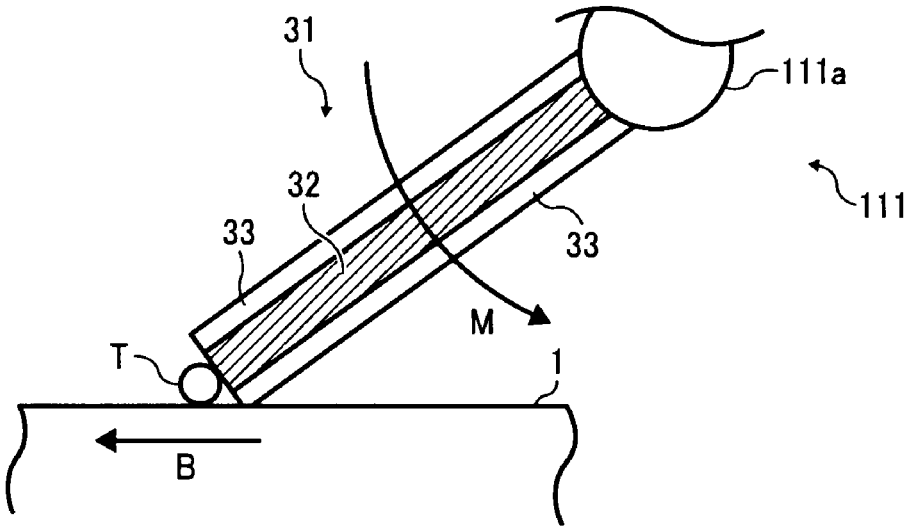
FIG. 13 is a vertical sectional view illustrating a piece of the brush string having a straight shape.

FIG. 13 is a vertical sectional view illustrating the brush string 31 having a straight shape. The brush string 31 includes a core-in-sheath type structure including the conductive material 32 and the insulating material 33 provided on the surface of the conductive material 32, and is fixed to the brush rotation shaft 111*a* in a radial pattern. Similarly to FIG. 11, the arrow M represents the rotation direction of the cleaning brush 111, namely a moving direction of the brush string 31. When the brush string 31 has a straight shape, the conductive material 32 contacts the toner particle T with a cutting surface at the leading edge of the brush string 31. As a result, the positive charge may be injected into the toner particle T from the cleaning brush 111.

On the other hand, when the brush string 31 has a bent shape, the conductive material 32 included in the brush string 31 hardly contacts the toner particle T as illustrated in FIG. 11. Therefore, the charge injection from the cleaning brush 111 to the residual toner particles can be suppressed in the areas E and F.

The areas E and F where the charge injection occurs are described in detail below with reference back to FIG. 2 in which the cleaning brush 111 includes the brush string 31 having a straight shape.

The charge injection into the residual toner particles occurs in the areas E and F in FIG. 2. The voltage applied from the second power circuit 122 to the collecting roller 117 is further applied to the cleaning brush 111 through the collecting roller 117, so that the residual toner particles are removed from the surface of the photoconductor 1 to the cleaning brush 111.

The charge is injected into the residual toner particles in the area E at the instant when the conductive material 32 included in the brush string 31 contacts the residual toner particles. At this time, because weakly charged residual toner particles are strongly charged to the polarity identical to that of the applied voltage, the strongly charged residual toner particles are further electrostatically attracted to the surface of the photoconductor 1. Consequently, the strongly charged residual toner particles are not removed from the surface of the photoconductor 1 by the cleaning brush 111 and remain on the surface of the photoconductor 1, resulting in the cleaning residual toner particles remaining on the surface of the photoconductor 1. On the other hand, although the charge is injected into the residual toner particles strongly charged to the polarity opposite to that of the voltage applied to the cleaning brush 111, the polarity of such residual toner particles is not reversed due to the larger amount of charge, so that the residual toner particles are removed from the surface of the photoconductor 1 to the cleaning brush 111.

The residual toner particles with the polarity opposite to that of the voltage applied to the cleaning brush 111 which are removed from the surface of the photoconductor 1 to the cleaning brush 111 are further removed from the cleaning brush 111 to the collecting roller 117. At this time, the charge injection occurs in the area F between the cleaning brush 111 and the collecting roller 117 in the same manner as described above. That is, the residual toner particles with a smaller amount of charge is strongly charged to the polarity of the voltage applied to the collecting roller 117, and consequently, the toner particles are not removed from the cleaning brush 111 to the collecting roller 117 and remain on the cleaning brush 111. Thereafter, the toner particles remaining on the cleaning brush 111 contact the surface of the photoconductor 1 along with the rotation of the cleaning brush 111, and adhere to the surface of the photoconductor 1 again due to an electric field between the photoconductor 1 and the cleaning brush 111, resulting in the cleaning residual toner particles.

However, as illustrated in FIG. 11, the conductive material 32 included in the brush string 31 hardly contacts the toner particle T with the use of the cleaning brush 111 including the brush string 31 having the core-in-sheath type structure and a bent shape. Accordingly, occurrence of the charge injection into the residual toner particles in the areas E and F can be suppressed. As a result, the negatively charged residual toner particles and the residual toner particles weakly charged to the positive polarity adhering to the cleaning brush 111 are prevented from being strongly charged to the polarity identical to that of the voltage applied to the collecting roller 117.

An occurrence of the charge injection in the areas E and F has been observed as described below.

Figure 14:
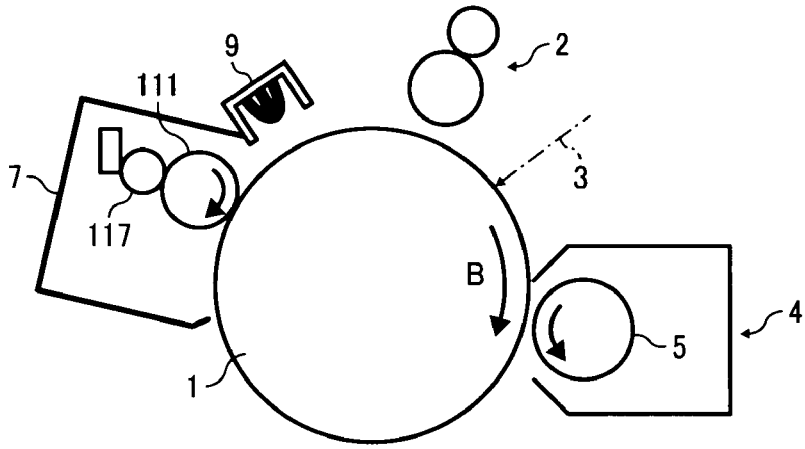
FIG. 14 is a schematic view illustrating the image forming apparatus in which a transfer device and the conductive blade are removed from the configuration illustrated in FIG. 1.

FIG. 14 is a schematic view illustrating the image forming apparatus in which the transfer device 6 and the conductive blade 11 are removed from the configuration shown in FIG. 1, so that the toner particles are substantially 100 percent negatively charged after development has been performed, and are removed by the cleaning brush 111. The rotation of the photoconductor 1 is stopped when the cleaning brush 111 is rotated two revolutions after the leading edge of the toner image on the surface of the photoconductor 1 reaches the portion where the cleaning brush 111 and the surface of the photoconductor 1 contact each other. Subsequently, a charge amount of the toner particles on the surface of the photoconductor 1 per a length twice as long as a perimeter of the cleaning brush 111 is measured. The charge injection occurs between the cleaning brush 111 and the collecting roller 117 because the cleaning brush 111 and the collecting roller 117 contact each other once when the cleaning brush 111 is rotated one revolution to collect the residual toner particles on the surface of the photoconductor 1 and contacts the surface of the photoconductor 1 again. Therefore, an occurrence of the charge injection between the surface of the photoconductor 1 and the cleaning brush 111 is observed by measuring the charge amount of the toner particles on the surface of the photoconductor 1 when the cleaning brush 111 is rotated two revolutions.

A configuration in which the cleaning brush 111 includes the brush string 31 having a straight shape is hereinafter referred to as a "configuration A", and a configuration in which the cleaning brush 111 includes the brush string 31 having a bent shape is hereinafter referred to as a "configuration B".

Furthermore, in a configuration hereinafter referred to as a "configuration C", the collecting roller 117 and the scraper 118 are removed from the configuration B, and a voltage is applied to the brush rotation shaft 111*a* of the cleaning brush 111. With such a configuration, it is observed that the charge injection mainly occurs between the cleaning brush 111 and the collecting roller 117. Similarly to the case with the configurations A and B, the rotation of the photoconductor 1 is stopped when the cleaning brush 111 is rotated two revolutions.

Figure 15:
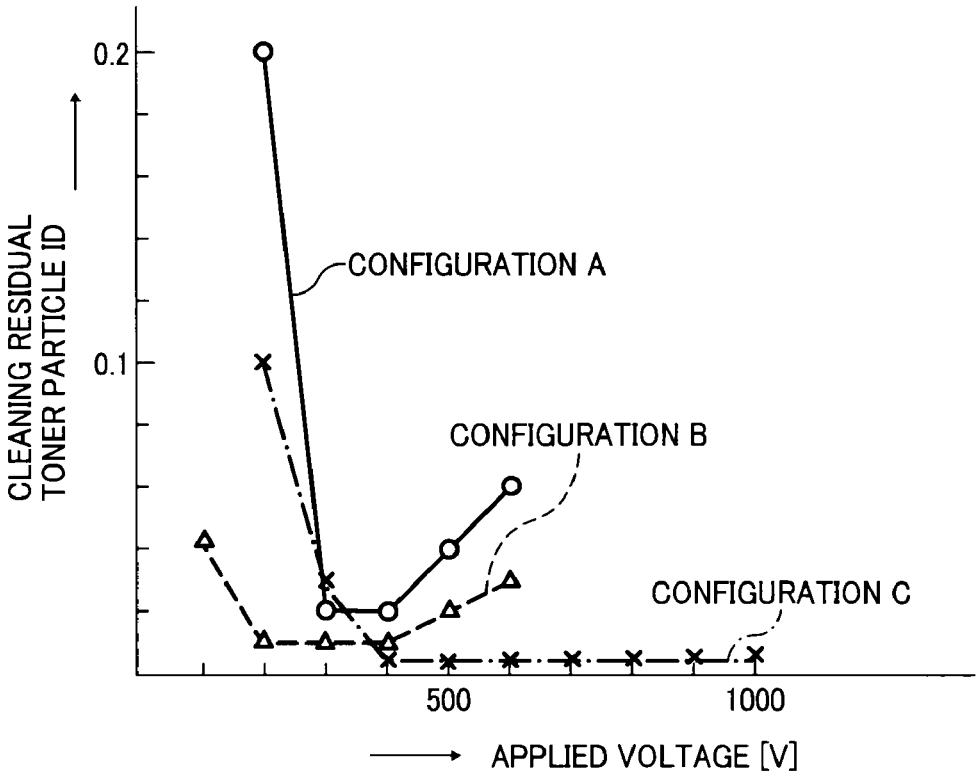
FIG. 15 is a graph comparing cleaning performance with configurations A, B, and C.

FIG. 15 is a graph comparing cleaning performance with the configurations A, B, and C described above. A horizontal axis represents a voltage applied to the collecting roller 117 or the cleaning brush 111, and a vertical axis represents an image density of cleaning residual toner particles on the surface of the photoconductor 1 (hereinafter referred to as "a cleaning residual toner particle ID"). The cleaning residual toner particle ID is obtained as follows. The toner particles remaining on the surface of the photoconductor 1 after cleaning has been performed by the cleaning brush 111 are transferred onto a SCOTCH® tape. Subsequently, the SCOTCH® tape with the transferred toner particles thereon is put on a paper to measure a reflection density thereof with a spectro-colorimeter X-RITE manufactured by X-RITE Inc. Meanwhile, only a SCOTCH® tape is put on a paper to measure a reflection density thereof with the spectro-colorimeter. The cleaning residual toner particle ID is obtained by subtracting the reflection density of the SCOTCH® tape from the reflection density of the SCOTCH® tape with the transferred toner particles thereon. The cleaning residual toner particle ID has a correlation with the amount of toner particles, and a value of the cleaning residual toner particle ID increases as an increase in the amount of toner particles. Therefore, the cleaning performance may be judged by the value of the cleaning residual toner particle ID.

As illustrated in FIG. 15, the value of the cleaning residual toner particle ID decreases with the configuration B as compared to the configuration A. The value of the cleaning residual toner particle ID further decreases with the configuration C as compared to the configuration B. The cleaning residual toner particle ID when the applied voltage is increased represents the toner particles strongly charged to the polarity of the applied voltage, namely, the toner particles into which a positive charge is injected. On the other hand, the cleaning residual toner particle ID when the applied voltage is decreased represents the toner particles which are not removed by the cleaning brush 111. The cleaning residual toner particle ID when a voltage of 500V or more is applied to the collecting roller 117 or the cleaning brush 111 represents positively charged toner particles. On the other hand, the cleaning residual toner particle ID when a voltage of 200V or less, or 100V or less in the configuration A, is applied to the collecting roller 117 or the cleaning brush 111 represents negatively charged toner particles. Therefore, from the graph shown in FIG. 15, it is confirmed that the charge injection occurs between the photoconductor 1 and the cleaning brush 111, and the cleaning brush 111 and the collecting roller 117, respectively. In addition, the result of the cleaning performance with the configuration C proves that the charge injection hardly occurs with the use of the cleaning brush 111 including the brush string 31 having the core-in-sheath type structure and a bent shape.

A specific example of the configuration applicable to the cleaning brush 111 and the collecting roller 117 according to the first exemplary embodiment is described in detail below. The collecting roller 117 includes a stainless steel, and has a diameter of 10 mm. The cleaning brush 111 includes a conductive polyester, and contacts the surface of the photoconductor 1 with an engagement of 1 mm. The brush string 31 has a width of 5 mm and a length of 5 mm, and has a resistivity of $10^8\Omega\cdot$m. The cleaning brush 111 has a density of 100,000 strings per square inch.

A specific example of the configuration applicable to the scraper 118 according to the first exemplary embodiment is described in detail below. The scraper 118 includes a polyurethane rubber, and contacts the collecting roller 117 at an angle of 20 degrees with an engagement of 1 mm.

A bending angle of the brush string 31 differs depending on the diameters of each of the photoconductor 1 and the collecting roller 117. Thus, the bending angle of the brush string 31 may be appropriately set such that the conductive material 32 of the brush string 31 does not contact each of the photoconductor 1 and the collecting roller 117.

In order to obtain the cleaning brush 111 including the brush string 31 having a bent shape, the cleaning brush 111 in which a straight brush string is radially provided to the brush rotation shaft 111*a* is put in a jig having the same inner diameter as that of the cleaning brush 111 to be rotated therein while being heated by the jig. As a result, the brush string 31 is permanently deformed to a bent shape. Therefore, a length of the brush string 31 having a bent shape from the leading edge thereof to the brush rotation shaft 111*a* is required to be longer than that having a straight shape. Not only the brush string 31 having a bent shape, but also the brush string 31 having a straight shape in which a length from the leading edge thereof to the brush rotation shaft 111*a* is sufficiently longer than a distance from the brush rotation shaft 111*a* to the surface of the photoconductor 1, and only a side surface thereof contacts the photoconductor 1, can suppress the contact between the leading edge of the brush string 31 and the residual toner particles when the cleaning brush 111 is rotated so as to face in the rotation direction of the photoconductor 1. As a result, the charge injection from the cleaning brush 111 into the residual toner particles are suppressed. Furthermore, both of the positively and negatively charged residual toner particles passing through the conductive blade 11 are preferably attracted to the brush string 31 including a conductive polyester.

A specific example of the configuration applicable to the conductive blade 11 according to the first exemplary embodiment is described in detail below. The conductive blade 11 contacts the surface of the photoconductor 1 so as to face in the rotation direction of the photoconductor 1 at a contact angle of 20° with a contact pressure of from 20 g/cm. The conductive blade 11 has, but is not limited to, a flat shape with a thickness of 2 mm, a free length of 7 mm, a JIS-A hardness of from 60 to 80 degrees, and an impact resilience of 30%, and is bonded to a blade holder 17 including a steel plate. Because the conductive blade 11 does not remove all residual toner particles, the amount of the residual toner particles passing through the contact portion between the conductive blade 11 and the photoconductor 1 does not matter. Although the above-described conductive blade 11 is used for removing pulverized toner particles, the conductive blade 11 having the same configuration as described above can also be used for removing toner particles having a spherical shape. Furthermore, the polarity of the voltage applied to each of the conductive blade 11, the cleaning brush 111, and the collecting roller 117 may be opposite to that described above in the first exemplary embodiment.

In a case in which the toner particles having a spherical shape are used, the amount of the residual toner particles removed from the surface of the photoconductor 1 by the conductive blade 11 becomes smaller as compared to a case in which pulverized toner particles are used. However, because the residual toner particles remaining on the surface of the photoconductor 1 are charged to the single polarity by the conductive blade 11 as described above, the cleaning brush 111 effectively removes the residual toner particles from the surface of the photoconductor 1. Thus, in a similar way as the case in which the pulverized toner particles are used, the charge injection from the cleaning brush 111 into the residual toner particles is suppressed, and consequently, the residual toner particles are reliably removed from the surface of the photoconductor 1 by the cleaning brush 111.

The polarity of the residual toner particles electrostatically attracted to the conductive blade 11 gradually changes to the polarity of the applied voltage over time due to the charge injection or the electric discharge. As a result, the residual toner particles pass through the conductive blade 11. However, because the amount of the residual toner particles adhering to the conductive blade 11 is greater than that of the residual toner particles passing through the conductive blade 11, the residual toner particles remain on the portion where the conductive blade 11 and the surface of the photoconductor 1 contact each other. Therefore, the amount of the charge injection or the electric discharge decreases, and the polarity of a larger amount of the residual toner particles passing through the conductive blade 11 is not turned into the polarity of the applied voltage. As a result, the residual toner particles passing through the conductive blade 11, of which polarity is opposite to that of the voltage applied to the conductive blade 11, may not be completely removed by the cleaning brush 111 provided on a downstream side from the conductive blade 11 relative to the rotation direction of the photoconductor 1. Therefore, the portion where the conductive blade 11 and the photoconductor 1 contact each other is required to be cleaned on regular basis.

Cleaning of the portion where the conductive blade 11 and the surface of the photoconductor 1 contact each other is performed while image formation is not performed. To clean such portion, a voltage with the polarity opposite to that of the applied voltage during image formation is applied to the conductive blade 11, and the photoconductor 1 is rotated in a direction opposite to the rotation direction thereof during image formation. When the photoconductor 1 is rotated in the opposite direction as described above, a surface of the conductive blade 11 provided on an upstream side relative to the rotation direction of the photoconductor 1, namely a surface of the conductive blade 11 for discharging electricity to reverse the polarity of the residual toner particles, contacts the surface of the photoconductor 1. Consequently, the residual toner particles adhering to the above-described surface of the conductive blade 11 are easily moved to the surface of the photoconductor 1. In addition, because most of the residual toner particles electrostatically adhering to the conductive blade 11 have the polarity opposite to that of the voltage applied to the conductive blade 11, the residual toner particles are easily moved to the surface of the photoconductor 1 when the voltage with the polarity identical to that of the residual toner particles is applied to the conductive blade 11. Thus, the residual toner particles which have the polarity opposite to that of the voltage applied to the conductive blade 11 and electrostatically adhere to the conductive blade 11 during image formation, are easily moved to the surface of the photoconductor 1, and are further conveyed to an upstream side from the conductive blade 11 relative to the rotation direction of the photoconductor 1. Thereafter, the conductive blade 11 mechanically removes the residual toner particles moved to the surface of the photoconductor 1 as described above from the surface of the photoconductor 1, or injects the charge into the residual toner particles during next image formation. Cleaning of the portion where the conductive blade 11 and the photoconductor 1 contact each other may be performed any time when image formation is not performed, for example, after images have been formed on a predetermined number of sheets, or a single image formation has been performed, and when the image forming apparatus is turned on.

It is desirable that the photoconductor 1 is rotated in a direction opposite to the rotation direction thereof for a distance identical to that between the conductive blade 11 and the cleaning brush 111. Because the amount of charge of the residual toner particles remaining on the surface of the photoconductor 1 between the conductive blade 11 and the cleaning brush 111 gradually decreases, or may be completely lost in an extreme case, when the rotation of the photoconductor 1 is stopped for a long time, the cleaning brush 111 provided on a downstream side from the conductive blade 11 relative to the rotation direction of the photoconductor 1 cannot collect the residual toner particles. To prevent such a problem, the residual toner particles are moved to an upstream side from the portion where the conductive blade 11 and the photoconductor 1 contact each other relative to the rotation direction of the photoconductor 1, and are charged by the conductive blade 11 again. Therefore, the cleaning brush 111 provided on a downstream side from the conductive blade 11 relative to the rotation direction of the photoconductor 1 removes the residual toner particles from the surface of the photoconductor 1.

A description is now given of collection of the residual toner particles on the surface of the collecting roller 117.

Because the scraper 118 formed of an insulating material mechanically removes the residual toner particles from the collecting roller 117, the scraper 118 hardly removes the residual toner particles having a spherical shape from the collecting roller 117.

The collecting roller 117 removes the residual toner particles adhering to the cleaning brush 111 to the collecting roller 117 by using a potential difference between the cleaning brush 111 and the collecting roller 117. Thus, unlike the photoconductor 1, the collecting roller 117 has many alternatives for materials included therein as long as the surface thereof has conductivity. Accordingly, the surface of the collecting roller 117 may be coated with a material having a lower friction coefficient, or a metal roller covered with a conductive tube with a lower friction coefficient may be used as the collecting roller 117 to improve abrasive resistance, so that a contact pressure of the scraper 118 against the collecting roller 117 can be increased. As a result, the scraper 118 formed of an insulating material can easily remove the residual toner particles having a spherical shape from the surface of the collecting roller 117. For example, the collecting roller 117, which is coated with a fluorine resin and a PVDF, or is covered with a PFA tube, may be used for improving abrasive resistance.

Figure 16:
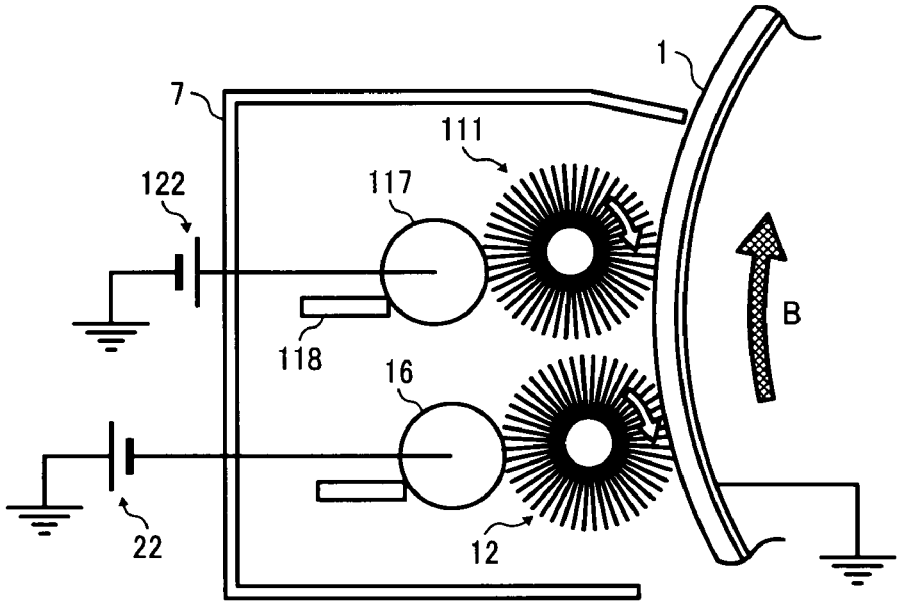
FIG. 16 is a schematic view illustrating the cleaning device in which a conductive brush is provided as a polarity control member.

As illustrated in FIG. 16, a conductive brush 12 may be used as the polarity control member for injecting a charge into the residual toner particles on the surface of the photoconductor 1 to control the polarity of the residual toner particles. The conductive brush 12 has a resistivity of from $10^5$ to $10^9 \Omega \cdot cm$, and a density of 100,000 strings per square inch. A length of a brush string included in the conductive brush 12 is 5 mm including foundation cloth, and the conductive brush 12 contacts the photoconductor 1 with an engagement of 1 mm.

Figure 17:
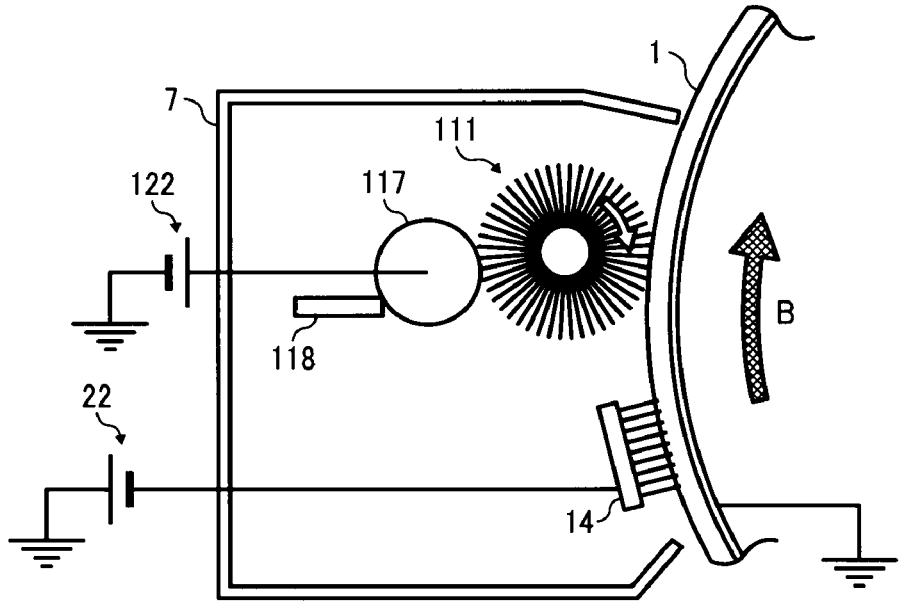
FIG. 17 is a schematic view illustrating the cleaning device in which a conductive brush having a belt-like shape is provided as the polarity control member.

In the configuration illustrated in FIG. 16, a voltage is applied to a conductive collecting roller 16 in contact with the conductive brush 12, and the voltage is further applied to the conductive brush 12 through the conductive collecting roller 16. Thus, the polarity of the residual toner particles on the surface of the photoconductor 1 is controlled by the conductive brush 12 to which the voltage is applied from the conductive collecting roller 16. The conductive collecting roller 16 collects the residual toner particles adhering to the conductive brush 12 by using a potential difference between a rotation shaft of the conductive brush 12 and the conductive collecting roller 16. Therefore, the conductive brush 12 can be reliably cleaned, so that the polarity of the residual toner particles on the surface of the photoconductor 1 can be stably controlled for a long time. Furthermore, in a case in which the residual toner particles adhering to the conductive brush 12 are naturally removed from the conductive brush 12 by virtue of a well thought out arrangement of the conductive brush 12, or the electrostatic collection of the residual toner particles from the conductive brush 12 is not necessary by virtue of vibration of a flicker bar, a belt-like brush 14 may be provided as the polarity control member as illustrated in FIG. 17, providing a simplified configuration.

Figure 18:
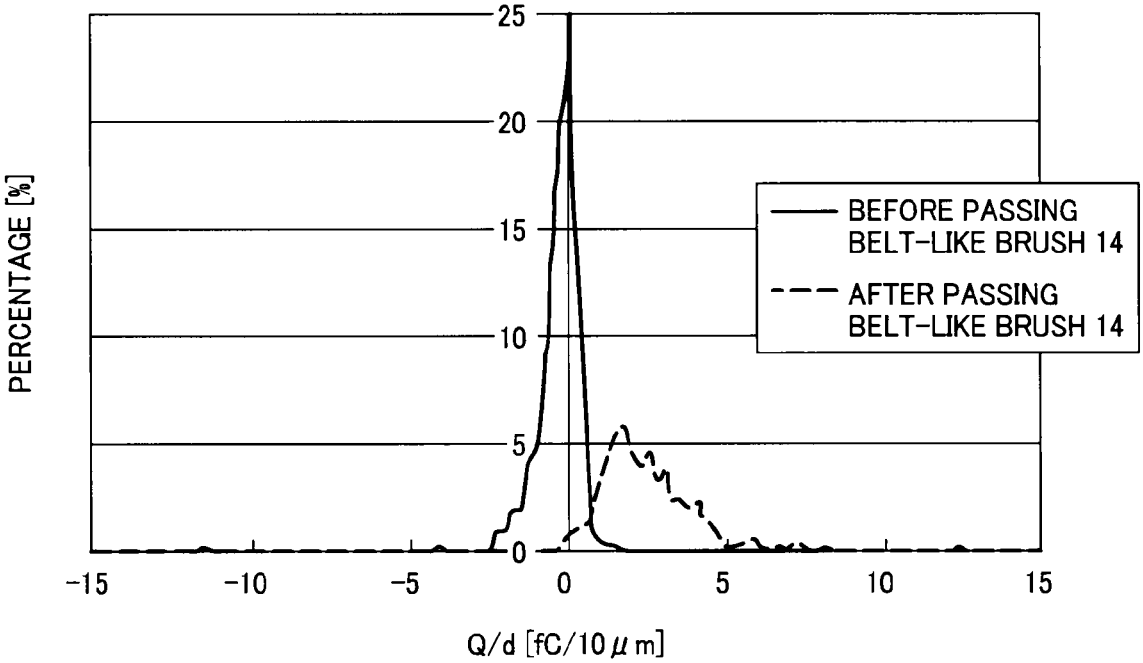
FIG. 18 is a graph illustrating charge distributions of a mixture of positively charged toner particles and negatively charged toner particles before and after passing through the conductive brush having a belt-like shape.

FIG. 18 is a graph illustrating charge distributions of a mixture of the positively and negatively charged residual toner particles obtained by experimentally applying a higher voltage to a wire to charge the toner particles by corona discharge when a voltage of +300V is applied to the belt-like brush 14 to control the polarity of the residual the toner particles. Referring to FIG. 18, about 50 percent of the residual toner particles before passing through the belt-like brush 14 have the positive polarity and the remaining about 50 percent thereof have the negative polarity, and the polarity of the residual toner particles after passing through the belt-like brush 14 is controlled by the belt-like brush 14. The charge distributions of the residual toner particles illustrated in FIG. 18 is measured in the same way as described above by using E-SPART analyzer. Although a brush string of the belt-like brush 14 includes conductive nylon, any materials such as polyester and acrylic including carbon and an ionic conductive material capable of providing conductive property to the brush string may be used.

A description is now given of reverse of the polarity of the residual toner particles when passing through the conductive brush 12 with reference back to FIG. 16. The polarity of the residual toner particles which is opposite to that of the voltage applied to the conductive brush 12 is reversed to the polarity identical to the polarity of the voltage applied to the conductive brush 12 when the residual toner particles pass through the conductive brush 12. In a case in which the voltage applied to the conductive brush 12 is sufficiently lower than the voltage at the beginning of electric discharge, it is considered that the residual toner particles are charged to the polarity identical to that of the voltage applied to the conductive brush 12 in a similar way as, for example, a condenser is charged, when the residual toner particles pass between the conductive brush 12 and the photoconductor 1. That is, a charge is injected into the residual toner particles from the conductive brush 12. Thereafter, the residual toner particles pass over the conductive brush 12. In a case in which the voltage applied to minute gaps between the conductive brush 12 and the residual toner particles, or the conductive brush 12 and the photoconductor 1, is close to, or greater than the voltage at the beginning of the electric discharge, the residual toner particles are charged to the polarity identical to that of the voltage applied to the conductive brush 12 due to an electric discharge from minute gaps at an entry and an exit of a wedge portion formed between the photoconductor 1 and the conductive brush 12.

A brush string of the conductive brush 12 may preferably include a conductive material dispersed into a surface part of the brush string as illustrated in FIGS. 10A and 10B. With such a structure, the conductive material easily contacts the residual toner particles so that a larger amount of current flows into the residual toner particles passing through the conductive brush 12. As a result, the residual toner particles tend to be charged to the polarity identical to that of the voltage applied to the conductive brush 12. Therefore, the polarity of the residual toner particles on the surface of the photoconductor 1 are easily controlled to the single polarity by the conductive brush 12.

Figure 19:
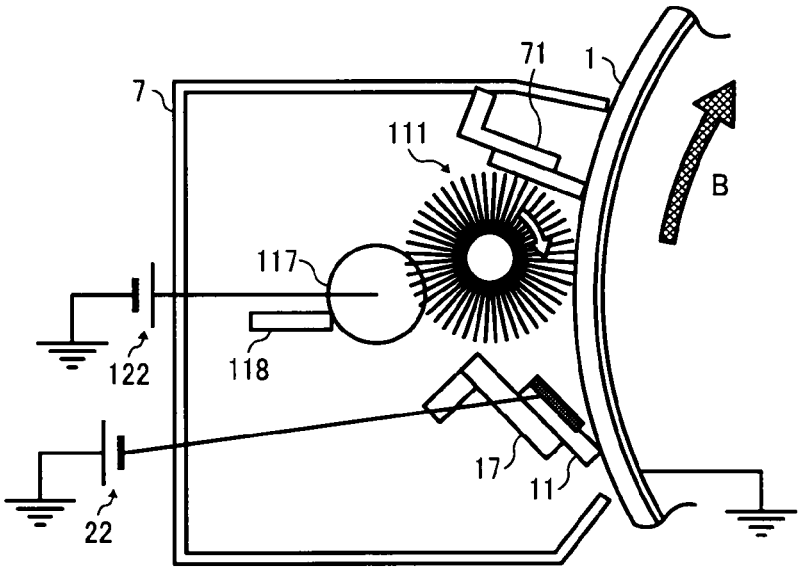
FIG. 19 is a schematic view illustrating the cleaning device in which a polishing blade is provided.

A polishing blade 71 supported in contact with/apart from the photoconductor 1 for polishing the surface of the photoconductor 1 may be provided on a downstream side from the cleaning brush 111 relative to the rotation direction of the photoconductor 1 as illustrated in FIG. 19. FIG. 19 is a schematic view illustrating the cleaning device 7 in which the polishing blade 71 contacts the surface of the photoconductor 1.

A filming material which is a mixture of a base component of the toner particles adhering to the surface of the photoconductor 1 due to the contact of the photoconductor 1 with the developing device 4, the transfer device 6, the cleaning device 7, and so forth provided around the photoconductor 1, additives which are added to the surface of the toner particles for providing fluidity and charging property to the toner particles but are separated from the surface of the toner particles, materials generated by an electric discharge from the charger 2, talc particles of the sheet, and so forth, is hardly removed from the surface of the photoconductor 1 by using the conductive blade 11 and the cleaning brush 111. A smaller amount of the filming material adhering to the surface of the photoconductor 1 does not often cause image deterioration. However, if the filming material remains adhering to the surface of the photoconductor 1 for a predetermined period of time, a size of a part of the filming material increases, preventing the surface of the photoconductor 1 from being evenly charged, and proper image formation. Therefore, the filming material adhering to the surface of the photoconductor 1 is required to be removed.

The polishing blade 71 illustrated in FIG. 19 includes an abrading agent particle layer in which abrading agent particles are included in an elastic material. The polishing blade 71 is provided such that the abrading agent particle layer contacts the surface of the photoconductor 1. It is important to fill a surface of the polishing blade 71 in contact with the surface of the photoconductor 1 with the abrading agent particles. For example, a volume fraction of the abrading agent particles on the surface of the polishing blade 71 in contact with the surface of the photoconductor 1 is preferably from 50% to 90%. When the above-described volume fraction of the abrading agent particles is less than 50%, a number of the abrading agent particles in contact with the surface of the photoconductor 1 is not sufficient. Consequently, the filming material adhering to the surface of the photoconductor 1 are not efficiently removed. On the other hand, when the volume fraction of the abrading agent particles exceeds 90%, the abrading agent particles on the surface of the polishing blade 71 easily come off, preventing reliable removal of the filming material adhering to the surface of the photoconductor 1.

Although the polishing blade 71 illustrated in FIG. 19 has a single layer including the abrading agent particle layer, the polishing blade 71 may have two layers including the abrading agent particle layer and a blade main layer.

The polishing blade 71 having a single layer is manufactured as described below.

The abrading agent particles are mixed with an elastic material, and the mixture is centrifugally formed in a sheet. Thereafter, the thus formed sheet is cut into an appropriate size and shape so that the polishing blade 71 is obtained. Thus, the polishing blade 71 having a single layer can be manufactured with a simple process.

Figure 20:
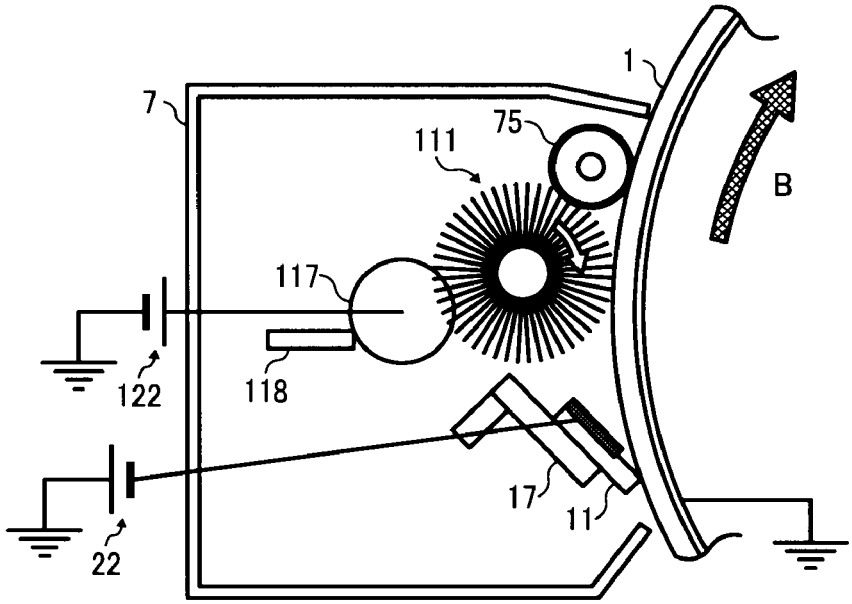
FIG. 20 is a schematic view illustrating the cleaning device in which a polishing roller is provided.

On the other hand, in order to manufacture the polishing blade 71 having two layers, smaller amounts of the elastic material and the abrading agent particles are used as compared to the case of manufacturing the polishing blade 71 having a single layer, so that a thin sheet of the mixture of the elastic material and the abrading agent particles is formed. The thus formed thin sheet is cut into an appropriate size and shape, and consequently, a thin blade including the abrading agent particle layer is obtained. Thereafter, the thin blade is bonded to the blade main layer including materials such as rubber, a resin, and metal, and the polishing blade 71 having two layers is obtained. Alternatively, materials such as a resin and metal included in the blade main layer may be poured on the thin sheet including the abrading agent particles described above to centrifugally form a sheet in which the blade main layer and the thin sheet are integrated. Thereafter, the thus formed sheet is cut into an appropriate size and shape, and the polishing blade 71 having two layers is obtained. In place of the polishing blade 71, the cleaning device 7 may include a polishing roller 75 as illustrated in FIG. 20. The polishing roller 75 includes a roller on which the abrading agent particle layer including the abrading agent particles is provided.

A toner preferably used for the first exemplary embodiment will be explained in detail.

The present inventors have performed a test in which the amount of residual toner particles remaining on the surface of the photoconductor 1 after a test image is transferred (hereinafter simply referred to as "residual toner particles after transfer") is measured. Three kinds of toners each having a shape factor SF-1 of 100, 150, and 160 are subjected to the test. A developing bias is controlled so that the amount of toner particles adhered to the surface of the photoconductor 1 per unit area is constant regardless of the kind of toner used. Toner particles adhered to the surface of the photoconductor 1 immediately after the test image has been developed is collected by a toner suction jig and weighed. The thus measured weight is hereinafter referred to as "the amount of developing toner (M1)". On the other hand, toner particles adhered to the surface of an intermediate transfer belt after the test image is primarily transferred thereon is collected by a toner suction jig and weighed. The thus measured weight is hereinafter referred to as "the amount of transferred toner (M2)". The amount of residual toner particles after transfer per unit area is determined by subtracting M2 from M1. The results of the test are shown in FIG. 21.

Figure 21:
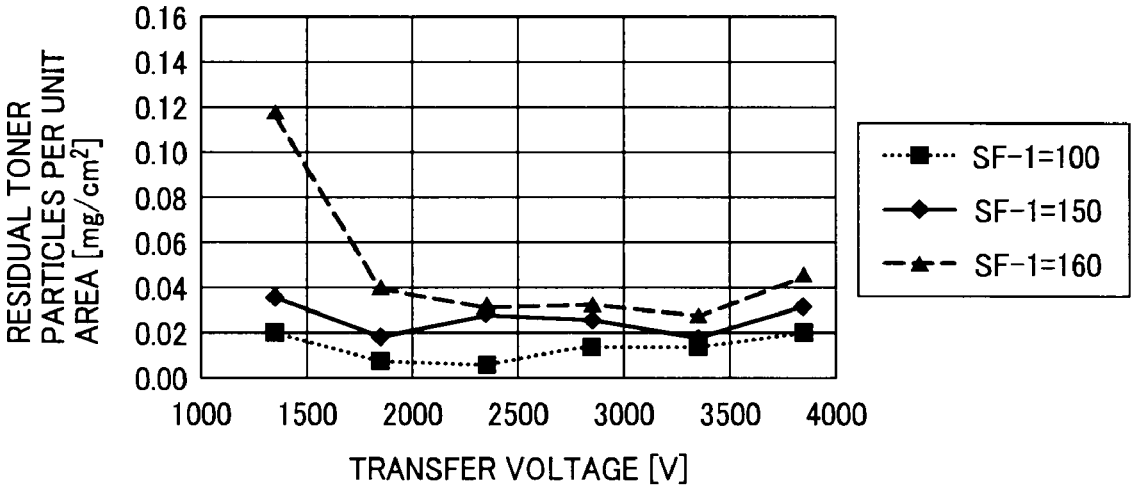
FIG. 21 is a graph illustrating a relation between a shape factor SF-1 and a number of the residual toner particles.

It is clear from FIG. 21 that as the shape factor SF-1 increases, the amount of residual toner particles after transfer per unit area increases. In other words, the smaller shape factor SF-1 a toner has, the smaller amount of residual toner particles remain on the surface of the photoconductor after transfer. In general, the life of a cleaning device 7 lengthens as the amount of residual toner particles after transfer decreases, because the cleaning device 7 receive less stress. In other words, the smaller shape factor SF-1 a toner has, the longer life a cleaning device 7 has. For the above reasons, toners having a shape factor SF-1 of from 100 to 150 are used in the printer 100 of the first exemplary embodiment.

A spherical toner, having a large average circularity, preferably used in the first exemplary embodiment of the present invention is prepared by a method including:

dissolving or dispersing toner constituents, including a colorant and a binder resin including a modified polyester resin capable of forming an urea bond, in an organic solvent to prepare a toner constituent mixture liquid;

dispersing the toner constituent mixture liquid in an aqueous medium while subjecting the modified polyester resin to an addition polymerization, to prepare a dispersion including toner particles;

removing the organic solvent from the dispersion to prepare toner particles; and washing and drying the toner particles.

A spherical toner can also be prepared by typical polymerization methods such as an emulsion aggregation method, a suspension polymerization method, and a dispersion polymerization method. In addition, a spherical toner can also be prepared by spheroidizing a pulverization toner by a thermal treatment.

The shape factor SF-1 indicates a proportional roundness of the toner particle, and is expressed by an equation of the form $SF\text{-}1=\{(MXLNG)^2/AREA\}\times(100\pi/4)$. The shape factor SF-1 is obtained by dividing the square of the maximum length MXLNG of the shape produced by projecting a toner particle in a two-dimensional plane, by the figural surface area AREA, and subsequently multiplying by $100\pi/4$. Particularly, 100 or more toner particles are randomly selected from a toner, and are subjected to the measurement of SF-1. The average SF-1 value among the randomly selected toner particles is treated as the shape factor SF-1 of the toner.

The amount of residual toner particles after transfer can be also measured by the following method, for example. At first, a latent image of a patch pattern having an area of A ($cm^2$) is formed on the photoconductor 1. The latent image is developed with a toner to form a toner image, and the toner image is subsequently transferred. After turning off a main switch of the main body of the printer 100, residual toner particles remaining on the surface of the photoconductor 1 after transfer are sucked by an air pump using a suction jig equipped with a toner collecting filter. The weight M (mg) of the sucked toner particles is measured. The amount of residual toner particles after transfer per unit area is determined by dividing the weight M (mg) by the area A ($cm^2$).

Next, the photoconductor 1 used for the first exemplary embodiment will be explained in detail.

The photoconductor 1 includes a conductive substrate and a photosensitive layer located overlying the conductive substrate. The photosensitive layer may be in direct contact with the conductive substrate, or there may be an intervening layer between the photosensitive layer and the conductive substrate. The photosensitive layer includes a charge generation material and a charge transport material, and optionally includes a particulate material. The particulate material is preferably localized in the surface side of the photoconductive layer, far from the substrate side thereof, so that abrasion resistance is improved and electric properties is stabilized. Alternatively, the photoconductor 1 may include a conductive substrate, a photosensitive layer, and a surface layer including a particulate material. The photosensitive layer needs to have electric insulation while being capable of being charged. Therefore, the photosensitive layer may be a dielectric layer having no photoconductivity or a photosensitive layer having photoconductivity.

The particulate material is typically pulverized, dispersed, and applied together with a binder resin, a low-molecular charge transport material, and/or a charge transport polymer. The surface layer preferably includes the particulate material in an amount of from 5% to 50% by weight, and more preferably from 10% to 40% by weight. When the amount is too small, the resultant layer has poor abrasion resistance. When the amount is too large, the resultant layer has poor transparency. The particulate material preferably has an average particle diameter of from 0.05 to 1.0 μm, and more preferably from 0.05 to 0.8 μm, in the resultant layer.

Inorganic and organic materials having higher hardness than a resin used in the surface layer are preferably used as the particulate material. Specific preferred examples of suitable particulate material include, but are not limited to, titanium oxide, silica, tin oxide, alumina, zirconium oxide, indium oxide, silicon nitride, calcium oxide, zinc oxide, and barium sulfate. Among these materials, titanium oxide, silica, and barium sulfate are preferably used. These particulate materials may be surface-treated with an inorganic or organic material so as to improve dispersibility, etc., thereof. For example, particulate materials treated with a silane-coupling agent, a fluorinated silane-coupling agent, or a higher fatty acid, so as to improve water-repellency, can be used. In addition, particulate materials treated with an inorganic material, such as alumina, zirconium, tin oxide, or silica, can be used.

The surface layer includes, for example, a polymer having a three-dimensional network structure, which is formed by a cross-linking reaction of a reactive monomer having a plurality of functional groups capable of cross-linking per molecule upon application of optical and/or thermal energy. The three-dimensional network structure imparts good abrasion resistance to the surface layer. From the viewpoints of electric stability and life, a reactive monomer partially or entirely having charge transportability is preferably used. Such a monomer is capable of forming a charge transport site in the network structure, resulting in improvement of abrasion resistance.

Specific preferred examples of suitable reactive monomer having charge transportability include, but are not limited to, a compound including one or more a charge transport component and one or more silicon atom having a hydrolyzable substituent group in the same molecule; a compound including a charge transport component and a hydroxyl group in the same molecule; a compound including a charge transport component and a carboxyl group in the same molecule; a compound including a charge transport component and an epoxy group in the same molecule; and a compound including a charge transport component and an isocyanate group in the same molecule. These reactive monomers can be used alone or in combination.

More specifically, a reactive monomer having a triarylamine structure is preferably used as the monomer having charge transportability, because of having good electrical and chemical stability and carrier mobility. Further, any known monofunctional and difunctional polymerizable monomers and oligomers may be used in combination, for the purpose of controlling viscosity of a coating liquid, relaxing stress of a cross-linked charge transport layer, and reducing surface energy and friction coefficient thereof.

A cross-linked polymer is obtained by polymerizing or cross-linking a compound having hole transportability upon application of heat and/or light. In a case a polymerization reaction occurs by application of heat, the polymerization reaction may occur either with or without a polymerization initiator. To efficiently perform the polymerization reaction at a lower temperature, a heat polymerization initiator is preferably used in combination. In a case a polymerization reaction occurs by application of light, ultraviolet ray is preferably used as the light. In this case, the polymerization reaction is hardly performed without a polymerization initiator and only with the application of light. Therefore, a light polymerization initiator is typically used in combination. Such a light polymerization initiator mainly absorbs ultraviolet ray having a wavelength not greater than 400 nm so as to produce active species such as radicals and ions. The heat and light polymerization initiators can be used alone or in combination. The thus formed charge transport layer having a network structure has good abrasion resistance, however, cracks may be formed thereon as the thickness thereof increases. This is because the volume thereof largely contacts when cross-linked. To prevent the above problem, the surface layer may have a multilayer structure including a lower layer (photosensitive layer side) including a low-molecular dispersion polymer and an upper layer (surface side) including a polymer having a cross-linking structure.

The photoconductor A is manufactured as follows. At first, 182 parts of methyltrimethoxysilane, 40 parts of dihydroxymethyltriphenylamine, 225 parts of 2-propanol, 106 parts of a 2% acetic acid, and 1 part of aluminum trisacetylacetonate are mixed to prepare a surface layer coating liquid. The coating liquid is applied to a charge transport layer and dried. Subsequently, the applied coating liquid is heated for 1 hour at 110° C. to be hardened. Thus, a surface layer having a thickness of 3 μm is prepared.

The photoconductor B is manufactured as follows. At first, 30 parts of a hole-transport compound having the following formula (1), 30 parts of an acrylic monomer having the following formula (2), and 0.6 parts of a light polymerization initiator (1-hydroxy-cyclohexyl-phneyl-ketone) are dissolved in a mixed solvent including 50 parts of monochlorobenzene and 50 parts of dichloromethane, to prepare a surface layer coating liquid:

(1)

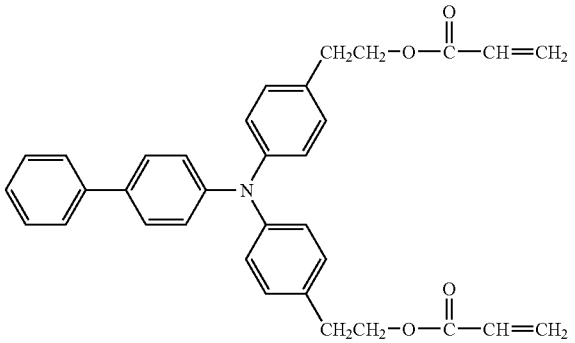

(2)

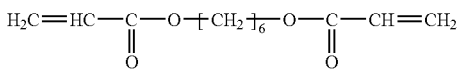

The coating liquid is applied to a charge transport layer by a spray coating method. Subsequently, a metal halide lamp irradiates the applied coating liquid for 30 seconds at a light strength of 500 mW/cm$^2$ to harden the applied coating liquid. Thus, a surface layer having a thickness of 5 μm is prepared.

According to the first exemplary embodiment of the present invention, even a smaller amount of the residual toner particles, of which polarity is not controlled by the conductive blade 11 to be identical to that of the voltage applied to the conductive blade 11, can be removed from the surface of the photoconductor 1 by using the cleaning brush 111. However, because the residual toner particles with the polarity opposite to that of the voltage applied to the conductive blade 11 are not collected by the collecting roller 117, the residual toner particles may remain on the cleaning brush 111, preventing frictional charge between the cleaning brush 111 and the toner particles, and the residual toner particles and the photoconductor 1. Therefore, the residual toner particles which have the polarity opposite to that of the voltage applied to the conductive blade 11 and remain adhering to the cleaning brush 111 need to be reliably collected by the collecting roller 117.

A description is now given of a second exemplary embodiment of the present invention, in which such residual toner particles are reliably collected by the collecting roller 117.

The second exemplary embodiment applied to an electrophotographic printer serving as an image forming apparatus (hereinafter referred to as a "printer 200") is described in detail below.

Figure 22:
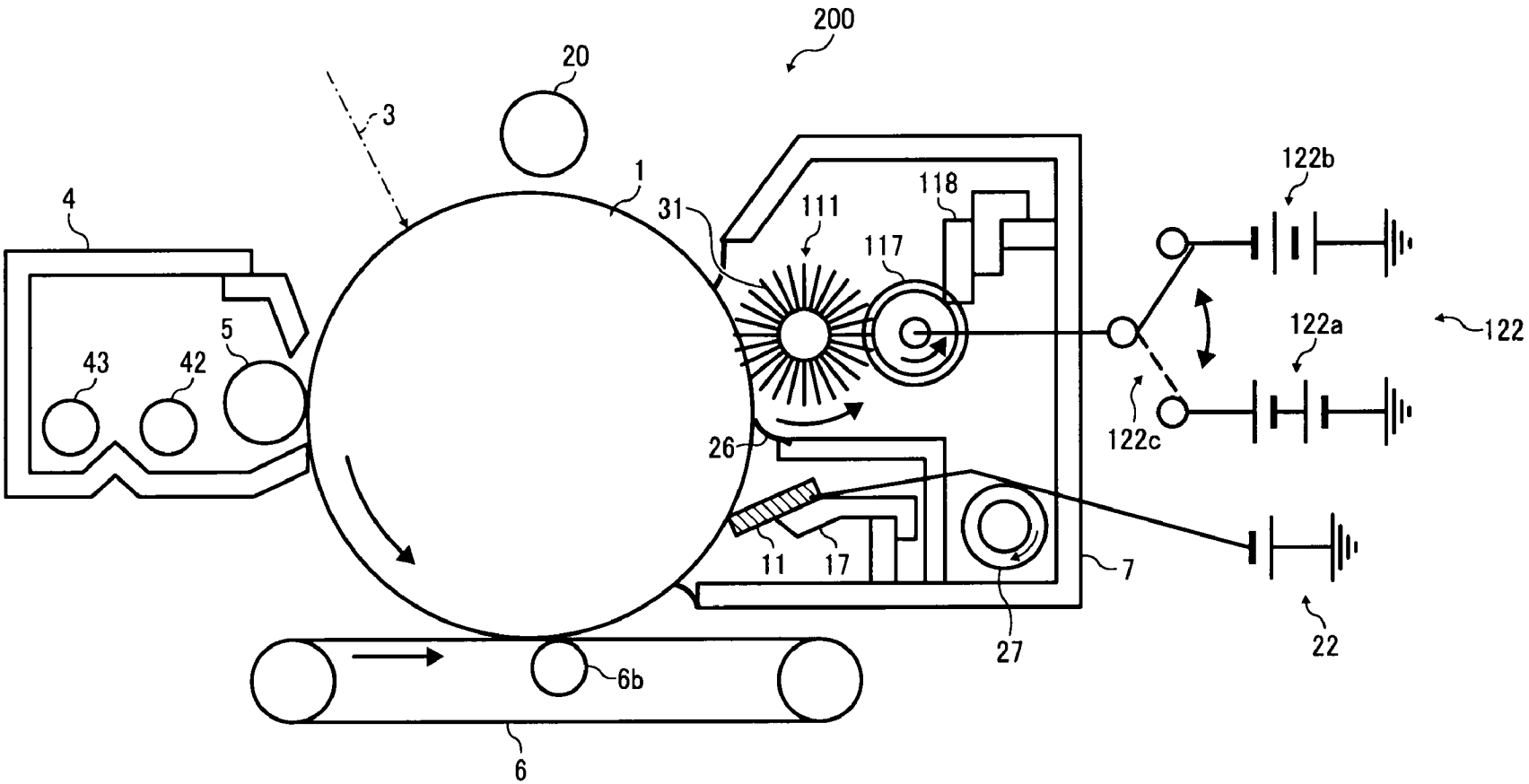
FIG. 22 is a schematic view illustrating main components of an image forming apparatus according to a second exemplary embodiment.

FIG. 22 is a schematic view illustrating main components of the printer 200 according to the second exemplary embodiment. In the second exemplary embodiment, a series of the image forming processes is performed by using a contactless charging roller 20 with a negative-positive process, in which a toner is adhered to a portion having a lower electric potential.

In the printer 200, when a start button provided in an operation unit, not shown, is pressed, a predetermined or desired voltage or current is sequentially applied to each of the contactless charging roller 20, the developing roller 5, the transfer device 6, the conductive blade 11, the cleaning brush 111, the collecting roller 117, and a neutralizing lamp, not shown, at a predetermined or desired timing. At the same time, each of the photoconductor 1, the contactless charging roller 20, the developing roller 5, the transfer device 6, a right screw 42, a left screw 43, the cleaning brush 111, the collecting roller 117, and a toner discharging screw 27 is rotated in a predetermined or desired direction. The photoconductor 1 is rotated at a speed of 200 mm/s, and each of the cleaning brush 111 and the collecting roller 117 is rotated at a speed of 200 mm/s.

The contactless charging roller 20 provided in a contactless manner relative to the photoconductor 1 evenly charges the surface of the photoconductor 1 to, for example, an electric potential of −700V. An exposure device, not shown, irradiates the laser beam 3 corresponding to an image signal to the surface of the photoconductor 1. The electric potential at a portion of the photoconductor 1 irradiated by the laser beam 3 falls to, for example, −120V at a portion of a black solid image so that an electrostatic latent image is formed on the surface of the photoconductor 1. Subsequently, the surface of the photoconductor 1 having the electrostatic latent image thereon contacts the magnetic brush formed of the developer on the developing roller 5. At this time, negatively charged toner particles on the developing roller 5 are attracted to the electrostatic latent image by a developing bias of, for example, −450V, applied to the developing roller 5, and consequently, a toner image is formed on the surface of the photoconductor 1. Meanwhile, a paper feed unit, not shown, feeds a sheet, and the sheet is conveyed between the photoconductor 1 and the transfer device 6 in synchronization with a leading edge of the toner image formed on the surface of the photoconductor 1 by a registration roller, not shown. Thus, the toner image is transferred onto the sheet. A current of +10 μA is applied to the transfer roller **6*b* so as to electrostatically transfer the toner image formed on the surface of the photoconductor 1 onto the sheet. Thereafter, the sheet having the toner image thereon is separated from the photoconductor 1 by a separation mechanism, not shown, and is discharged from the printer 200** through a fixing device, not shown.

Residual toner particles remaining on the surface of the photoconductor 1 after transfer has been performed by the transfer device 6 have a broader charge distribution including both of the positively charged toner particles and the negatively charged toner particles, and are conveyed to the conductive blade 11 along with the rotation of the photoconductor 1. The conductive blade 11 is provided in contact with the photoconductor 1 so as to face in the rotation direction of the photoconductor 1. For example, the conductive blade 11 includes an elastic body including a material such as a polyurethane rubber so as to provide conductive property. A thickness of the conductive blade 11 may be from 50 to 2000 μm, and preferably from 100 to 500 μm. If the thickness of the conductive blade 11 is too thin, a contact pressure of the conductive blade 11 against the photoconductor 1 are not reliably obtained due to flexibility of the surface of the photoconductor 1 and the conductive blade 11. On the other hand, if the thickness of the conductive blade 11 is too thick, the conductive blade 11 absorbs vibration from a vibration member, not shown, and consequently, the vibration is not sufficiently transmitted to the leading edge of the conductive blade 11. As a result, the toner particles adhering to the conductive blade 11 are not shaken off by the vibration member, degrading polarity control of the toner particles performed by the conductive blade 11. The conductive blade 11 may include a material having a JIS-A hardness of from 85 to 100 degrees, so that the vibration from the vibration member is effectively transmitted to the leading edge of the conductive blade 11. In the second exemplary embodiment, the conductive blade 11 contacts the surface of the photoconductor 1 at a contact angle of 20° with a contact pressure of 20 g/cm, and an engagement of 0.6 mm, and has an electric resistivity of $1\times10^{6}\Omega\cdot$cm. The electric resistivity of the conductive blade 11 may be preferably from $2\times10^{5}\Omega\cdot$cm to $5\times10^{7}\Omega\cdot$cm.

The conductive blade 11 has, but is not limited to, a flat shape with a thickness of 2 mm, a free length of 7 mm, a JIS-A hardness of from 60 to 80 degrees, and an impact resilience of 30%, and is bonded to the blade holder 17 including a steel plate. For example, the conductive blade 11 preferably has a JIS-A hardness of from 40 to 85 degrees. Because the conductive blade 11 does not remove all residual toner particles, the amount of the residual toner particles passing through the contact portion between the conductive blade 11 and the photoconductor 1 does not matter.

Most of the residual toner particles are mechanically removed from the surface of the photoconductor 1 by the conductive blade 11. However, a part of the residual toner particles pass through the conductive blade 11 and remain on the surface of the photoconductor 1 due to the stick-slip motion of the conductive blade 11. A voltage with a polarity identical to the regular polarity of the toner particles, namely, the negative polarity, is applied to the conductive blade 11 from the first power circuit 22, so that the conductive blade 11 negatively charges the residual toner particles when the residual toner particles pass through the conductive blade 11. For example, a voltage of −450V is applied to the conductive blade 11.

Figure 23:
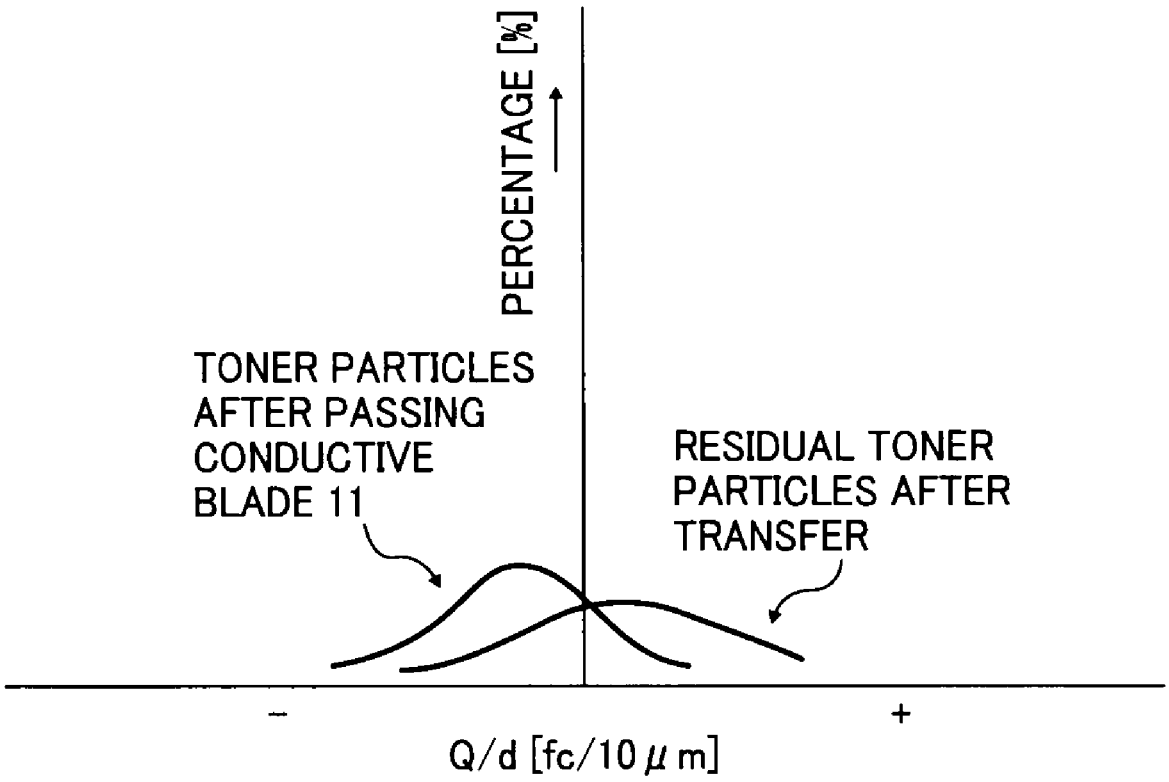
FIG. 23 is a graph illustrating charge distributions of each of the residual toner particles on the surface of the photoconductor after transfer has been performed, and the residual toner particles passing through the portion where the conductive blade contacts the photoconductor according to the second exemplary embodiment.

When passing through the conductive blade 11, the residual toner particles are triboelectrically charged with a pressure from the photoconductor 1 and the conductive blade 11, and consequently, the charge distribution of the residual toner particles on the surface of the photoconductor 1 is shifted toward the negative polarity side as illustrated in FIG. 23. In addition, the voltage is applied to the conductive blade 11 to reliably control the polarity of the residual toner particles such that the charge distribution of the residual toner particles are more stably shifted toward the negative polarity side. When the residual toner particles are sandwiched between the conductive blade 11 and the photoconductor 1, a current is flown into the residual toner particles due to the voltage applied to the conductive blade 11. As a result, the residual toner particles are charged to the polarity identical to that of the applied voltage, and pass through the conductive blade 11. Furthermore, the residual toner particles are charged to the polarity identical to that of the applied voltage due to a micro discharge from the minute gaps at an entry and an exit of a wedge portion formed between the photoconductor 1 and the conductive blade 11. However, as a result of several measurements of the charge distributions of the residual toner particles passing over the conductive blade 11 by using E-SPART analyzer, it is found out that the polarity of 90 percent or more of the residual toner particles is reliably controlled, and the polarity of 10 percent or less of the residual toner particles with a smaller amount of charge is not controlled.

The residual toner particles passing through the conductive blade 11 further pass through an entry seal member 26 along with the rotation of the photoconductor 1, and reaches the cleaning brush 111. The brush string 31 of the cleaning brush 111 is formed of a conductive polyester, and the collecting roller 117 is provided in contact with the cleaning brush 111. Each of the cleaning brush 111, the collecting roller 117, and the toner discharging screw 27, is rotated by a driving force transmitted from a driving unit of the photoconductor 1. The collecting roller 117 is formed of a stainless steel, and a direct-current voltage of 300V is applied to the collecting roller 117 from the second power circuit 122 at the same time when the voltage is applied to the contactless charging roller 20. An alternating-current voltage may be overlapped on the direct-current voltage in order to more reliably remove the residual toner particles from the surface of the photoconductor 1.

The cleaning brush 111 is electrically floated, and the voltage is applied to the cleaning brush 111 through a portion where the cleaning brush 111 contacts the collecting roller 117. Thus, the cleaning brush 111 has an electric potential slightly lower than the voltage applied to the collecting roller 117.

Because most of the residual toner particles on the surface of the photoconductor 1 conveyed to the cleaning brush 111 are negatively charged, the brush string 31 of the cleaning brush 111 charged to the positive polarity electrostatically attract the residual toner particles by rotatably contacting the residual toner particles. Thereafter, the residual toner particles are electrostatically collected to the collecting roller 117 by the voltage applied to the collecting roller 117. The residual toner particles collected by the collecting roller 117 are conveyed to the scraper 118 provided in contact with the collecting roller 117 along with the rotation of the collecting roller 117. Thereafter, the scraper 118 scrapes off the residual toner particles from the collecting roller 117 by contacting the surface of the collecting roller 117.

Meanwhile, the residual toner particles which pass through the conductive blade 11 and are not charged to the regular polarity of the toner particles, namely, the negative polarity, also pass through the entry seal member 26 together with the negatively charged residual toner particles described above along with the rotation of the photoconductor 1, and reaches the portion where the cleaning brush 111 contacts the photoconductor 1. The cleaning brush 111 is formed of polyester including conductive carbon therein, and the surface of the brush string 31 includes conductive polyester. Polyester tends to be charged to the negative polarity in the triboelectric series, so that polyester is negatively charged by friction with the photoconductor 1 which includes a thin polycarbonate film including a photoconductive material on a surface of an aluminum drum. Therefore, the brush string 31 of the cleaning brush 111 is negatively charged by contacting the photoconductor 1, so that the positively charged residual toner particles, which are not charged to the regular polarity by the conductive blade 11, electrostatically adhere to the brush string 31 of the cleaning brush 111, and are removed from the surface of the photoconductor 1.

Thus, a smaller amount of the positively charged residual toner particles which are not charged to the regular polarity by the conductive blade 11 is removed from the surface of the photoconductor 1 by the cleaning brush 111 as described above. However, because the positively charged residual toner particles, of which polarity is opposite to that of the voltage applied to the conductive blade 11, are not collected by the collecting roller 117, the positively charged residual toner particles remain adhering to the cleaning brush 111, preventing frictional charge between the cleaning brush 111 and the residual toner particles, and the cleaning brush 111 and the photoconductor 1. To solve such a problem, the positively charged residual toner particles need to be removed from the cleaning brush 111 at a predetermined timing. Only the positively charged residual toner particles with a smaller amount of charge are collected by the brush string 31. Therefore, even if the positively charged residual toner particles are not collected by the collecting roller 117 and are conveyed to the portion where the cleaning brush 111 contacts the photoconductor 1 again, the positively charged residual toner particles are hardly affected by an electric field between the cleaning brush 111 and the photoconductor 1. As a result, the positively charged residual toner particles remain adhering to the brush string 31, and hardly adhere to the surface of the photoconductor 1.

Referring back to FIG. 22, the second power circuit 122 includes a first power source 122*a* for applying a voltage of 300V to the collecting roller 117, and a second power source 122*b* for applying a voltage of −300V to the collecting roller 117. The second power circuit 122 further includes a switching member 122*c* for switching the power source for applying the voltage to the collecting roller 117 between the first power source 122*a* and the second power source 122*b*. Thus, a polarity of the voltage applied to the collecting roller 117 is switched by the switching member 122*c*.

As described above, the switching member 122*c* connects to the first power source 122*a* so as to apply the voltage of 300V from the first power source 122*a* to the collecting roller 117 during normal cleaning operations. Consequently, the cleaning brush 111 is charged to an electric potential of 220V, which is slightly lower than the electric potential of the collecting roller 117. Therefore, the negatively charged residual toner particles which have the polarity controlled to be identical to that of the voltage applied to the conductive blade 11 and adhere to the cleaning brush 111, are electrostatically collected by the collecting roller 117, and are removed from the cleaning brush 111. The negatively charged toner particles electrostatically collected by the collecting roller 117 are conveyed to the scraper 118 along with the rotation of the collecting roller 117, and are scraped off by the scraper 118. Thereafter, the residual toner particles are conveyed to a waste toner tank provided outside of the cleaning device 7 thorough the toner discharge screw 27.

Meanwhile, the switching member 122*c* switches the power source for applying the voltage to the collecting roller 117 from the first power source 112*a* to the second power source 122*b* to collect the positively charged residual toner particles. Accordingly, a voltage of −300V is applied to the collecting roller 117, and a leading edge of the cleaning brush 111 is charged to an electric potential of about −200V. As a result, the positively charged residual toner particles adhering to the cleaning brush 111 are attracted to the collecting roller 117 having a higher negative electric field, and adhere to the collecting roller 117. Therefore, the positively charged residual toner particles are removed from the cleaning brush 111. The positively charged residual toner particles adhering to the collecting roller 117 are conveyed to the scraper 118 along with the rotation of the collecting roller 117, and are scraped off by the scraper 118. Thereafter, the residual toner particles are conveyed to the waste toner tank provided outside of the cleaning device 7 thorough the toner discharge screw 27.

The positively charged residual toner particles, of which polarity is not controlled by the conductive blade 11, are collected from the cleaning brush 111 when a single printing operation is completed, or at an appropriate timing during the printing operation. Because the residual toner particles with a smaller amount of charge, for example, 0 fC, are not electrostatically collected, it is not preferable to collect the positively charged residual toner particles when the printer 200 is not operated for a long time so that the amount of charge of the residual toner particles decreases. Therefore, it is most preferable to collect the positively charged residual toner particles from the cleaning brush 111 immediately after a single printing operation is completed. In a case in which image formation is continuously performed for a long time in a single printing operation, the positively charged residual toner particles may be collected at a predetermined timing during image formation. The voltage of −300V is preferably applied to the collecting roller 117 for a time when the cleaning brush 111 is rotated one revolution or more, and more preferably for a time when the cleaning brush 111 is rotated five revolutions or more.

Figure 24:
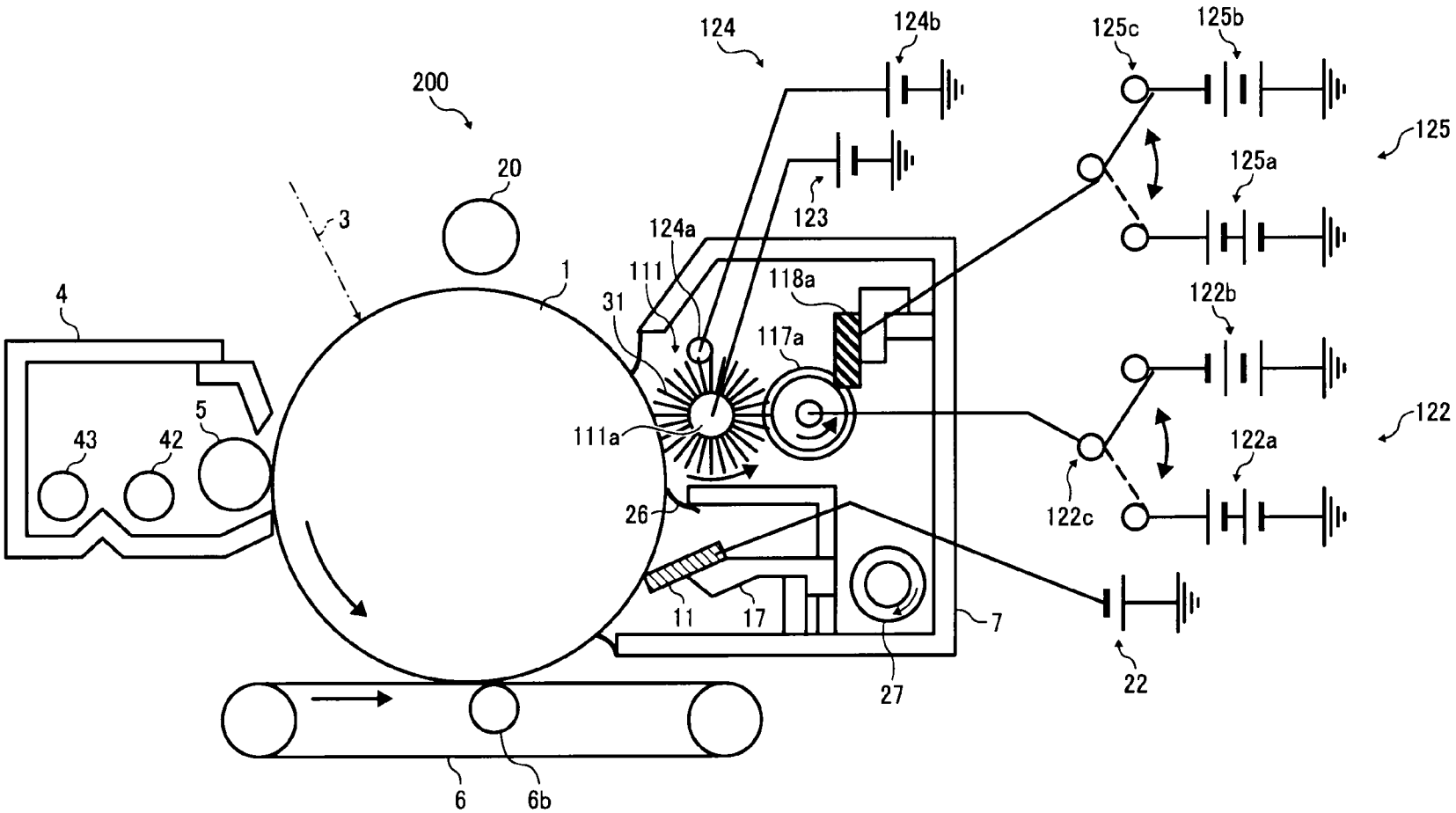
FIG. 24 is a schematic view illustrating a first exemplary variation of the main components of the image forming apparatus according to the second exemplary embodiment.

FIG. 24 is a schematic diagram illustrating a first exemplary variation of the main components of the image forming apparatus according to the second exemplary embodiment. In the first exemplary variation, the cleaning device 7 includes a collecting roller 117*a* having a high-resistance surface layer (hereinafter referred to as a "high-resistance collecting roller 117*a*"). The cleaning device 7 further includes a brush charge application unit 124 for applying a charge to the surface of the brush string 31 included in the cleaning brush 111, and a roller charge application unit for applying a charge to the surface of the high-resistance collecting roller 117*a*.

The high-resistance collecting roller 117*a* includes a stainless steel core with a diameter of 16 mm, and a surface of the stainless steel core is coated with a PVDF in a thickness of 100 μm, and is further covered with an acrylic UV curing resin layer. The high-resistance collecting roller 117*a* has a resistivity of $10^{12}\Omega/\square$.

The brush charge application unit 124 includes a brush charge application member 124*a* and a fourth power circuit 124*b*. The brush charge application member 124*a* is provided on a downstream side from a portion where the cleaning brush 111 and the high-resistance collecting roller 117*a* contact each other relative to the rotation direction of the cleaning brush 111, and on an upstream side from the portion where the cleaning brush 111 and the photoconductor 1 contact each other relative to the rotation direction of the cleaning brush 111. The brush charge application member 124*a* includes a stainless bar extending in an axial direction of the brush rotation shaft 111*a*, and contacts the leading edge of the cleaning brush 111 with an engagement of 1 mm. The brush charge application member 124*a* is connected to the fourth power circuit 124*b*, and a voltage with the polarity opposite to that of the voltage applied to the conductive blade 11 is applied to the brush charge application member 124*a* from the fourth power circuit 124*b*. A material included in the brush charge application member 124*a* is not limited to a stainless steel as long as the material is conductive. Furthermore, a shape of the brush charge application member 124*a* is not limited to a bar-like shape, and may be a plate-like shape.

The roller charge application unit includes a conductive scraper 118*a* including a conductive polyurethane blade, and a fifth power circuit 125 for applying a voltage to the conductive scraper 118*a*. The fifth power circuit 125 includes a first power source 125*a* for applying a positive voltage to the conductive scraper 118*a*, and a second power source 125*b* for applying a negative voltage to the conductive scraper 118*a*. The fifth power circuit 125 further includes a switching member 125*c* for switching the power source for applying the voltage to the conductive scraper 118*a* between the first power source 125*a* and the second power source 125*b*.

In the first exemplary variation, a voltage with a polarity opposite to that of the voltage applied to the conductive blade 11 is applied from the third power circuit 123 to the brush rotation shaft 111*a* of the cleaning brush 111.

The high-resistance collecting roller 117*a* more reliably collects the residual toner particles adhering to the cleaning brush 111, improving cleaning performance of the cleaning brush 111.

A description is now given of toner collecting performance of the high-resistance collecting roller 117*a*.

Figure 25A:
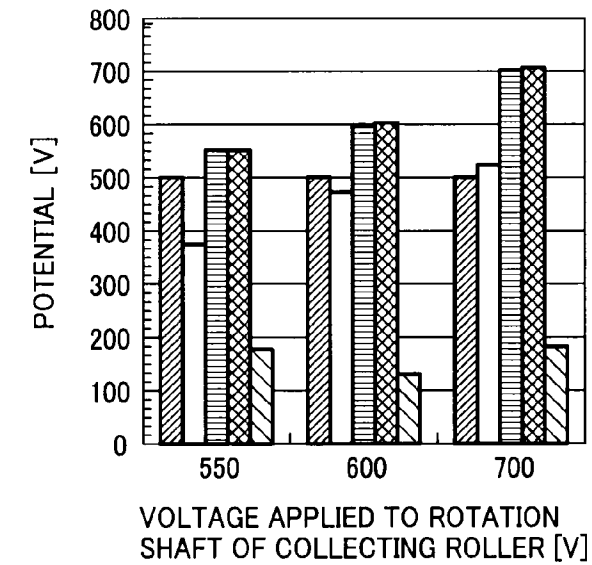
FIG. 25A is a graph illustrating electric potentials of each of a leading edge of the cleaning brush and a surface of a metal collecting roller.
Figure 25B:
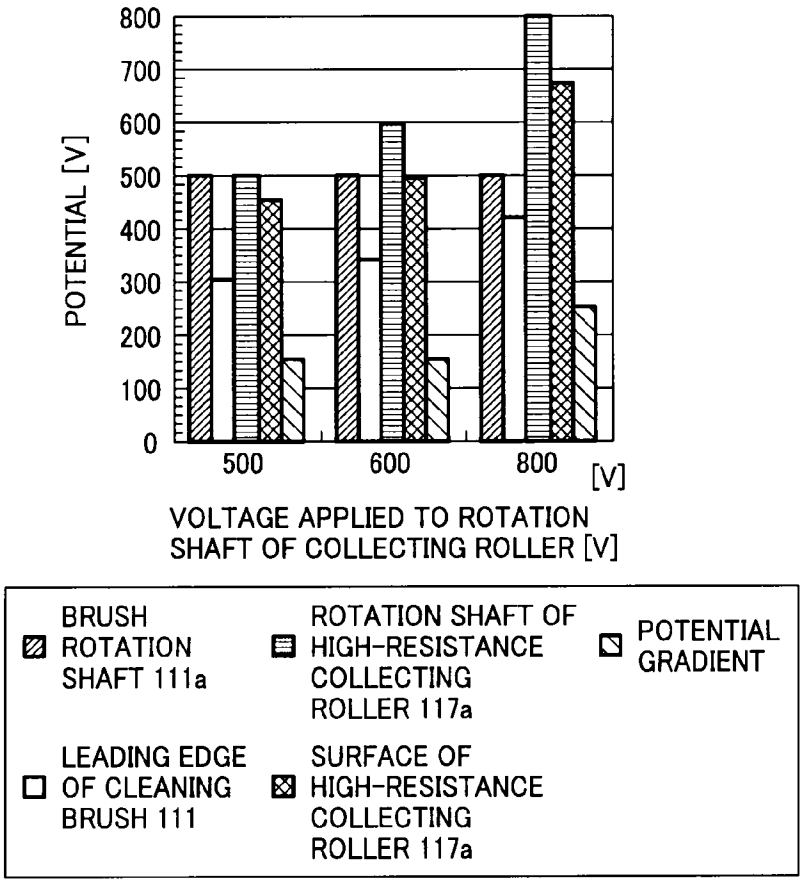
FIG. 25B is a graph illustrating electric potentials of each of the leading edge of the cleaning brush and a surface of a high-resistance collecting roller.

FIG. 25A is a graph illustrating a relation between electric potentials of each of the brush rotation shaft 111*a*, the leading edge of the cleaning brush 111, the rotation shaft of the collecting roller 117 made of SUS, and the surface of the collecting roller 117, and a potential difference between the surface of the collecting roller 117 and the leading edge of the cleaning brush 111 when voltages of 500V and from 550V to 700V are respectively applied to the brush rotation shaft 111*a* and the rotation shaft of the collecting roller 117 under an environmental condition at a higher temperature of 32° C. and a higher humidity of 80%. FIG. 25B is a graph illustrating a relation between electric potentials of each of the brush rotation shaft 111*a*, the leading edge of the cleaning brush 111, a rotation shaft of the high-resistance collecting roller 117*a*, and a surface of the high-resistance collecting roller 117*a*, and a potential difference between the surface of the high-resistance collecting roller 117*a* and the leading edge of the cleaning brush 111 when voltages of 500V and from 500V to 800V are respectively applied to the brush rotation shaft 111*a* and the rotation shaft of the high-resistance collecting roller 117*a* under the environmental condition at the higher temperature of 32° C. and the higher humidity of 80%.

Referring to FIGS. 25A and 25B, an electric potential of the leading edge of the cleaning brush 111 when an electric potential of the surface of the high-resistance collecting roller 117*a* is about 700V is lower than that when an electric potential of the surface of the collecting roller 117 is about 700V. Therefore, when the voltages applied to the rotation shafts of each of the collecting roller 117 and the high-resistance collecting roller 117*a* are increased, a larger potential difference between the surface of the high-resistance collecting roller 117*a* and the leading edge of the cleaning brush 11 is obtained as compared to a potential difference between the surface of the collecting roller 117 and the leading edge of the cleaning brush 111. Such a larger potential difference increases an electrostatic force to move the residual toner particles adhering to the cleaning brush 111 to the high-resistance collecting roller 117*a*, improving toner collecting performance of the high-resistance collecting roller 117*a*.

Figure 26:
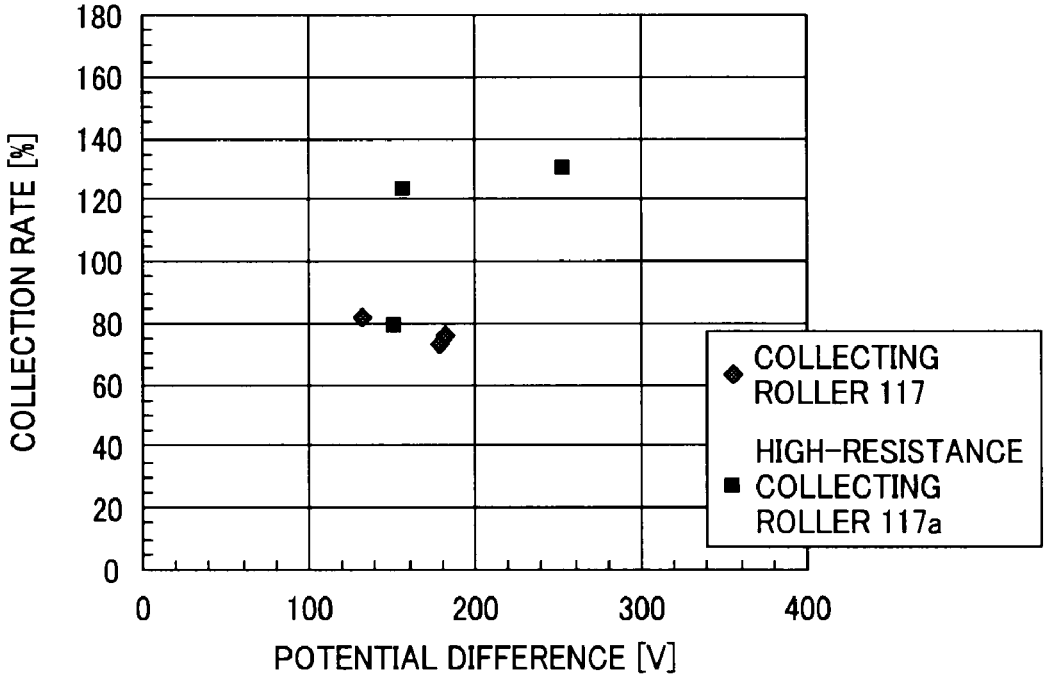
FIG. 26 is a graph illustrating a relation between potential differences between each of the surface of the metal collecting roller and the high-resistance collecting roller, and the leading edge of the cleaning brush, and a collection rate of the toner particles.

FIG. 26 is a graph illustrating a relation between the potential difference between the leading edge of the cleaning brush 111 and the surfaces of each of the collecting roller 117 and the high-resistance collecting roller 117*a*, which is represented on a horizontal axis, and a collection rate of the residual toner particles, which is represented on a vertical axis. Here, to obtain the collection rate of the residual toner particles, a predetermined amount of the toner particles, represented by a unit of $mg/cm^2$ for convenience of calculation, is experimentally adhered to the surface of the photoconductor 1, and amounts of the toner particles collected from the cleaning brush 111 by each of the collecting roller 117 and the high-resistance collecting roller 117*a* are measured per unit area. The collection rate of the residual toner particles is calculated by an expression of the form: Collection Rate(%)=(M/A on Collecting Roller)/(M/A on Photoconductor before Cleaning)×100, where M/A, represented by a unit of $mg/cm^2$, is a mass of the residual toner particles per unit area.

As is clear from the graph illustrated in FIG. 26, although the collection rate of the residual toner particles when the collecting roller 117 is used is 80% at a maximum, the collection rate of the residual toner particles when the high-resistance collecting roller 117*a* is used may be 100% or more. Here, the collection rate of the residual toner particles may exceed 100% because the toner particles are provided to the photoconductor 1 for 10 seconds, the cleaning brush 111 and the high-resistance collecting roller 117*a* may not entirely collect the residual toner particles for the first few seconds, and a part of the residual toner particles remain on the cleaning brush 111. Therefore, the high-resistance collecting roller 117*a* collect both of the residual toner particles remaining on the cleaning brush 111 and the residual toner particles sequentially collected by the cleaning brush 111 at the same time. As a result, the amount of the residual toner particles collected by the high-resistance collecting roller 117*a* may exceed the amount of the toner particles provided to the photoconductor 1, and the collection rate of the residual toner particles exceeds 100%.

As is clear from the graphs respectively illustrated in FIGS. 25A, 25B, and 26, the high-resistance collecting roller 117*a* can provide higher toner collecting performance as compared to the collecting roller 117.

Figure 27:
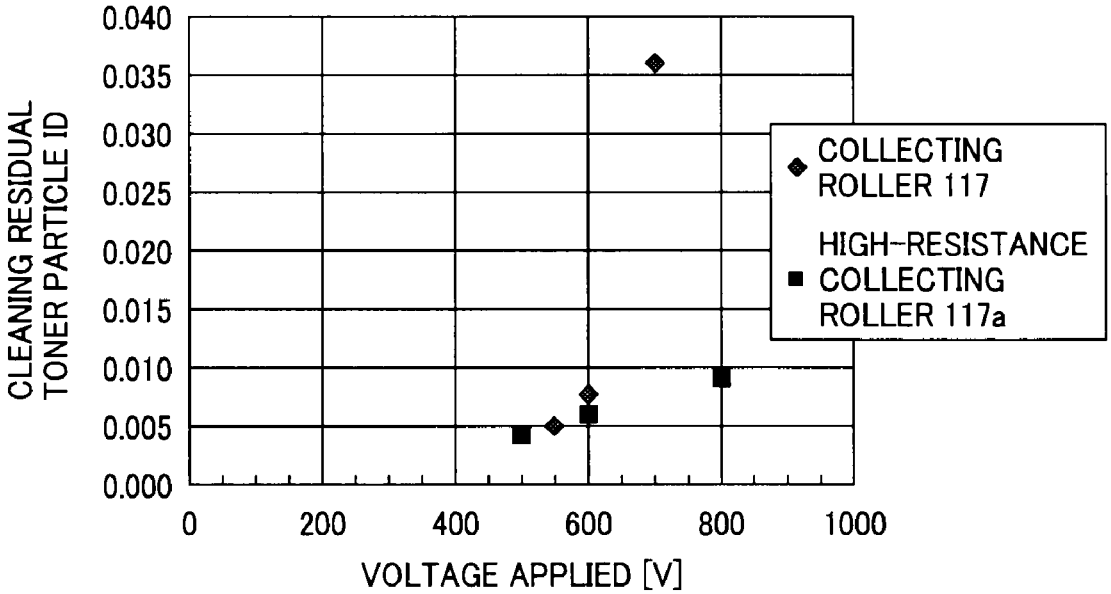
FIG. 27 is a graph illustrating a relation between cleaning residual toner particle IDs of each of the metal collecting roller and the high-resistance collecting roller, and a voltage applied to each of the above-described collecting rollers.

FIG. 27 is a graph illustrating a relation between the cleaning residual toner particle ID and a voltage applied to each of the collecting roller 117 and the high-resistance collecting roller 117*a*. The cleaning residual toner particle ID is represented on a vertical axis. Here, the cleaning residual toner particle ID is obtained as follows. Toner particles remaining on the surface of the photoconductor 1 after cleaning has been performed by the cleaning brush 111 are transferred onto a SCOTCH® tape. Subsequently, the SCOTCH® tape with the transferred toner particles thereon is put on a paper to measure a reflection density thereof with a spectro-colorimeter X-RITE 938 manufactured by X-Rite Inc. Meanwhile, only a SCOTCH® tape is put on a paper to measure a reflection density thereof with the spectro-colorimeter. The cleaning residual toner particle ID is obtained by subtracting the reflection density of the SCOTCH® tape from the reflection density of the SCOTCH® tape with the transferred toner particles thereon. The cleaning residual toner particle ID has a correlation with the amount of toner particles, and a value of the cleaning residual toner particle ID increases as an increase in the amount of toner particles. Therefore, the cleaning performance may be judged by the value of the cleaning residual toner particle ID. In other words, a smaller value of the cleaning residual toner particle ID represents higher cleaning performance.

Referring to FIG. 27, the high-resistance collecting roller 117*a* has a higher margin of the applied voltage relative to the cleaning residual toner particle ID as compared to the collecting roller 117 even when the applied voltage is increased. Accordingly, higher cleaning performance can be obtained even when the voltage applied to the high-resistance collecting roller 117*a* is increased. A possible reason for this is described below.

A positive voltage V1, which is set such that the leading edge of the cleaning brush 111 has a higher electric potential than that of the surface of the photoconductor 1 after passing through the conductive blade 11, is applied to the brush rotation shaft 111*a*, and a positive voltage V2, which is higher than the positive voltage V1, is applied to the rotation shafts of each of the collecting roller 117 and the high-resistance collecting roller 117*a* to collect the residual toner particles negatively charged by the conductive blade 11. In such a case, the negatively charged residual toner particles adhere to the cleaning brush 111 charged to the positive polarity. In addition, the positively charged residual toner particles with a smaller amount of charge, of which polarity is not controlled to be negative by the conductive blade 11, also adhere to the brush string 31 of the cleaning brush 111 due to the frictional charge between the brush string 31 and the photoconductor 1. Thereafter, the negatively charged toner particles adhere to the collecting roller 117 or the high-resistance collecting roller 117*a*, each of which is positively charged and has a higher electric potential than that of the cleaning brush 111, and are collected by the collecting roller 117 or the high-resistance collecting roller 117*a*. When contacting the toner particles adhering to the brush string 31 of the cleaning brush 111, each of the collecting roller 117 and the high-resistance collecting roller 117*a* supplies a charge to the brush string 31 and the residual toner particles adhering thereto until the brush string 31 and the residual toner particles have an electric potential identical to that of the surface of each of the collecting roller 117 and the high-resistance collecting roller 117*a*. Thereafter, the voltage is applied from the second power circuit 122 to each of the collecting roller 117 and the high-resistance collecting roller 117*a* again to raise the electric potential of the surface of each of the collecting roller 117 and the high-resistance collecting roller 117*a*. It is estimated that a time required for the surface of the collecting roller 117 to have the electric potential identical to that of the voltage applied from the second power circuit 122 again after supplying the charge is shorter than the time required for the surface of the high-resistance collecting roller 117*a* under the same condition as described above. Therefore, as compared to the high-resistance collecting roller 117*a*, the collecting roller 117 supplies a larger amount of charge to the residual toner particles adhering to the cleaning brush 111 at a portion where the collecting roller 117 contacts the cleaning brush 111. The amount of charge supplied to the residual toner particles increases as the voltage applied to the collecting roller is increased. Therefore, the positively charged residual toner particles with a smaller amount of charge adhering to the cleaning brush 111 by the frictional charge between the cleaning brush 111 and the photoconductor 1 turn into the positively charged residual toner particles with a larger amount of charge when the applied voltage is increased. In addition, the negatively charged residual toner particles adhering to the cleaning brush 111 are reversed to the positively charged residual toner particles with a larger amount of charge. Consequently, a larger number of the residual toner particles adhering to the cleaning brush 111 turn into the positively charged residual toner particles with a larger amount of charge, and move to the surface of the photoconductor 1 from the cleaning brush 111 because the photoconductor 1 has a higher negative electric potential as compared to the leading edge of the cleaning brush 111. As a result, the cleaning residual toner particle ID increases. On the other hand, in a case in which the high-resistance collecting roller 117*a*, of which surface has a resistivity of $10^{10}$ to $10^{13}\Omega/\square$, is used, a smaller amount of charge is applied to the residual toner particles between the brush string 31 and the high-resistance collecting roller 117*a*. Therefore, a smaller amount of the residual toner particles is strongly charged to the positive polarity even when a higher voltage is applied to the high-resistance collecting roller 117*a*, so that a smaller cleaning residual toner particle ID can be obtained as compared to the case in which the collecting roller 117 is used.

As described above, the residual toner particles between the brush string 31 and the high-resistance collecting roller 117*a* do not tend to be strongly charged to the positive polarity when the surface of the high-resistance collecting roller 117*a* has the resistivity of $10^{10}\Omega/\square$ or more at the higher temperature and humidity.

However, when the high-resistance collecting roller 117*a* is used under a condition of lower temperature and humidity, problems of changes in the electric potentials of each of the leading edge of the cleaning brush 111 and the high-resistance collecting roller 117*a* occur as described below.

Figure 28:
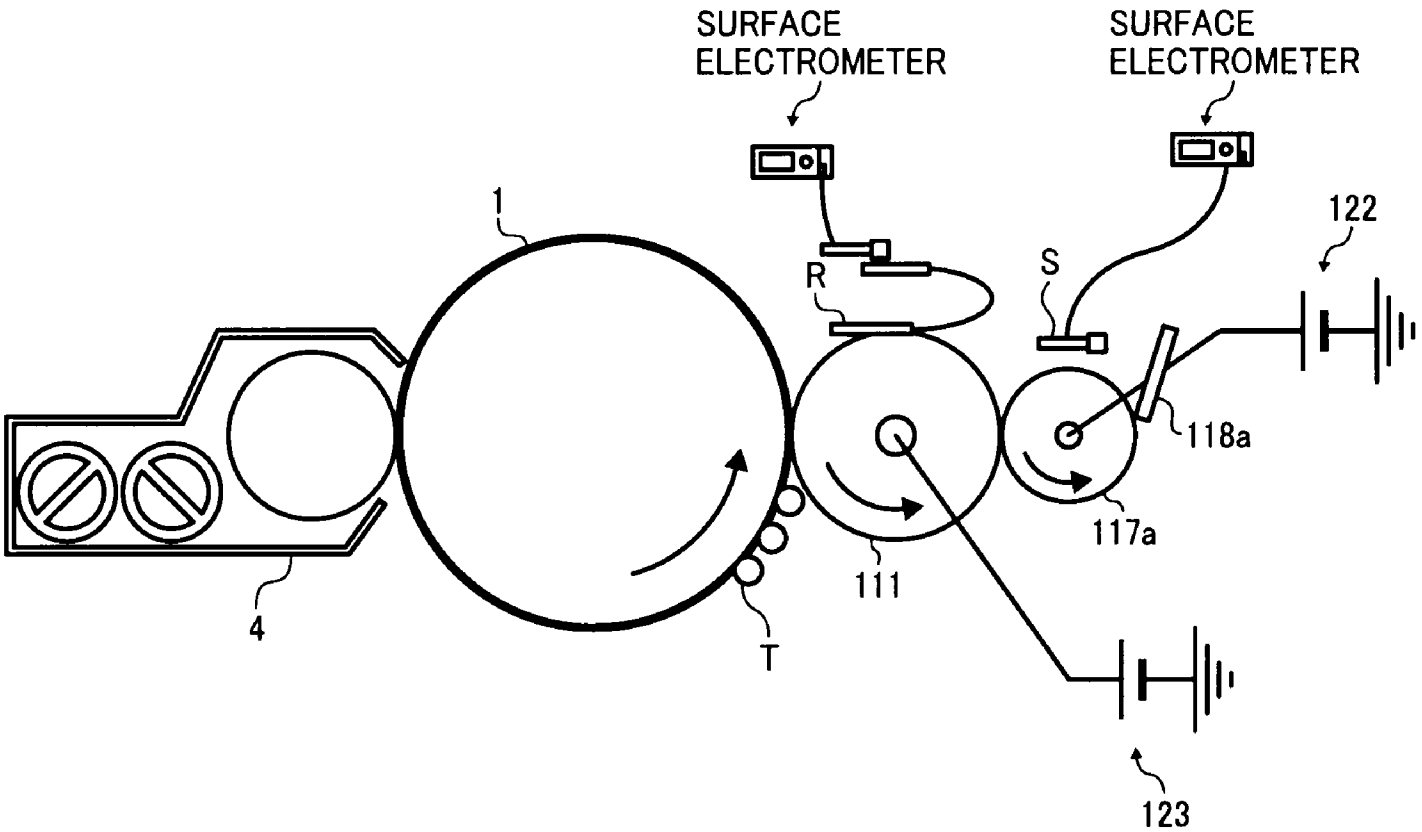
FIG. 28 is a schematic view illustrating a laboratory equipment to measure the electric potentials of each of the leading edge of the cleaning brush and the surface of the high-resistance collecting roller.

An experiment has been performed by using a laboratory equipment illustrated in FIG. 28 under a condition at a lower temperature of 10° C. and a lower humidity of 15%. An electric potential of the surface of the high-resistance collecting roller 117*a* is measured at a portion S after the residual toner particles adhering to the high-resistance collecting roller 117*a* has been removed by the conductive scraper 118*a*. As a result, it is found out that the electric potential of the surface of the high-resistance collecting roller 117*a* decreases at the portion S. In addition, an electric potential of the leading edge of the cleaning brush 111 which rotatively contacts the high-resistance collecting roller 117*a* is measured by using a surface electrometer at a portion R. As a result, it is found out that the electric potential of the leading edge of the cleaning brush 111 also varies at the portion R within several hundred volts.

Figure 29A:
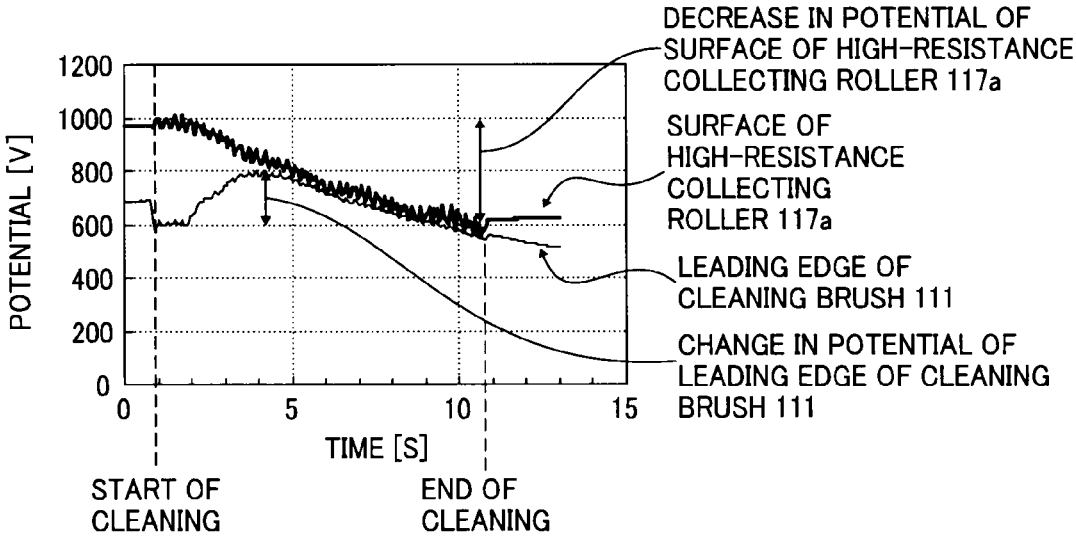
FIG. 29A is a graph illustrating the electric potentials of each of the surface of the high-resistance collecting roller and the leading edge of the cleaning brush measured for 10 seconds while supplying the toner particles to the surface of the photoconductor.
Figure 29B:
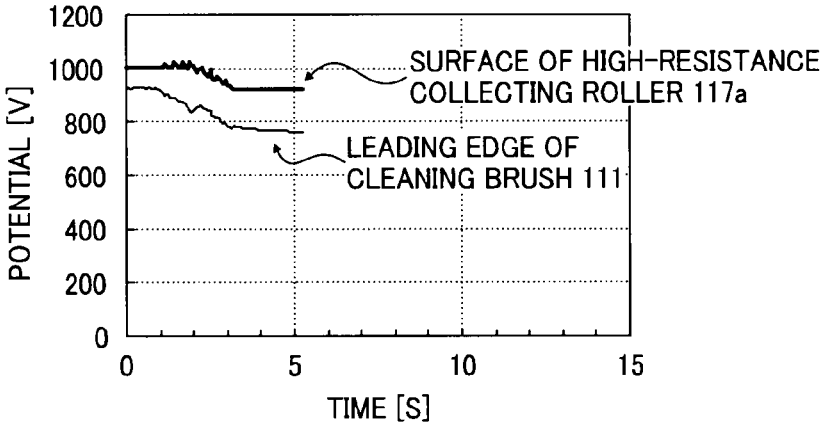
FIG. 29B is a graph illustrating the electric potentials of each of the surface of the high-resistance collecting roller and the leading edge of the cleaning brush measured for 2 seconds while supplying the toner particles to the surface of the photoconductor.
Figure 29C:
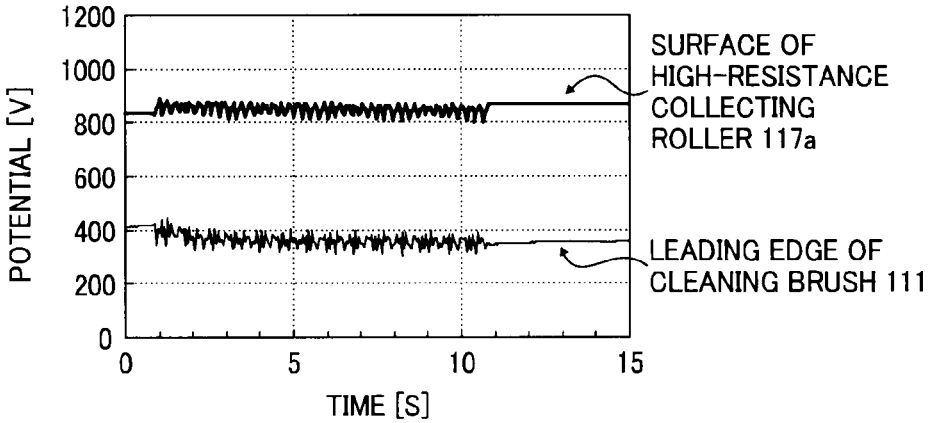
FIG. 29C is a graph illustrating the electric potentials of each of the surface of the high-resistance collecting roller and the leading edge of the cleaning brush measured for 10 seconds without supplying the toner particles to the surface of the photoconductor.

FIG. 29A is a graph illustrating electric potentials of each of the surface of the high-resistance collecting roller 117*a* and the leading edge of the cleaning brush 111 measured by a surface electrometer for 10 seconds while supplying toner particles to the photoconductor 1, and FIG. 29B is a graph illustrating the above-described electric potentials measured for 2 seconds. FIG. 29C is a graph illustrating the above-described electric potentials measured for 10 seconds without supplying toner particles to the photoconductor 1. Voltages of 1000V and 700V are respectively applied to the rotation shaft of the high-resistance collecting roller 117*a* and the brush rotation shaft 111*a* during the measurement. A mass of supplied toner particles per unit area (M/A) on the surface of the photoconductor 1 is 0.1 mg/cm$^2$, and an amount of charge of the supplied toner particles per unit mass (Q/M) is from −5 to −11 μC/g. Although a mass of the residual toner particles on the surface of the photoconductor 1 per unit area after transfer has been performed usually changes, an estimated mass thereof is from 0.02 to 0.08 mg/cm$^2$. Accordingly, based on the estimation, the mass of the residual toner particles has been set so as to slightly exceed the estimated value described above.

Referring to FIG. 29A, the electric potential of the surface of the high-resistance collecting roller 117*a* decreases by 400V 10 seconds later from the start of cleaning. Furthermore, the electric potential of the leading edge of the cleaning brush 111 varies within about 250V. A potential difference of about 400V between the surface of the high-resistance collecting roller 117*a* and the leading edge of the cleaning brush 111 decreases to about 30V 10 seconds later from the start of cleaning.

Referring to FIG. 29B, the potential difference between the surface of the high-resistance collecting roller 117*a* and the leading edge of the cleaning brush 111 is still 150V 2 seconds later from the start of cleaning although decrease in the electric potential of the surface of the high-resistance collecting roller 117*a* and change in the electric potential of the leading edge of the cleaning brush 111 are already started at that time. Referring to FIG. 29C, unlike the above-described two examples, the electric potential of the surface of the high-resistance collecting roller 117*a* does not vary within several hundred volts, and the electric potential of the leading edge of the cleaning brush 111 does not vary within several hundreds volts when the measurement is performed for 10 seconds without supplying the toner particles to the photoconductor 1. Factors which cause the above-described change and decrease in the electric potentials are not yet known. However, because the above-described change and decrease are correlated with the supply of the toner particles, it is no doubt that the supply of the toner particles affects the electric potentials of each of the leading edge of the cleaning brush 111 and the surface of the high-resistance collecting roller 117*a*. So far, it is thought that an electric discharge occurs when the charged residual toner particles adhering to the surface of the high-resistance collecting roller 117*a* are scraped off by the conductive scraper 118*a*, so that negative charges are applied to the high-resistance layer or the insulating layer included in the high-resistance collecting roller 117*a*, causing the decrease in the electric potential of the surface of the high-resistance collecting roller 117*a*. Alternatively, it is thought that the residual toner particles adhering to the surface of the high-resistance collecting roller 117*a* apply negative charges to the surface layer of the high-resistance collecting roller 117*a*, and such negative charges remain on the high-resistance collecting roller 117*a* even after the residual toner particles have been scraped off by the conductive scraper 118*a*, causing the decrease in the electric potential of the surface of the high-resistance collecting roller 117*a*.

When there is little potential difference between the leading edge of the cleaning brush 111 and the surface of the high-resistance collecting roller 117*a* as illustrated in FIG. 29A, naturally, the residual toner particles adhering to the cleaning brush 111 are not collected by the high-resistance collecting roller 117*a*, and remain adhering to the cleaning brush 111. Therefore, the residual toner particles on the surface of the photoconductor 1 are not reliably cleaned. To solve such a problem, in the first exemplary variation, charges are applied from the roller charge application unit to the surface of the high-resistance collecting roller 117*a* to prevent the decrease in the electric potential of the surface of the high-resistance collecting roller 117*a* as described above.

Figure 30:
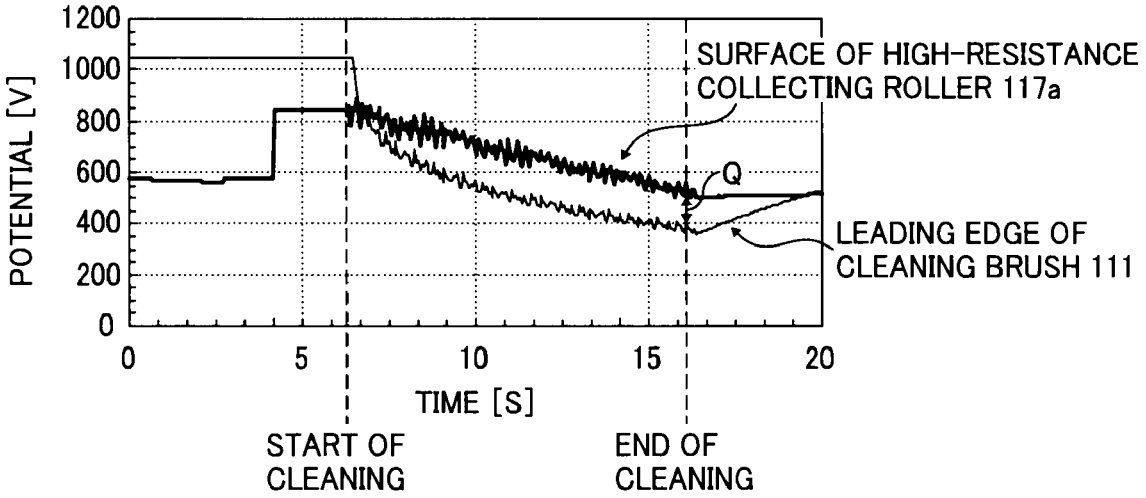
FIG. 30 is a graph illustrating the electric potentials of each of the surface of the high-resistance collecting roller and the leading edge of the cleaning brush measured while supplying the toner particles to the surface of the photoconductor when voltages of 700V, 1000V, and 1000V are respectively applied to a brush rotation shaft, a rotation shaft of the high-resistance collecting roller, and a conductive scraper.

FIG. 30 is a graph illustrating electric potentials of the surface of the high-resistance collecting roller 117*a* and the leading edge of the cleaning brush 111 measured by a surface electrometer while supplying toner particles to the photoconductor 1 when voltages of 700V, 1000V, and 1000V are respectively applied to the brush rotation shaft 111*a*, the rotation shaft of the high-resistance collecting roller 117*a*, and the conductive scraper 118*a*. As is clear from comparison between FIG. 29A and FIG. 30, the decrease in the electric potential of the surface of the high-resistance collecting roller 117*a* is suppressed by applying charges to the surface of the high-resistance collecting roller 117*a* from the roller charge application unit. As a result, a larger potential difference between the surface of the high-resistance collecting roller 117*a* and the leading edge of the cleaning brush 111 is obtained even 10 seconds later from the start of cleaning as indicated by a two-headed arrow Q in FIG. 30. The electric potential of the surface of the high-resistance collecting roller 117*a* is further increased and stably kept by reducing the resistivity of the conductive scraper 118*a*, or increasing the voltage applied to the conductive scraper 118*a*.

Figure 31:
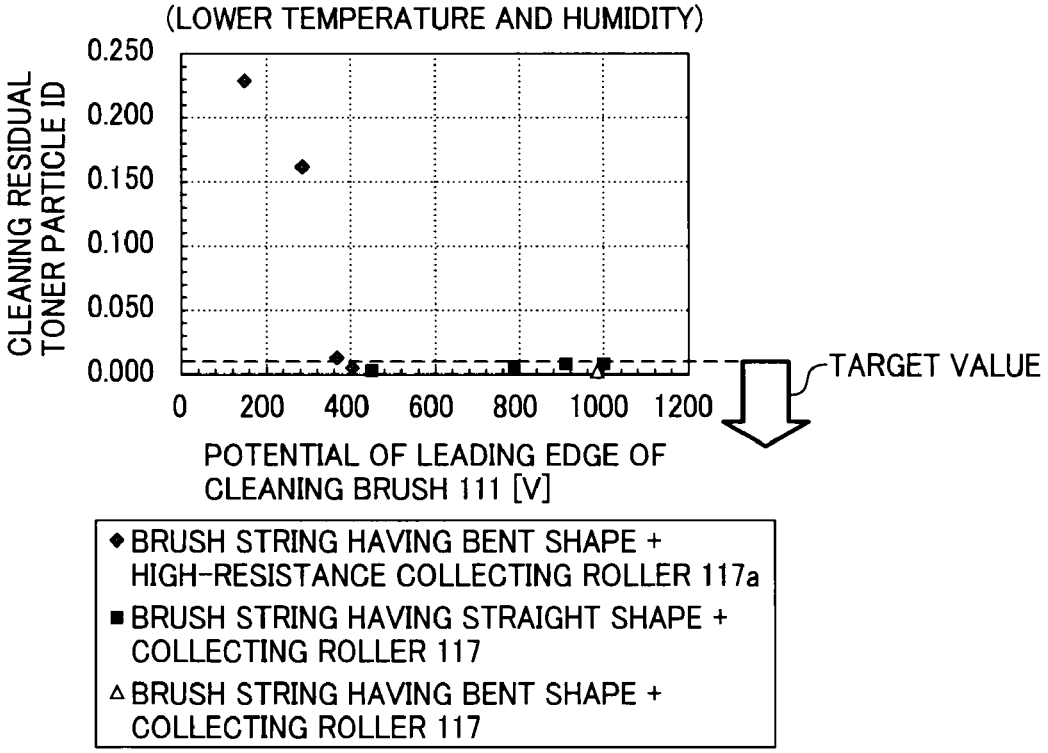
FIG. 31 is a graph illustrating a relation between the electric potentials of each of the leading edge of the cleaning brush and the cleaning residual toner particle ID at lower temperature and humidity.
Figure 32:
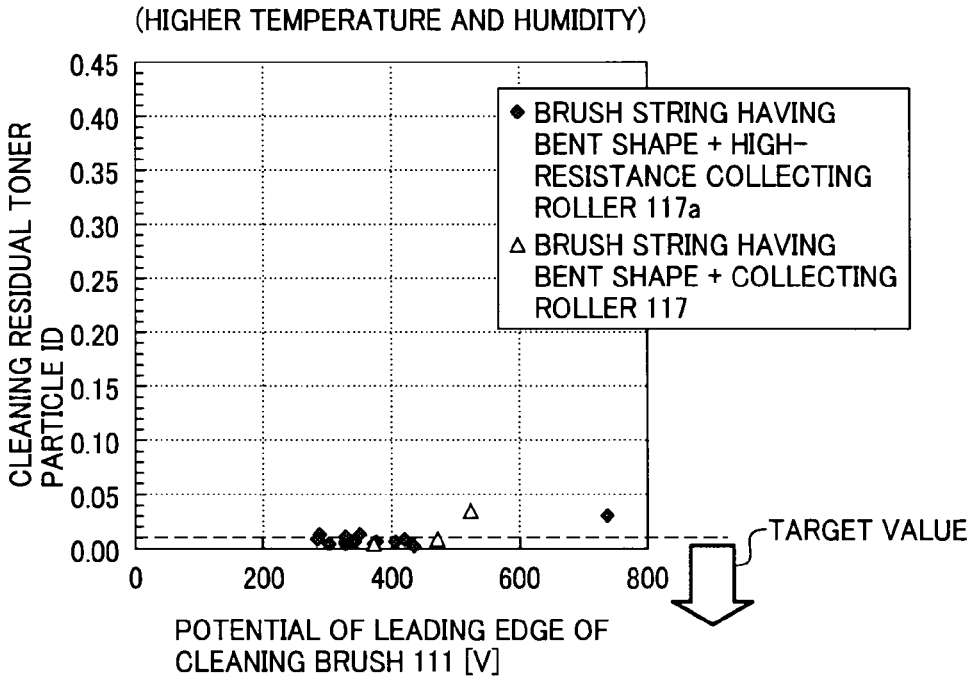
FIG. 32 is a graph illustrating a relation between the electric potentials of each of the leading edge of the cleaning brush and the cleaning residual toner particle ID at higher temperature and humidity.

FIG. 31 is a graph illustrating a relation between the electric potential of the leading edge of the cleaning brush 111 and the cleaning residual toner particle ID under the condition at the lower temperature of 10° C. and the lower humidity of 15%. FIG. 32 is a graph illustrating the relation illustrated in FIG. 31 under the condition at the higher temperature of 32° C. and the higher humidity of 80%. Referring to FIG. 31, the cleaning residual toner particle ID reaches a target value of 0.01 or less when the electric potential of the leading edge of the cleaning brush 111 is from 400 to 1000V at the lower temperature and humidity. Referring to FIG. 32, the cleaning residual toner particle ID reaches the above-described target value when the electric potential of the leading edge of the cleaning brush 111 is from 300V to 500V at the higher temperature and humidity. Therefore, the residual toner particles on the surface of the photoconductor 1 are reliably collected by the cleaning brush 111 under both conditions at the lower temperature and humidity and the higher temperature and humidity when the electric potential of the leading edge of the cleaning brush 111 is from 400V to 500V.

However, as illustrated in FIGS. 29A and 29B, when the high-resistance collecting roller 117*a* is used, the electric potential of the leading edge of the cleaning brush 111 is considerably changed if it takes 2 seconds or more from the start to the end of cleaning at the lower temperature and humidity. To prevent such a considerable change in the electric potential, in the first exemplary variation, charges are applied from the brush charge application unit 124 to the leading edge of the cleaning brush 111 as described above. Here, the brush charge application member 124*a* of the brush charge application unit 124 is provided in contact with the leading edge of the cleaning brush 111 with an engagement of 1 mm, and a voltage of 500V is applied from the fourth power circuit 124*b*.

Figure 33:
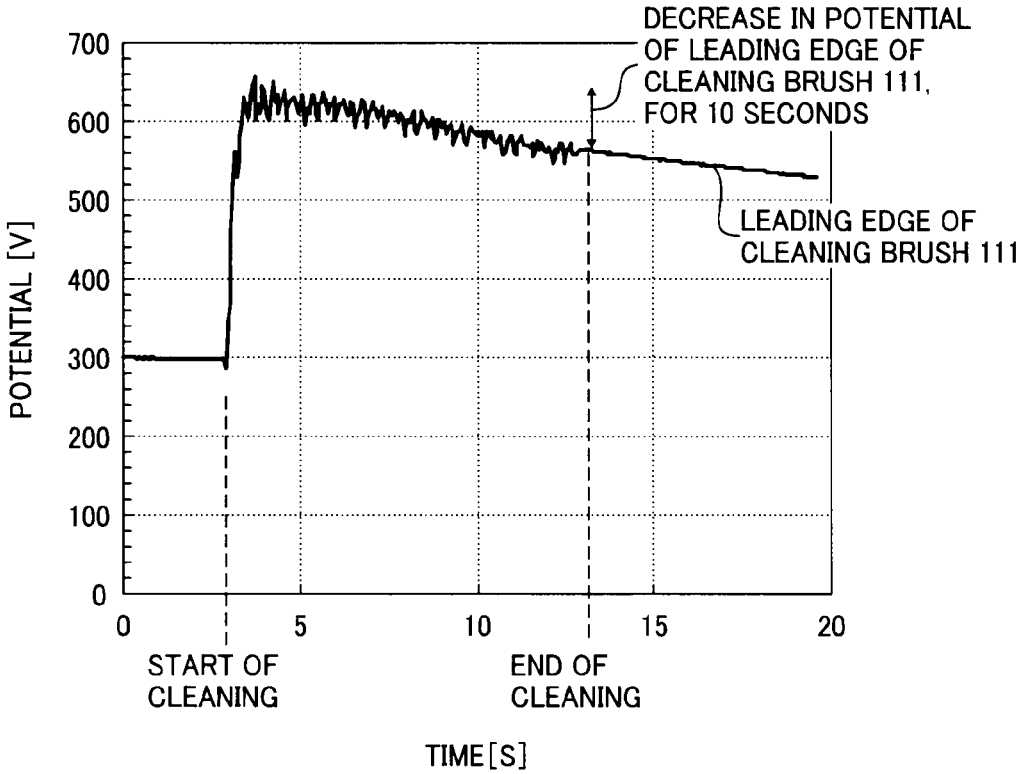
FIG. 33 is a graph illustrating the electric potential of the leading edge of the cleaning brush measured by a surface electrometer while supplying the toner particles to the surface of the photoconductor when voltages of 700V, 700V, 1000V, and 1000V are respectively applied to the brush rotation shaft, a brush charge application member, the rotation shaft of the high-resistance collecting roller, and the conductive scraper.

FIG. 33 is a graph illustrating an electric potential of the leading edge of the cleaning brush 111 measured by a surface electrometer while supplying toner particles to the photoconductor 1 when voltages of 700V, 700V, 1000V, and 1000V are respectively applied to the brush rotation shaft 111*a*, the brush charge application member 124*a*, the rotation shaft of the high-resistance collecting roller 117*a*, and the conductive scraper 118*a*. Referring to FIG. 33, the electric potential of the leading edge of the cleaning brush 111 is prevented from being considerably changed as compared to the example illustrated in FIG. 29A. Furthermore, the decrease in the electric potential of the leading edge of the cleaning brush 111 is suppressed as compared to the example illustrated in FIG. 29A.

Figure 34:
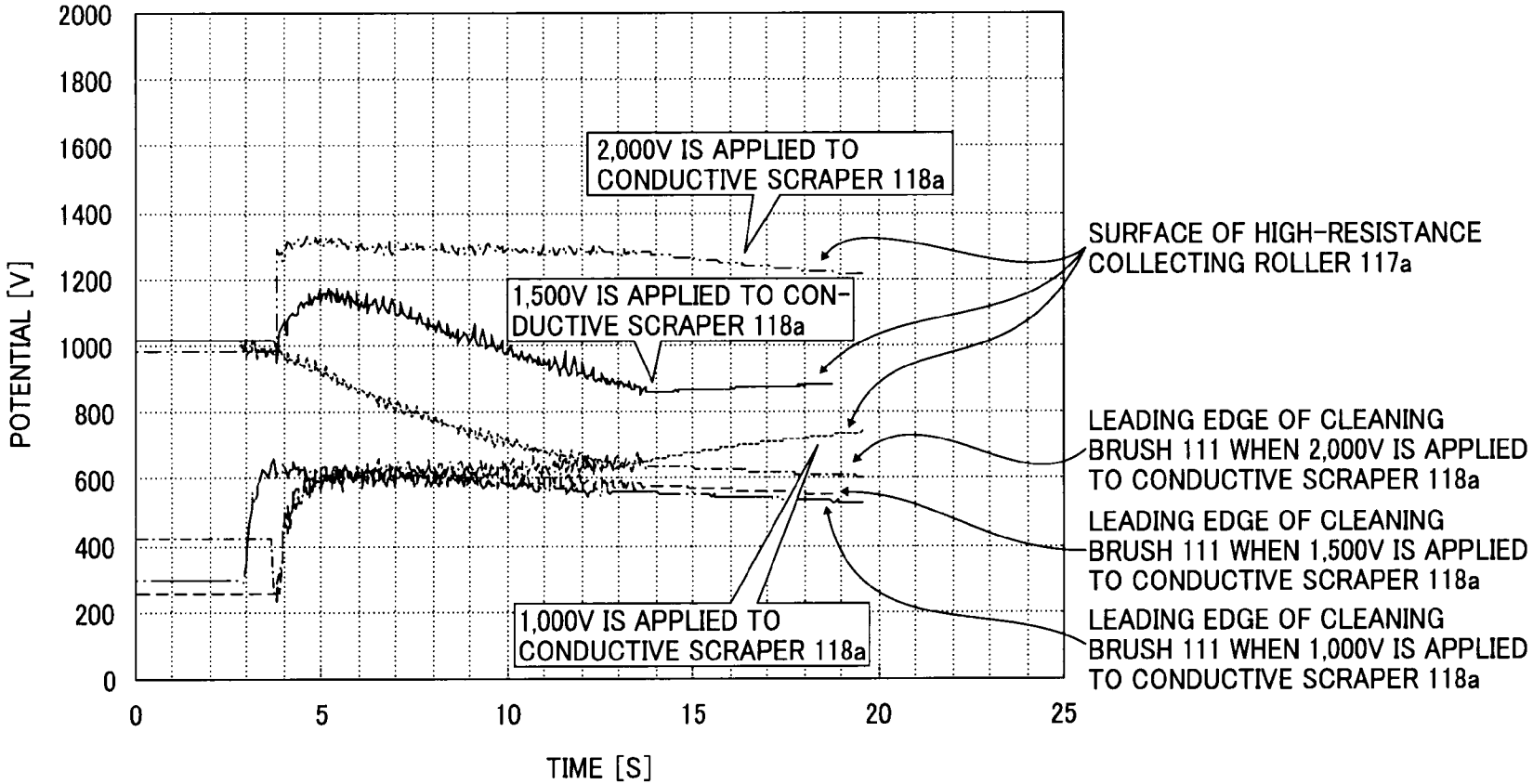
FIG. 34 is a graph illustrating the electric potentials of each of the leading edge of the cleaning brush and the surface of the high-resistance collecting roller measured while supplying the toner particles to the surface of the photoconductor when the voltage applied to the conductive scraper is gradually increased.

FIG. 34 is a graph illustrating electric potentials of each of the leading edge of the cleaning brush 111 and the surface of the high-resistance collecting roller 117*a* measured by a surface electrometer while supplying toner particles to the photoconductor 1 when a voltage applied to the conductive scraper 118*a* serving as the roller charge application member is gradually increased to 1000V, 1500V, and 2000V. The brush charge application member 124*a* includes a copper plate, and voltages of 700V, 700V, and 1000V are respectively applied to the brush rotation shaft 111*a*, the brush charge application member 124*a*, and the rotation shaft of the high-resistance collecting roller 117*a*.

Referring to FIG. 34, the decrease in the electric potential of the surface of the high-resistance collecting roller 117*a* is further suppressed by increasing the voltage applied to the conductive scraper 118*a*. Although the conductive scraper 118*a* having a volume resistivity of $10^8\Omega\cdot$cm is used in the first exemplary variation, charges can be more effectively applied to the high-resistance collecting roller 117*a* by using the conductive scraper 118*a* including a material with a lower resistivity as long as toner cleaning performance of the conductive scraper 118*a* is not degraded. It is desirable that the conductive scraper 118*a* includes the material having a lower resistivity particularly at the lower temperature and humidity.

The voltages applied to each of the brush rotation shaft 111*a*, the brush charge application member 124*a*, the rotation shaft of the high-resistance collecting roller 117*a*, and the conductive scraper 118*a* are not limited to the above-described values. Because appropriate values of the applied voltages vary depending on characteristics of a toner, the electric potentials of the surface of the photoconductor 1 after passing through the conductive blade 11 or being evenly charged, a resistivity of the cleaning brush 111, and so forth, the values of the applied voltages may be appropriately set.

A description is now given of cleaning of the surface of the photoconductor 1 according to the first exemplary variation.

Referring back to FIG. 24, the residual toner particles charged to the regular polarity of the toner particles, namely, the negative polarity, by the negatively charged conductive blade 11 pass through the entry seal member 26 along with the rotation of the photoconductor 1, and are conveyed to the cleaning brush 111. A voltage with a polarity opposite to that of the regular polarity of the toner particles controlled by the conductive blade 11, namely, the positive polarity, is applied to the brush rotation shaft 111*a* from the third power circuit 123. Consequently, the residual toner particles with the negative polarity electrostatically adhere to the cleaning brush 111 after passing through the conductive blade 11.

Meanwhile, the positively charged residual toner particles which are not charged to the regular polarity of the toner particles when passing through the conductive blade 11 also pass through the entry seal member 26 together with the negatively charged residual toner particles described above along with the rotation of the photoconductor 1, and are conveyed to the cleaning brush 111. A smaller amount of the positively charged residual toner particles electrostatically adhere to the brush string 31 triboelectrically charged by contacting the photoconductor 1.

Voltages of 500V, 500V, 800V, and 1000V are respectively applied to the brush rotation shaft 111*a*, the brush charge application member 124*a*, the rotation shaft of the high-resistance collecting roller 117*a*, and the conductive scraper 118*a* during normal cleaning operations. Consequently, the residual toner particles which are charged to the negative polarity by the conductive blade 11 and adhered to the cleaning brush 111 are collected by the high-resistance collecting roller 117*a* due to the potential difference between the leading edge of the cleaning brush 111 and the surface of the high-resistance collecting roller 117*a*. The residual toner particles collected by the high-resistance collecting roller 117*a* are scraped off by the conductive scraper 118*a*, and are discharged from the cleaning device 7 through the toner discharge screw 27, or are conveyed back to the developing device 4.

Meanwhile, as described above, the positively charged residual toner particles, of which polarity is not controlled by the conductive blade 11, are collected from the cleaning brush 111 when a single printing operation is completed, or at a predetermined timing during the printing operation. In other words, the switching member 122*c* switches the power source for applying the voltage to the high-resistance collecting roller 117*a* from the first power source 112*a* to the second power source 122*b*. In addition, the switching member 125*c* switches the power source for applying the voltage to the conductive scraper 118*a* from the first power source 125*a* to the second power source 125*b*. Consequently, voltages of 500V, 500V, −100V, and −500V are respectively applied to the brush rotation shaft 111*a*, the brush charge application member 124*a*, the rotation shaft of the high-resistance collecting roller 117*a*, and the conductive scraper 118*a* during collection of the positively charged residual toner particles. Therefore, the positively charged residual toner particles adhering to the cleaning brush 111 electrostatically adhere to the high-resistance collecting roller 117*a* due to the potential difference between the leading edge of the cleaning brush 111 and the surface of the high-resistance collecting roller 117*a*, and are removed from the cleaning brush 111. The positively charged residual toner particles electrostatically collected by the high-resistance collecting roller 117*a* are conveyed to the conductive scraper 118*a* along with the rotation of the high-resistance collecting roller 117*a*, and are scraped off by the conductive scraper 118*a*. Thereafter, the residual toner particles are conveyed to a waste toner tank provided outside of the cleaning device 7 thorough the toner discharge screw 27.

Thus, the brush charge application unit 124 and the roller charge application unit are provided as described above to suppress the change in the potential difference between the leading edge of the cleaning brush 111 and the surface of the high-resistance collecting roller 117*a*. As a result, the high-resistance collecting roller 117*a* stably and reliably collects the negatively charged residual toner particles, of which polarity is controlled by the conductive blade 11, and the positively charged residual toner particles, of which polarity is not controlled by the conductive blade 11, from the cleaning brush 111.

Figure 35:
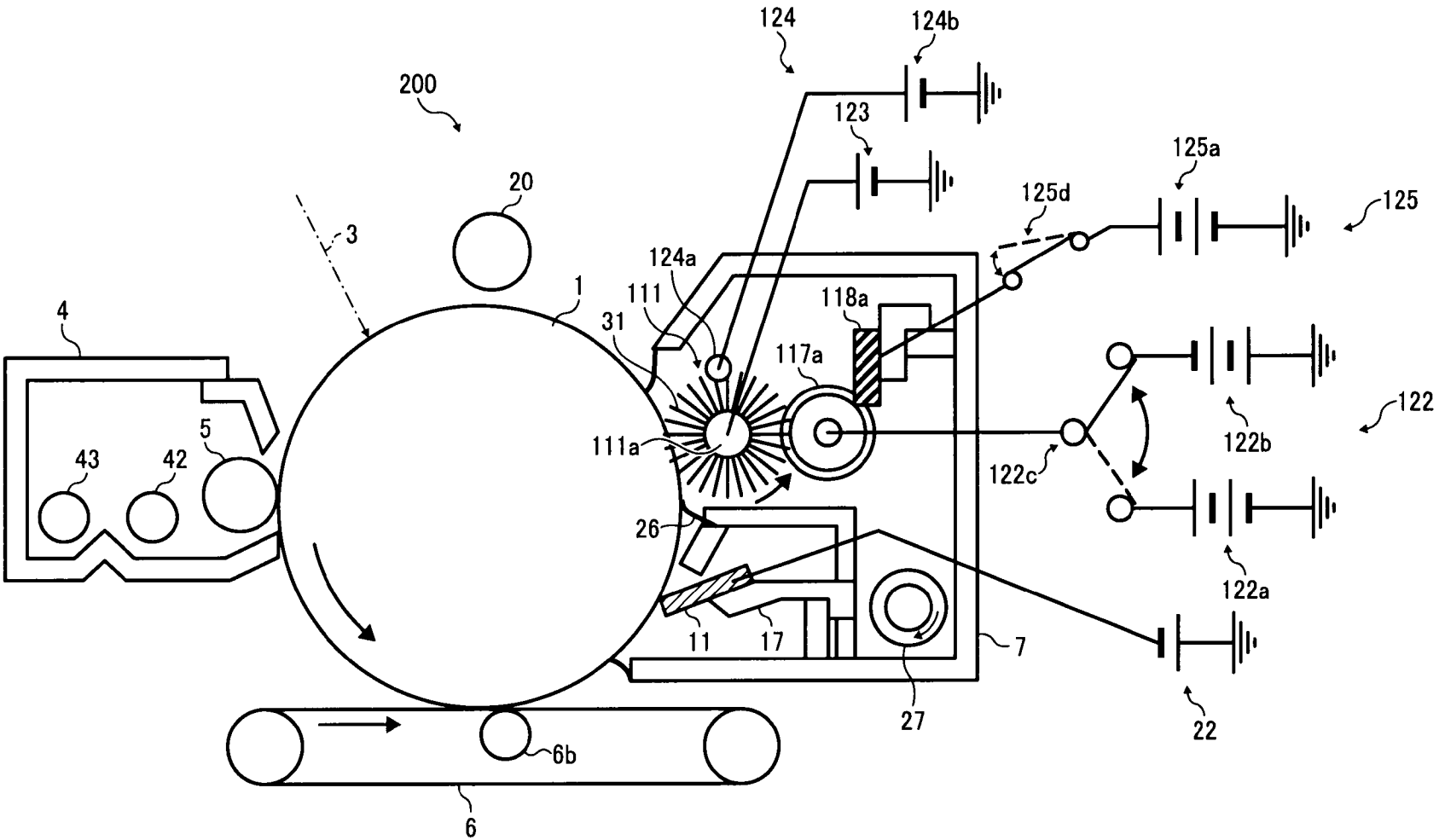
FIG. 35 is a schematic view illustrating an example of a second exemplary variation of the main components of the image forming apparatus according to the second exemplary embodiment.

A description is now given of a second exemplary variation of the second exemplary embodiment. FIG. 35 is a schematic view illustrating the second exemplary variation of the main components of the image forming apparatus according to the second exemplary embodiment. In the second exemplary variation, a voltage is not applied to the conductive scraper 118*a* serving as the roller charge application member during collection of the positively charged residual toner particles, of which polarity is not controlled by the conductive blade 11. Accordingly, the image forming apparatus of the second exemplary variation includes a configuration same as that of the image forming apparatus of the first exemplary variation, except that the fifth power circuit 125 includes the first power source 125*a* and a switch 125*d*.

Similarly to the first exemplary variation, voltages of 500V, 500V, 800V, and 1000V are respectively applied to the brush rotation shaft 111*a*, the brush charge application member 124*a*, the rotation shaft of the high-resistance collecting roller 117*a*, and the conductive scraper 118*a* during normal cleaning operations of collecting the negatively charged residual toner particles, of which polarity is controlled by the conductive blade 11, from the cleaning brush 111. Consequently, the negatively charged residual toner particles adhering to the cleaning brush 111 electrostatically adhere to the high-resistance collecting roller 117*a* due to the potential difference between the leading edge of the cleaning brush 111 and the surface of the high-resistance collecting roller 117*a*. The negatively charged residual toner particles collected by the high-resistance collecting roller 117*a* are scraped off by the conductive blade 118*a*, and are discharged from the cleaning device 7 through the toner discharge screw 27, or are conveyed back to the developing device 4.

Meanwhile, the switching member 122*c* switches the power source for applying the voltage to the high-resistance collecting roller 117*a* from the first power source 112*a* to the second power source 122*b* during collection of the positively charged toner particles. In addition, the switch 125*d* of the fifth power circuit 125 is turned off, so that the voltage is not applied to the conductive scraper 118*a* from the first power source 125*a*. In other words, voltages of 500V, 500V, and −500V are respectively applied to the brush rotation shaft 111*a*, the brush charge application member 124*a*, and the rotation shaft of the high-resistance collecting roller 117*a*, and no voltage is applied to the conductive scraper 118*a* during collection of the positively charged residual toner particles. Therefore, the positively charged residual toner particles adhering to the cleaning brush 111 electrostatically adhere to the high-resistance collecting roller 117*a* due to the potential difference between the leading edge of the cleaning brush 111 and the surface of the high-resistance collecting roller 117*a* generated by applying the voltage of −500V to the rotation shaft of the high-resistance collecting roller 117*a*. Thus, the positively charged toner particles are removed from the cleaning brush 111 to the high-resistance collecting roller 117*a*.

According to the second exemplary variation, a negative voltage is not applied to the conductive scraper 118*a* during collection of the positively charged toner particles, resulting in lower costs of power as compared to the image forming apparatus of the first exemplary variation. However, the application of the voltage to the conductive scraper 118*a* is not required only within a time when the electric potential of the surface of the high-resistance collecting roller 117*a* is not decreased by the application of the voltage to the rotation shaft of the high-resistance collecting roller 117*a*. In other words, the appropriate potential difference between the leading edge of the cleaning brush 111 and the surface of the high-resistance collecting roller 117*a* can be kept for 2 seconds from the start of cleaning as illustrated in FIG. 29B. Therefore, the configuration of the second exemplary variation is effectively applicable to the image forming apparatus as long as the positively charged residual toner particles are collected by the high-resistance collecting roller 117*a* within 2 seconds.

The time when the appropriate potential difference between the leading edge of the cleaning brush 111 and the surface of the high-resistance collecting roller 117*a* can be kept is not limited to 2 seconds as described above, and may vary depending on a resistivity, a thickness of a surface layer, and a rotation speed of each of the cleaning brush 111, the high-resistance collecting roller 117*a*, a toner particle, and the photoconductor 1, and so forth. Therefore, the time for collecting the positively charged residual toner particles may be preferably set based on results of an experiment.

Figure 36:
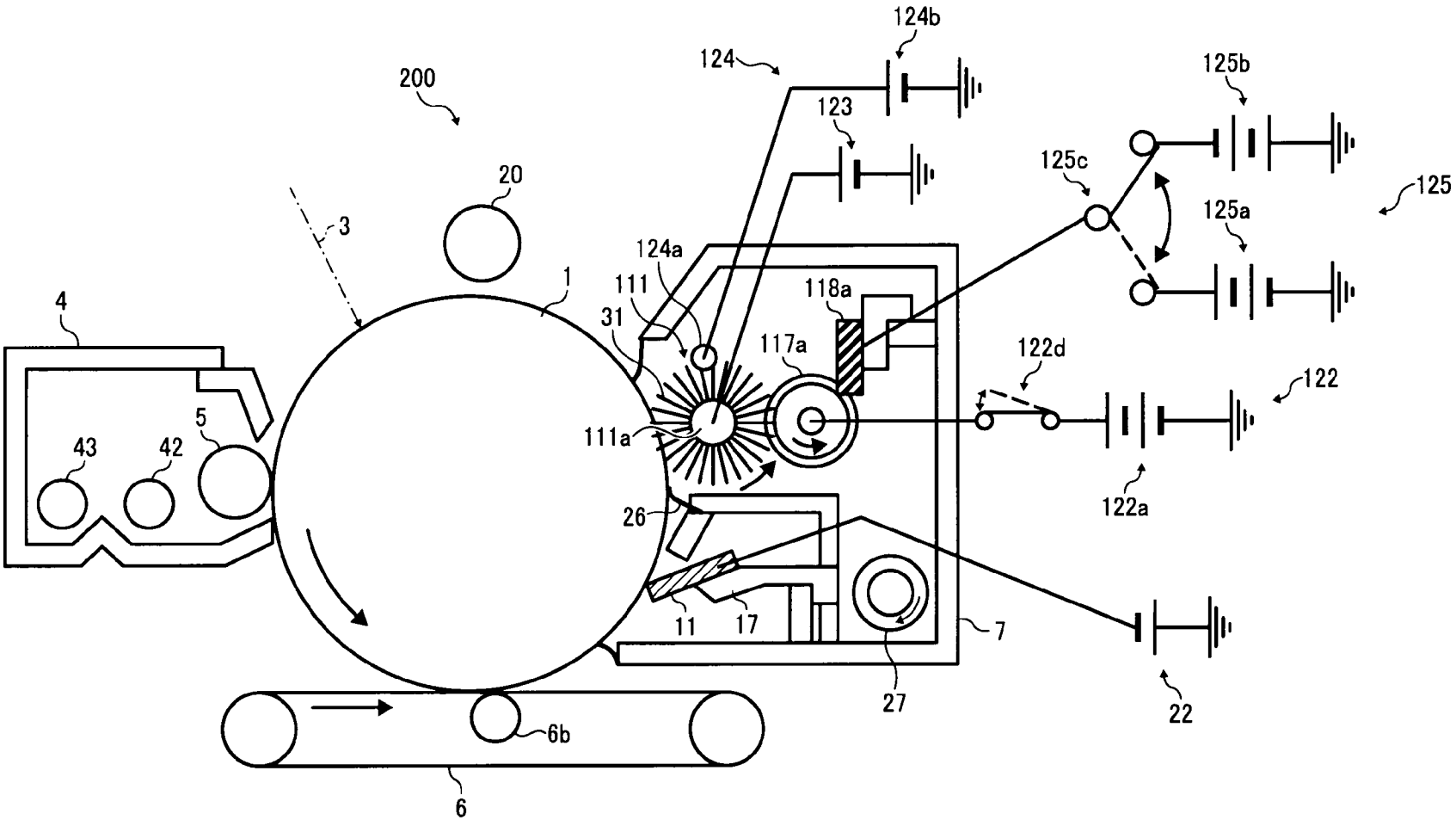
FIG. 36 is a schematic view illustrating another example of the second exemplary variation of the main components of the image forming apparatus according to the second exemplary embodiment.

Alternatively, as illustrated in FIG. 36, the voltage may not be applied to the high-resistance collecting roller 117*a* during collection of the positively charged residual toner particles. In such a case, the second power circuit 122 for applying the voltage to the high-resistance collecting roller 117*a* includes the first power source 122*a* and a switch 122*d*.

Similarly to the above-described example, voltages of 500V, 500V, 800V, 1000V are respectively applied to the brush rotation shaft 111*a*, the brush charge application member 124*a*, the rotation shaft of the high-resistance collecting roller 117*a*, the conductive scraper 118*a* during normal cleaning operations of collecting the negatively charged residual toner particles from the cleaning brush 111.

Meanwhile, the switch 122*d* of the second power circuit 122 is turned off, so that a voltage is not applied to the high-resistance collecting roller 117*a* from the first power source 122*a* during collection of the positively charged residual toner particles. In addition, the switching member 125*c* of the fifth power circuit 125 switches the power source for applying the voltage to the conductive scraper 118*a* from the first power source 125*a* to the second power source 125*b*. In other words, voltages of 500V, 500V, and −500V are respectively applied to the brush rotation shaft 111*a*, the brush charge application member 124*a*, and the conductive scraper 118*a*, and no voltage is applied to the rotation shaft of the high-resistance collecting roller 117*a* during collection of the positively charged residual toner particles. Therefore, the positively charged residual toner particles adhering to the cleaning brush 111 are electrostatically collected by the high-resistance collecting roller 117*a* due to the potential difference between the leading edge of the cleaning brush 111 and the surface of the high-resistance collecting roller 117*a* generated by applying the voltage of −500V to the conductive scraper 118*a*. Thus, the positively charged toner particles are collected by the high-resistance collecting roller 117*a* from the cleaning brush 111.

A lower costs of power can be achieved with the configuration illustrated in FIG. 36 as compared to the image forming apparatus of the first exemplary variation. In the configuration illustrated in FIG. 36, the positively charged residual toner particles are required to be collected from the cleaning brush 111 within the time when the electric potential of the surface of the high-resistance collecting roller 117*a* is not decreased by the application of the voltage to the rotation shaft of the high-resistance collecting roller 117*a*.

Figure 37:
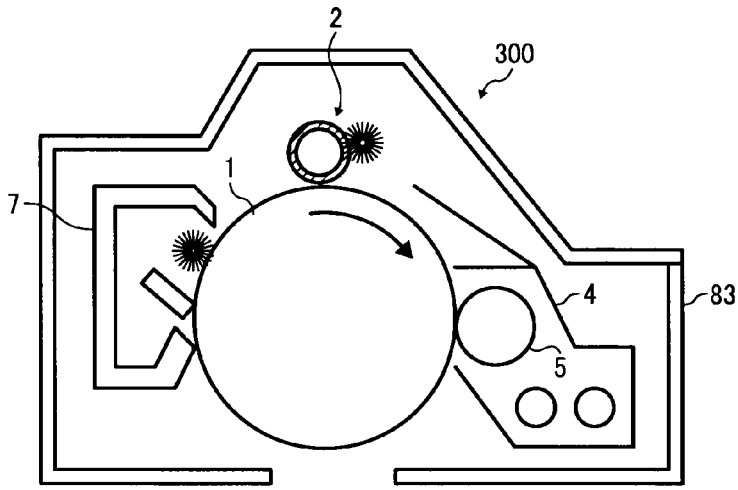
FIG. 37 is a schematic view illustrating an embodiment of a process cartridge according to exemplary embodiments.

Referring to FIG. 37, the photoconductor 1 and the cleaning device 7 may be integrally formed within a frame 83 to form a process cartridge 300 which can be attached to/detached from the image forming apparatus. Although not only the photoconductor 1 and the cleaning device 7, but also the charger 2 and the developing device 4 are integrally provided in the process cartridge 300 illustrated in FIG. 37, the process cartridge 300 in which at least the photoconductor 1 and the cleaning device 7 are integrally provided is applicable.

Examples of employing the cleaning device 7 according to exemplary embodiments in a color image forming apparatus are described in detail below with reference to FIGS. 38 through 40.

Figure 38:
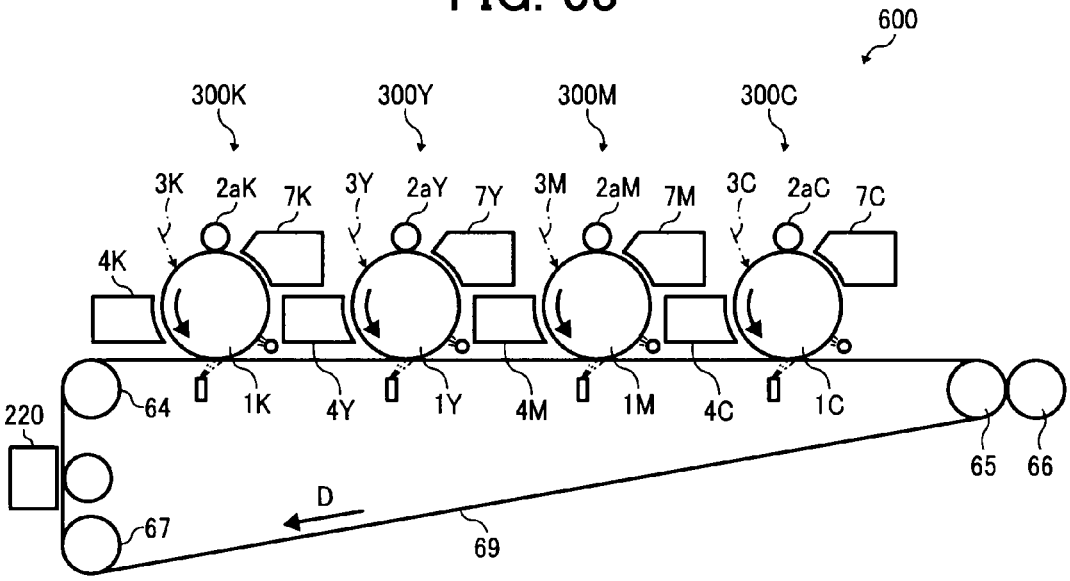
FIG. 38 is a schematic view illustrating main components of a tandem type full-color image forming apparatus according to exemplary embodiments.

FIG. 38 is a schematic view illustrating a tandem type full-color image forming apparatus 600 in which cleaning devices 7Y, 7M, 7C, and 7K (hereinafter collectively referred to as the "cleaning device 7") according to exemplary embodiments are employed. The tandem type full-color image forming apparatus 600 includes an intermediate transfer belt 69 tightly stretched across a plurality of rollers 64, 65, and 67, such that a horizontal length of the tandem type full-color image forming apparatus 600 is longer than a vertical length thereof when the tandem type full-color image forming apparatus 600 is installed on a horizontal surface. The intermediate transfer belt 69 is driven in a direction indicated by an arrow D in FIG. 38. The above-described four process cartridges 300Y, 300M, 300C, and 300K (hereinafter collectively referred to as the "process cartridge 300") configured to form yellow, magenta, cyan, and black images, respectively, are aligned on a horizontally stretched portion of the intermediate transfer belt 69. The alignment order of the process cartridges 300Y, 300M, 300C, and 300K is not limited thereto. The process cartridges 300Y, 300M, 300C, and 300K may be aligned in any desired order.

A typical color image forming apparatus is large in size because of including a plurality of image forming parts. In addition, such a color image forming apparatus has a complicated configuration. Therefore, it takes a lot of trouble replacing each image forming unit, such as a cleaning unit and a charging unit, when the image forming unit is out of order or the life thereof comes to the end. Use of a process cartridge, which integrally supports image forming units such as a photoconductor, a charging roller, a developing device, and a cleaning device, solves the above-described problems and provide a compact color image forming apparatus having high durability and good maintainability.

The tandem type full-color image forming apparatus 600 further includes a paper feed cassette, not shown, in which a plurality of sheets P, not shown, is stored. A paper feed roller, not shown, feeds the sheet P sheet by sheet from the paper feed cassette, and the sheet P is conveyed to a secondary transfer area between a secondary transfer roller 66 and the intermediate transfer belt 69 at a timing controlled by a pair of registration rollers, not shown.

When image forming processes are started in the tandem type full-color image forming apparatus 600, photoconductors 1Y, 1M, 1C, and 1K (hereinafter collectively referred to as the "photoconductor 1") are rotated in a counterclockwise direction, and the intermediate transfer belt 69 is driven in the direction indicated by the arrow D in FIG. 38. After charging rollers 2*a*Y, 2*a*M, 2*a*C, and 2*a*K (hereinafter collectively referred to as the "charging roller 2*a*") have evenly charged the surface of the photoconductor 1, laser beams 3Y, 3M, 3C, and 3K (hereinafter collectively referred to as the "laser beam 3"), which are modulated with image data of each color, are irradiated to the surface of the photoconductor 1 to form electrostatic latent images of yellow, magenta, cyan, and black, on the surface of the photoconductor 1, respectively. Subsequently, developing devices 4Y, 4M, 4C, and 4K (hereinafter collectively referred to as the "developing device 4") develop the electrostatic latent images of each color with toners of corresponding colors to form toner images of each color. Obtained toner images of each color are primarily transferred onto the intermediate transfer belt 69 such that the toner images are superimposed on one another. The superimposed toner images are transferred by the secondary transfer roller 66 onto the sheet P conveyed to the secondary transfer area. The sheet P having a transferred toner image thereon is conveyed to a fixing device, not shown. In the fixing device, heat and pressure are applied to the sheet P to fix the toner image onto the sheet P. After fixing has been performed, the sheet P is discharged to a discharge tray, not shown. The residual toner particles on the surface of the photoconductor 1 after transfer has been performed are removed by the cleaning device 7. The residual toner particles on the surface of the intermediate transfer belt 69 are removed by an intermediate transfer belt cleaning device 220. The intermediate transfer belt cleaning device 220 may have the same configuration as the cleaning device 7.

Even if residual toner particles remaining on the photoconductor 1 include both positively-charged and negatively-charged toner particles, the residual toner particles can be preferably removed from the surfaces of the photoconductor 1 by using the cleaning device 7 in the tandem type full-color image forming apparatus 600 shown in FIG. 38. Moreover, even if residual toner particles remaining on the intermediate transfer belt 69 include both positively-charged and negatively-charged toner particles, the residual toner particles can be preferably removed from the surfaces of the intermediate transfer belt 69 by using the intermediate transfer belt cleaning device 220 in the tandem type full-color image forming apparatus 600 shown in FIG. 38.

Figure 39:
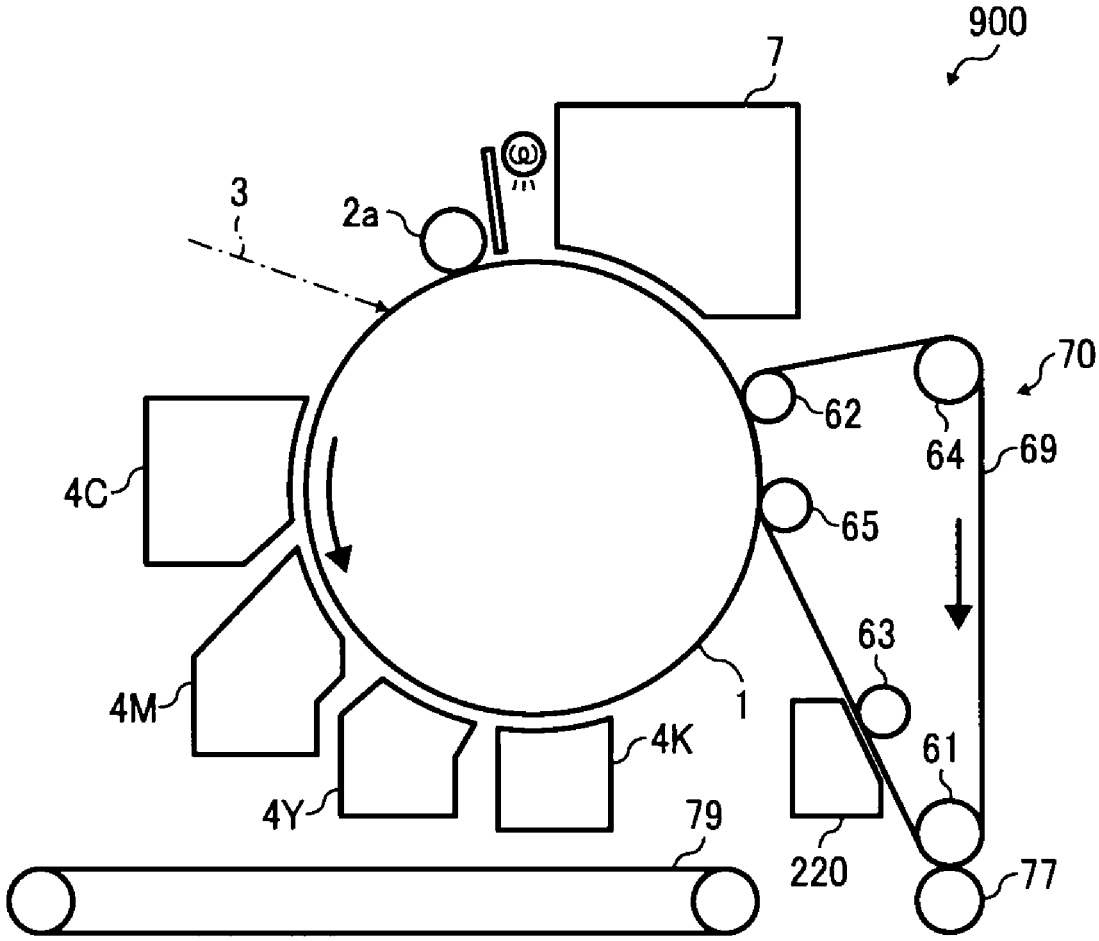
FIG. 39 is a schematic view illustrating main components of a single-drum type full-color image forming apparatus according to exemplary embodiments.

FIG. 39 is a schematic view illustrating a single-drum type full-color image forming apparatus 900 in which the cleaning device 7 according to exemplary embodiments is employed. In the single-drum type full-color image forming apparatus 900, a photoconductor 1 is provided within a casing, not shown. A charging roller 2*a*, developing devices 4C, 4M, 4Y, and 4K corresponding to toner colors of cyan (C), magenta (M), yellow (Y), and black (K), respectively, an intermediate transfer device 70, the cleaning device 7, and so forth, are provided around the photoconductor 1. The single-drum type full-color image forming apparatus 900 further includes a paper feed cassette, not shown, in which a plurality of sheets P, not shown, is stored. A paper feed roller, not shown, feeds the sheet P sheet by sheet from the paper feed cassette, and the sheet P is conveyed to a secondary transfer area between a secondary transfer roller 77 and the intermediate transfer device 70 at a timing controlled by a pair of registration rollers, not shown.

Each of the developing devices 4C, 4M, 4Y, and 4K includes a developing sleeve, not shown, which rotates to bring magnet brushes of a developer formed thereon into contact with the surface of the photoconductor 1 so that an electrostatic latent image is developed, and a developer paddle, not shown, which rotates to draw up and agitate a developer. A toner contained in each developing device is agitated with a ferrite carrier so that the toner is negatively charged to have a charge amount of from −10 to −25 μC/g. A developing bias, in which an alternating current voltage Vac is overlapped with a negative direct current voltage Vdc or consisting of a direct current voltage, is applied to the developing sleeve from a developing bias power source serving as a developing bias applying device, not shown, so that the developing sleeve is biased to a predetermined potential relative to a metal substrate layer of the photoconductor 1.

The intermediate transfer device 70 includes the intermediate transfer belt 69, an intermediate transfer belt cleaning device 220, and so forth. The intermediate transfer belt 69 is stretched across a driving roller 61, a bias roller 62, a cleaning facing roller 63, and driven rollers 64 and 65, and is driven by a driving motor, not shown. The intermediate transfer belt 69 includes a fluorocarbon resin ETFE (ethylene tetrafluoroethylene) in which a carbon is dispersed, and has a volume resistivity of $10^{10}\Omega\cdot$cm and a surface resistivity of $10^{9}\Omega/\square$. The secondary transfer roller 77 includes an epichlorohydrin rubber roller covered with a PFE tube, and has a volume resistivity of $10^{9}\Omega\cdot$cm. A secondary transfer bias, in which an alternating current voltage is overlapped with a negative direct current voltage or consisting of a direct current voltage, is applied to the secondary transfer roller 77 from a secondary bias power source serving as a secondary bias applying device, not shown.

When image forming processes are started in the single-drum type full-color image forming apparatus 900, a color scanner, not shown, reads color image information of an original image by reading each color separation light, such as Red (R), Green (G), Blue (B), of the original image. Particularly, an irradiating lamp of the color scanner irradiates the original image set on a contact glass so that color image information is provided to a color sensor through mirrors and lenses. The color sensor includes, for example, a color separation device configured to separate color image information into lights of R, G, and B, and a photoelectric transducer such as a CCD. The color sensor simultaneously reads color separation lights of R, G, and B of the original image. The thus read color image information is converted into an electrical signal. The signal obtained from the color image information of R, G, and B are subjected to a color conversion treatment in an image treatment part, not shown, so that color image data of cyan (C), magenta (M), yellow (Y), and black (K) are obtained.

In order to obtain the color image data of K, C, M, and Y, the color scanner operates as follows. At first, an optical system including an irradiating lamp and mirrors scans an original image, upon receiving a scanning start signal corresponding with a timing of an operation of a color printer. A single scanning operation reads single color image data. By repeating the scanning operation four times, color image data of four colors can be obtained.

The photoconductor 1 is rotated in a counterclockwise direction, and the intermediate transfer belt 69 is driven in a clockwise direction in FIG. 39. After the charging roller 2*a* has evenly charged the surface of the photoconductor 1 to an electric potential of from −500V to −700V, a laser beam 3 modulated with cyan image data is irradiated to the surface of the photoconductor 1 to form an electrostatic latent image of cyan having an electric potential of from −80V to −130V on the surface of the photoconductor 1. Subsequently, the developing device 4C develops the electrostatic latent image of cyan with a cyan toner. An obtained cyan toner image having a toner concentration of from 2% to 6% by weight is primarily transferred onto the intermediate transfer belt 69. After the cleaning device 7 has removed residual cyan toner particles from the surface of the photoconductor 1, the charging roller 2*a* evenly charges the surface of the photoconductor 1 again. Next, the laser beam 3 modulated with magenta image data is irradiated to the surface of the photoconductor 1 to form an electrostatic latent image of magenta on the surface of the photoconductor 1. Subsequently, the developing device 4M develops the electrostatic latent image of magenta with a magenta toner. An obtained magenta toner image is primarily transferred onto the intermediate transfer belt 69 such that the magenta toner image is superimposed on the cyan toner image primarily transferred onto the intermediate transfer belt 69 in advance. Thereafter, yellow and black toner images are primarily transferred onto the intermediate transfer belt 69, respectively, by the similar processes described above. The formation order of electrostatic latent images of each color on the photoconductor 1 is not limited to the above-described order. The electrostatic latent images of each color may be formed on the photoconductor 1 in any desired order. The primarily transfer bias voltages of the first, second, third, and fourth color are 1200V, 1300V, 1400V, and 1500V, respectively. The toner images of each color, which are superimposed on one another on the intermediate transfer belt 69, are transferred by the secondary transfer roller 77 onto the sheet P conveyed to the secondary transfer area. The secondary transfer bias voltage is 1300V. The sheet P having a transferred toner image thereon is conveyed to a fixing device, not shown, by a sheet conveyance belt 79. In the fixing device, heat and pressure are applied to the sheet P to fix the toner image onto the sheet P. After fixing has been performed, the sheet P is discharged to a discharge tray, not shown. The residual toner particles on the surface of the photoconductor 1 after transfer has been performed are removed by the cleaning device 7. The residual toner particles on the surface of the intermediate transfer belt 69 are removed by the intermediate transfer belt cleaning device 220. The intermediate transfer belt cleaning device 220 may have the same configuration as the cleaning device 7.

Even if residual toner particles remaining on the photoconductor 1 include both positively-charged and negatively-charged toner particles, the residual toner particles can be preferably removed from the surfaces of the photoconductor 1 by using the cleaning device 7 in the single-drum type full-color image forming apparatus 900 shown in FIG. 39. Moreover, even if residual toner particles remaining on the intermediate transfer belt 69 include both positively-charged and negatively-charged toner particles, the residual toner particles can be preferably removed from the surfaces of the intermediate transfer belt 69 by using the intermediate transfer belt cleaning device 220 in the single-drum type full-color image forming apparatus 900 shown in FIG. 39.

Figure 40:
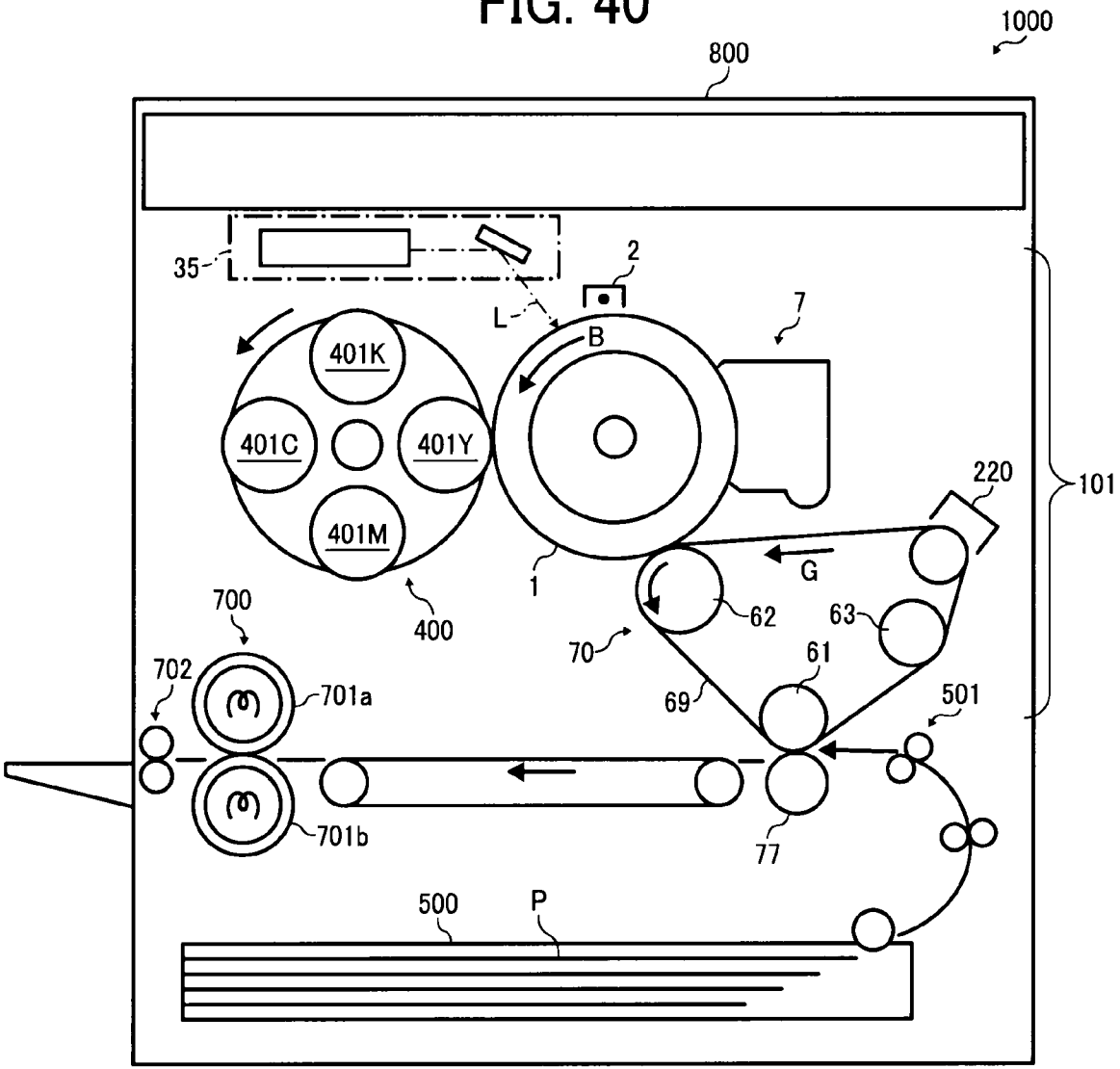
FIG. 40 is a schematic view illustrating main components of a revolver type full-color image forming apparatus according to exemplary embodiments.

FIG. 40 is a schematic view illustrating a revolver type full-color image forming apparatus 1000 in which the cleaning device 7 according to exemplary embodiments is employed. The revolver type full-color image forming apparatus 1000 includes an image forming part 101, a color image reading part (hereinafter referred to as a "color scanner") 800, a paper feeding part 500, and a controlling part, not shown.

The color scanner 800 reads color image information of an original image by reading each color separation light, such as Red (R), Green (G), and Blue (B), of the original image. The thus read color image information is converted into an electrical signal. The signal obtained from the color image information of R, G, and B are subjected to a color conversion treatment in an image treatment part, not shown, so that color image data of cyan (C), magenta (M), yellow (Y), and black (K) are obtained.

The image forming part 101 includes a photoconductor 1 serving as an image bearing member, a charger 2 serving as a charging device, an optical writing unit 35 serving as an irradiating device, a revolver developing unit 400 serving as a developing device, the cleaning device 7, an intermediate transfer device 70, a secondary transfer bias roller 77 serving as a secondary transfer device, and a fixing device 700 including a pair of fixing rollers 701*a* and 701*b*.

The photoconductor 1 rotates in a counterclockwise direction, as indicated by an arrow B. The charger 2, the revolver developing unit 400, the cleaning device 7, and an intermediate transfer belt 69 serving as an intermediate transfer member of the intermediate transfer device 70 are provided around the photoconductor 1.

The revolver developing unit 400 includes a black developing device 401K containing a black toner, a cyan developing device 401C containing a cyan toner, a magenta developing device 401M containing a magenta toner, a yellow developing device 401Y containing a yellow toner, a developing revolver driving part, not shown, to drive the revolver developing unit 400 to rotate in a counterclockwise direction, and so forth. Once a copying operation is started, one of the developing devices moves to an area (i.e., developing area) facing the photoconductor 1 to develop an electrostatic latent image with a first-color toner. After the rear end of the first-color toner image passes through the developing area, the revolver developing unit 400 rotates so that the next-color toner develops an electrostatic latent image.

The intermediate transfer device 70 includes the intermediate transfer belt 69 stretched across a primary transfer bias roller 62, a belt driving roller 61, a belt tension roller 63, etc. The above-described rollers are formed of a conductive material. The rollers except for the primary transfer bias roller 62 are grounded. A transfer bias, controlled to have a predetermined current or voltage according to the number of toner images superimposed, is applied to the primary transfer bias roller 62 from a primary transfer power source, not shown, controlled with a constant current or voltage. The intermediate transfer belt 69 is rotated in a direction indicated by an arrow G by the belt driving roller 61 rotated by a driving motor, not shown. A pre-transfer charger (hereinafter referred to as the "PTC"), not shown, configured to evenly charge a toner image before the toner image is transferred onto a paper P, the secondary transfer bias roller 77, an intermediate transfer belt cleaning device 220 serving as an intermediate transfer member cleaning device, and so forth, are provided around the intermediate transfer belt 69.

In a primary transfer area, where a toner image is transferred from the photoconductor 1 onto the intermediate transfer belt 69, the primary transfer bias roller 62 press the intermediate transfer belt 69 against the photoconductor 1 so that the intermediate transfer belt 69 is tightly stretched. Thereby, a nip having a predetermined width is formed between the photoconductor 1 and the intermediate transfer belt 69.

When image forming processes are started in the revolver type full-color image forming apparatus 1000, the photoconductor 1 is rotated in the counterclockwise direction indicated by the arrow B by a driving motor, not shown. Subsequently, the charger 2 evenly charges the photoconductor 1 to a predetermined negative potential by corona discharge. The optical writing unit 35 irradiates the photoconductor 1 with a raster light beam L based on a signal of a black color image so as to form an electrostatic latent image thereon. As described above, the electrostatic latent image is developed with the first-color toner. Subsequently, the intermediate transfer belt 69 is rotated in the counterclockwise direction indicated by the arrow G by the belt driving roller 61. Toner images of black, cyan, magenta, and yellow are successively superimposed on one another on the intermediate transfer belt 69 along with a rotation of the intermediate transfer belt 69. A transfer process in which a toner image is transferred from the photoconductor 1 onto the intermediate transfer belt 69 is hereinafter referred to as a "belt transfer process".

The intermediate transfer belt 69 may include a belt material having a multilayer structure including a surface layer, an intermediate layer, and a base layer, or a single-layer structure. In the revolver type full-color image forming apparatus 1000, a multilayered intermediate transfer belt having a thickness of 0.15 mm, a width of 368 mm, and an inner perimeter of 565 mm is used as the intermediate transfer belt 69. The intermediate transfer belt 69 is set to move at a velocity of 250 mm/sec. The intermediate transfer belt 69 includes a surface layer having a thickness of about 1 μm, which is insulative; an intermediate layer including PVDF (polyvinylidene fluoride) and having a thickness of about 75 μm, which is insulative (having a volume resistivity of about $10^{13}\Omega\cdot$cm); and a base layer including PVDF and titanium oxide and having a thickness of about 75 μm, which has a medium resistivity (having a volume resistivity of from $10^{8}$ to $10^{11}\Omega\cdot$cm). The intermediate transfer belt 69 including the above-described layers has a volume resistivity of from $10^{7}$ to $10^{4}\Omega\cdot$cm. The volume resistivity can be measured according to a method based on JIS K 6911, by applying a voltage of 100V for 10 seconds. The surface of the surface layer of the intermediate transfer belt 69 has a surface resistivity of from $10^{7}$ to $10^{4}\Omega/\square$, when measured by a resistivity meter HIRESTA IP manufactured by Yuka Denshi Co., Ltd. The surface resistivity can be also measured according to a method based on JIS K 6911.

The toner images of black, cyan, magenta, and yellow are successively formed on the photoconductor 1, and subsequently transferred from the photoconductor 1 one by one onto the same position of the intermediate transfer belt 69. As a result, a superimposed toner image, in which four toner images are superimposed on one another at a maximum, is formed. The superimposed toner image on the intermediate transfer belt 69 is evenly charged by the PTC, not shown. The sheet P is timely fed by a pair of registration rollers 501 to meet the superimposed toner image, so that the superimposed toner image is transferred onto the sheet P due to a transfer bias applied to the secondary transfer bias roller 77 (i.e., a secondary transfer process). The sheet P having the superimposed toner image thereon is diselectrified by a diselectrification device, not shown, and separated from the intermediate transfer belt 69. Subsequently, the sheet P having the superimposed toner image thereon is conveyed to the fixing device 700 so that the superimposed toner image is melted and fixed on the sheet P at the nip between the fixing rollers 701*a* and 701B, and discharged by a pair of discharge rollers 702.

On the other hand, residual toner particles remaining on the surface of the intermediate transfer belt 69 after the toner image is transferred onto the sheet P are removed by the intermediate transfer belt cleaning device 220.

The above-described embodiment refers to a four-color copying operation. A three-color or two-color copying operation can be similarly performed by specifying the kind and number of colors.

Even if residual toner particles remaining on the photoconductor 1 include both positively-charged and negatively-charged toner particles, the residual toner particles can be preferably removed from the surfaces of the photoconductor 1 by using the cleaning device 7 in the revolver type full-color image forming apparatus 1000 shown in FIG. 40. Moreover, even if residual toner particles remaining on the intermediate transfer belt 69 include both positively-charged and negatively-charged toner particles, the residual toner particles can be preferably removed from the surfaces of the intermediate transfer belt 69 by using the intermediate transfer belt cleaning device 220 in the revolver type full-color image forming apparatus 1000 shown in FIG. 40.

Elements and/or features of different exemplary embodiments may be combined with each other and/or substituted for each other within the scope of this disclosure and appended claims.

Example embodiments being thus described, it will be obvious that the same may be varied in many ways. Such exemplary variations are not to be regarded as a departure from the spirit and scope of the present invention, and all such modifications as would be obvious to one skilled in the art are intended to be included within the scope of the following claims.

The number of constituent elements, locations, shapes and so forth of the constituent elements are not limited to any of the structure for performing the methodology illustrated in the drawings.

What is claimed is:

1. A cleaning device, comprising:

a cleaning brush to remove residual toner particles from a cleaning target having a moving surface, the cleaning brush including a brush rotation shaft;

a power circuit configured to apply a first voltage of a first polarity to the brush rotation shaft; and a cleaning member configured to apply a second voltage of the first polarity to the cleaning brush, wherein the cleaning brush is configured to be triboelectrically charged to a second polarity by contacting the cleaning target, the second polarity being opposite to the first polarity of the voltage applied to the cleaning brush.

2. The cleaning device according to claim 1, further comprising:

a polarity control member to which a voltage with the second polarity is applied to control a polarity of a plurality of the residual toner particles on the cleaning target, the polarity control member being provided facing the cleaning target on an upstream side from a portion where the cleaning brush removes the residual toner particles from the cleaning target relative to a rotation direction of the cleaning target.

3. The cleaning device according to claim 2, wherein the polarity control member comprises a conductive blade provided in contact with the cleaning target.

4. The cleaning device according to claim 2, wherein the polarity control member comprises a conductive brush provided in contact with the cleaning target.

5. The cleaning device according to claim 1, wherein the cleaning brush comprises a brush string having a surface comprising an insulating material.

6. The cleaning device according to claim 5, wherein the cleaning brush removes the residual toner particles from the cleaning target while being rotated and the brush string is bent backward relative to a rotation direction of the cleaning brush.

7. The cleaning device according to claim 1, further comprising:

a switching member configured to switch a polarity of a voltage applied to the cleaning member, wherein the cleaning member is provided in contact with the cleaning brush.

8. The cleaning device according to claim 1, further comprising:

a polishing member to polish the surface of the cleaning target provided on a downstream side from the cleaning brush relative to a rotation direction of the cleaning target.

9. An image forming apparatus, comprising:

at least one image bearing member to bear an electrostatic latent image;

a charging device to charge a surface of the image bearing member;

an irradiating device to irradiate the charged surface of the image bearing member to form an electrostatic latent image thereon;

at least one developing device to develop the electrostatic latent image with a toner to form a toner image;

a transfer device to transfer the toner image onto a transfer member or a recording medium; and a cleaning device comprising:

a cleaning brush to remove residual toner particles from a cleaning target having a moving surface, the cleaning brush including a brush rotation shaft, a power circuit configured to apply a first voltage of a first polarity to the brush rotation shaft, and a cleaning member configured to apply a second voltage of the first polarity to the cleaning brush, wherein the cleaning brush is configured to be triboelectrically charged to a second polarity by contacting the cleaning target, the second polarity being opposite to the first polarity of the voltage applied to the cleaning brush, and wherein the cleaning target is the image bearing member.

10. The image forming apparatus according to claim 9, wherein the at least one developing device is configured as a plurality of developing devices to form a plurality of toner images on the at least one image bearing member, and the toner images are superimposed on one another to form a full-color image.

11. The image forming apparatus according to claim 9, wherein the at least one image bearing member is configured as a plurality of image bearing members, the at least one developing device is configured as a plurality of developing devices, each of which forms a toner image on each of the plurality of image bearing members, and the toner images formed on the plurality of image bearing members are superimposed on one another to form a full-color image.

12. The image forming apparatus according to claim 9, wherein the toner has a shape factor SF-1 of from 100 to 150.

13. The image forming apparatus according to claim 9, wherein the image bearing member comprises a surface protection layer comprising a filler.

14. The image forming apparatus according to claim 9, wherein the image bearing member comprises a surface protection layer comprising a cross-linked polymer.

15. The image forming apparatus according to claim 14, wherein the surface protection layer comprises a charge transport layer.

16. A process cartridge detachably attachable to an image forming apparatus, comprising:

an image bearing member; and a cleaning device comprising:

a cleaning brush to remove residual toner particles from a cleaning target having a moving surface, the cleaning brush including a brush rotation shaft, a power circuit configured to apply a first voltage of a first polarity to the brush rotation shaft, and a cleaning member configured to apply a second voltage of the first polarity to the cleaning brush, wherein the cleaning brush is configured to be triboelectrically charged to a second polarity by contacting the cleaning target, the second polarity being opposite to the first polarity of the voltage applied to the cleaning brush, and wherein the cleaning target is the image bearing member.

17. The cleaning device according to claim 1, wherein the brush includes brush strings and the brush strings comprise polyester.

18. The cleaning device according to claim 17, further comprising:

a brush charge application unit to apply a third voltage of the first polarity to the brush strings, wherein the brush charge application unit includes a bar extending in an axial direction of the brush rotation shaft and contacts a leading edge of the brush strings.

19. The cleaning device according to claim 18, wherein the bar comprises stainless steel and contacts the leading edge of the brush strings with an engagement of 1 mm.

* * * * *